US011680401B2

(12) United States Patent
Carrion et al.

(10) Patent No.: US 11,680,401 B2
(45) **Date of Patent: *Jun. 20, 2023**

(54) PRECAST WALL PANELS AND METHOD OF ERECTING A HIGH-RISE BUILDING USING THE PANELS

(71) Applicants: Skidmore Owings & Merrill LLP, New York, NY (US); Newco Ventures LLC, South Plainfield, NJ (US)

(72) Inventors: Juan Carrion, Lake Zurich, IL (US); William F. Baker, Evanston, IL (US); John A. Cavanagh, Centerport, NY (US); Robert C. Stewart, Annandale, NJ (US); James C. MacDonald, North Bergen, NJ (US); Charles Besjak, Westfield, NJ (US)

(73) Assignees: SKIDMORE, OWINGS & MERRILL LLP, New York, NY (US); NEWCO VENTURES LLC, South Plainfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/097,906

(22) Filed: Nov. 13, 2020

(65) Prior Publication Data

US 2021/0087810 A1 Mar. 25, 2021

Related U.S. Application Data

(60) Continuation of application No. 15/896,362, filed on Feb. 14, 2018, now abandoned, which is a (Continued)

(51) Int. Cl.
*E04B 2/64* (2006.01)
*E04B 1/04* (2006.01)
(Continued)

(52) U.S. Cl.
CPC ..... *E04B 2/64* (2013.01); *E04B 1/04* (2013.01); *E04B 1/24* (2013.01); *E04B 1/34* (2013.01);
(Continued)

(58) Field of Classification Search
CPC ..... E04B 2/64; E04B 1/04; E04B 1/24; E04B 1/34; E04B 1/2403; E04B 2001/2415;
(Continued)

(56) References Cited

U.S. PATENT DOCUMENTS 1,031,926 A 7/1912 Hansbrough
1,501,288 A 4/1920 Morley
(Continued)

FOREIGN PATENT DOCUMENTS

CA 1147928 6/1983
CN 1514902 7/2004
(Continued)

OTHER PUBLICATIONS

Japanese Patent Office Action corresponding to Japanese Serial No. 2013-553504 dated Nov. 4, 2015.
(Continued)

*Primary Examiner* — Brian D Mattei
*Assistant Examiner* — Omar F Hijaz
(74) *Attorney, Agent, or Firm* — Dentons US LLP

(57) ABSTRACT

Precast wall systems and methods for constructing a high-rise building using the precast wall system is disclosed. In one embodiment, the system includes a plurality of interconnected precast panels, each having a top end plate, a bottom end plate, a plurality of vertical bars disposed between the end plates and a cementitious material encasing the vertical bars and defining a plurality of sides of the respective panel. A first of the precast panels has a first column member half defining a right side of the first panel,
(Continued)

a second of the precast panels has a second column member half defining a left side of the second panel such that, when the right side of the first precast panel and the left side of the second precast panel are disposed horizontally adjacent to each other, the first column member half and the second column member half collectively form a column member.

32 Claims, 41 Drawing Sheets

Related U.S. Application Data continuation of application No. 13/874,760, filed on May 1, 2013, now abandoned, which is a division of application No. 13/023,062, filed on Feb. 8, 2011, now Pat. No. 8,631,616, which is a continuation-in-part of application No. 12/356,414, filed on Jan. 20, 2009, now Pat. No. 8,074,414.

(51) Int. Cl.

| | |
|---|---|
| ***E04B 1/24*** | (2006.01) |
| ***E04B 1/34*** | (2006.01) |
| ***E04G 21/16*** | (2006.01) |
| ***E04G 21/26*** | (2006.01) |
| ***E04C 2/06*** | (2006.01) |

(52) U.S. Cl.

CPC ..... *E04C 2/06* (2013.01); *E04G 21/16* (2013.01); *E04G 21/26* (2013.01); *E04B 1/2403* (2013.01); *E04B 2001/2415* (2013.01); *E04B 2001/2496* (2013.01)

(58) Field of Classification Search

CPC ... E04B 2001/2496; E04C 2/06; E04G 21/16; E04G 21/26

See application file for complete search history.

(56) References Cited

U.S. PATENT DOCUMENTS

| | | | |
|---|---|---|---|
| 1,637,215 | A | 7/1927 | Coppock |
| 1,900,656 | A | 5/1931 | Kotrbaty |
| 2,142,305 | A | 9/1939 | Davis |
| 2,618,146 | A | 12/1946 | Ciarlini |
| 2,751,776 | A | 7/1950 | Streblow et al. |
| 2,664,740 | A | 1/1954 | Cochrane |
| 2,673,459 | A | 3/1954 | Overhulse |
| 2,883,852 | A | 4/1959 | Midby |
| 3,261,135 | A | 7/1966 | Knabe |
| 3,292,331 | A | 12/1966 | Sams |
| 3,355,852 | A | 11/1967 | Lally |
| 3,398,498 | A | 8/1968 | Krauss |
| 3,435,580 | A | 4/1969 | Merrill et al. |
| 3,494,092 | A | 2/1970 | Bottjer et al. |
| 3,512,819 | A | 5/1970 | Morgan et al. |
| 3,640,039 | A | 2/1972 | McKee et al. |
| 3,782,061 | A | 1/1974 | Minutoli |
| 3,851,024 | A | 11/1974 | Cull et al. |
| 3,882,649 | A | 5/1975 | Mah et al. |
| 3,908,324 | A | 9/1975 | Stout |
| 4,018,021 | A | 4/1977 | Dow |
| 4,059,939 | A | 11/1977 | Elliott |
| 4,065,905 | A | 1/1978 | van der Lely |
| 4,145,861 | A | 3/1979 | Yarnick |
| 4,219,978 | A | 9/1980 | Brown |
| 4,294,051 | A | 10/1981 | Hughes, Jr. |
| 4,606,165 | A | 8/1986 | Allan |
| 4,635,422 | A | 1/1987 | Nowack et al. |
| 4,649,682 | A | 3/1987 | Barrett, Jr. |
| 4,936,069 | A | 6/1990 | Hunter et al. |
| 5,035,100 | A | 7/1991 | Sachs |
| 5,048,257 | A | 9/1991 | Ludtke |
| 5,065,558 | A | 11/1991 | Boatsman |
| 5,152,118 | A | 10/1992 | Lancelot |
| 5,184,808 | A | 2/1993 | Vesper |
| 5,493,836 | A | 2/1996 | Lopez-Munoz |
| 5,590,497 | A | 1/1997 | Moore |
| 5,706,620 | A | 1/1998 | De Zen |
| 5,737,895 | A | 4/1998 | Perrin |
| 5,761,862 | A | 6/1998 | Hendershot et al. |
| 5,813,175 | A | 9/1998 | Hiragaki |
| 6,076,319 | A | 6/2000 | Hendershot et al. |
| 6,230,465 | B1 | 5/2001 | Messenger et al. |
| 6,301,851 | B1 | 10/2001 | Matsubara |
| 6,457,281 | B1 | 10/2002 | Teron |
| 6,477,814 | B1 | 11/2002 | Kadosh |
| 6,493,996 | B1 | 12/2002 | Alexander et al. |
| 6,516,583 | B1 | 2/2003 | Houghton |
| 6,543,371 | B1 | 4/2003 | Gardner |
| 6,557,316 | B2 | 5/2003 | Van Der Heijden |
| 6,658,799 | B1 | 12/2003 | Stoodley |
| 6,892,498 | B1 | 5/2005 | Roman |
| 6,955,016 | B1 | 10/2005 | Churches |
| 6,959,515 | B1 | 11/2005 | Beighton |
| 7,114,695 | B2 | 10/2006 | DeLoach, Sr. |
| 7,121,061 | B2 | 10/2006 | Jazzar |
| 7,121,520 | B2 | 10/2006 | Khoo |
| 7,140,155 | B1 | 11/2006 | Nasimov |
| 7,185,467 | B2 | 3/2007 | Marty |
| 7,204,060 | B2 | 4/2007 | Hunt |
| 7,475,517 | B2 | 1/2009 | Kawai et al. |
| 7,665,264 | B1 | 2/2010 | Wolfe |
| 7,941,985 | B2 | 5/2011 | Simmons |
| 8,166,717 | B2 | 5/2012 | Kim |
| 8,307,601 | B2 | 11/2012 | Bonelli |
| 2002/0104286 | A1 | 8/2002 | Gregel |
| 2003/0183742 | A1 | 10/2003 | Deloach |
| 2004/0020145 | A1 | 2/2004 | Matsufuji |
| 2004/0052589 | A1 | 3/2004 | Lewis |
| 2004/0118066 | A1 | 6/2004 | DeLoach |
| 2004/0118069 | A1 | 6/2004 | Budge |
| 2004/0118080 | A1 | 6/2004 | Jazzar |
| 2004/0211140 | A1 | 10/2004 | Suzuki et al. |
| 2006/0185305 | A1 | 8/2006 | Schaffer |
| 2006/0272251 | A1 | 12/2006 | Hatzinikolas |
| 2008/0060293 | A1 | 3/2008 | Hanlon |
| 2008/0083181 | A1 | 4/2008 | Ospina |
| 2009/0094915 | A1 | 4/2009 | Liberman |
| 2009/0249725 | A1 | 10/2009 | McDonagh |
| 2010/0058686 | A1 | 3/2010 | Henriquez |
| 2010/0162658 | A1 | 7/2010 | Nagy et al. |
| 2010/0180519 | A1 | 7/2010 | Carrion et al. |
| 2011/0023397 | A1 | 2/2011 | Charvoz |
| 2011/0030288 | A1 | 2/2011 | Traulsen et al. |
| 2011/0094182 | A1 | 4/2011 | Kim |

FOREIGN PATENT DOCUMENTS

| | | |
|---|---|---|
| CN | 1607300 | 4/2005 |
| CN | 101680227 | 3/2010 |
| JP | H01-230843 | 9/1989 |
| KR | 100864604 B1 | 10/2008 |

OTHER PUBLICATIONS

Chinese Office Action dated Dec. 16, 2014 corresponding to Chinese Serial No. 201280008218.0.

European Search Report corresponding to European Serial No. 09838994.3 dated Apr. 30, 2014.

India Patent Office Action issued in connection with related India Application No. 5476/DELNP/2011 dated Jun. 19, 2018 with translation.

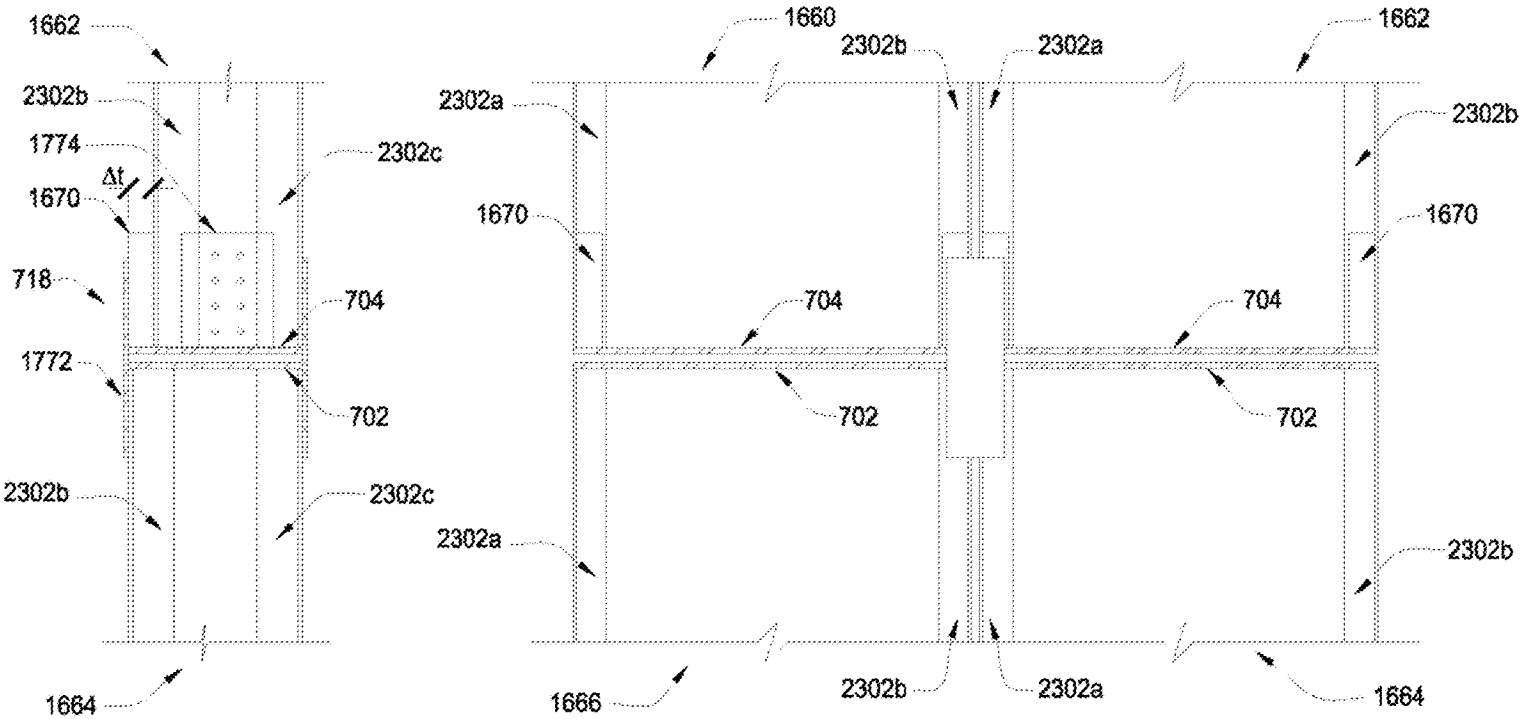
FIG. 16D
FIG. 16C
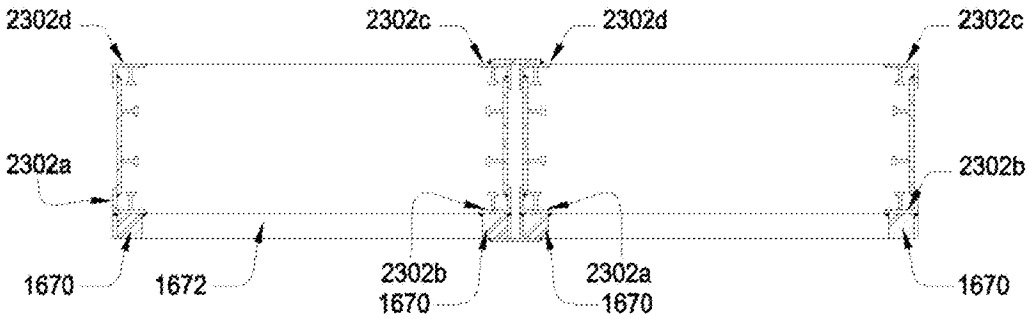
FIG. 16E

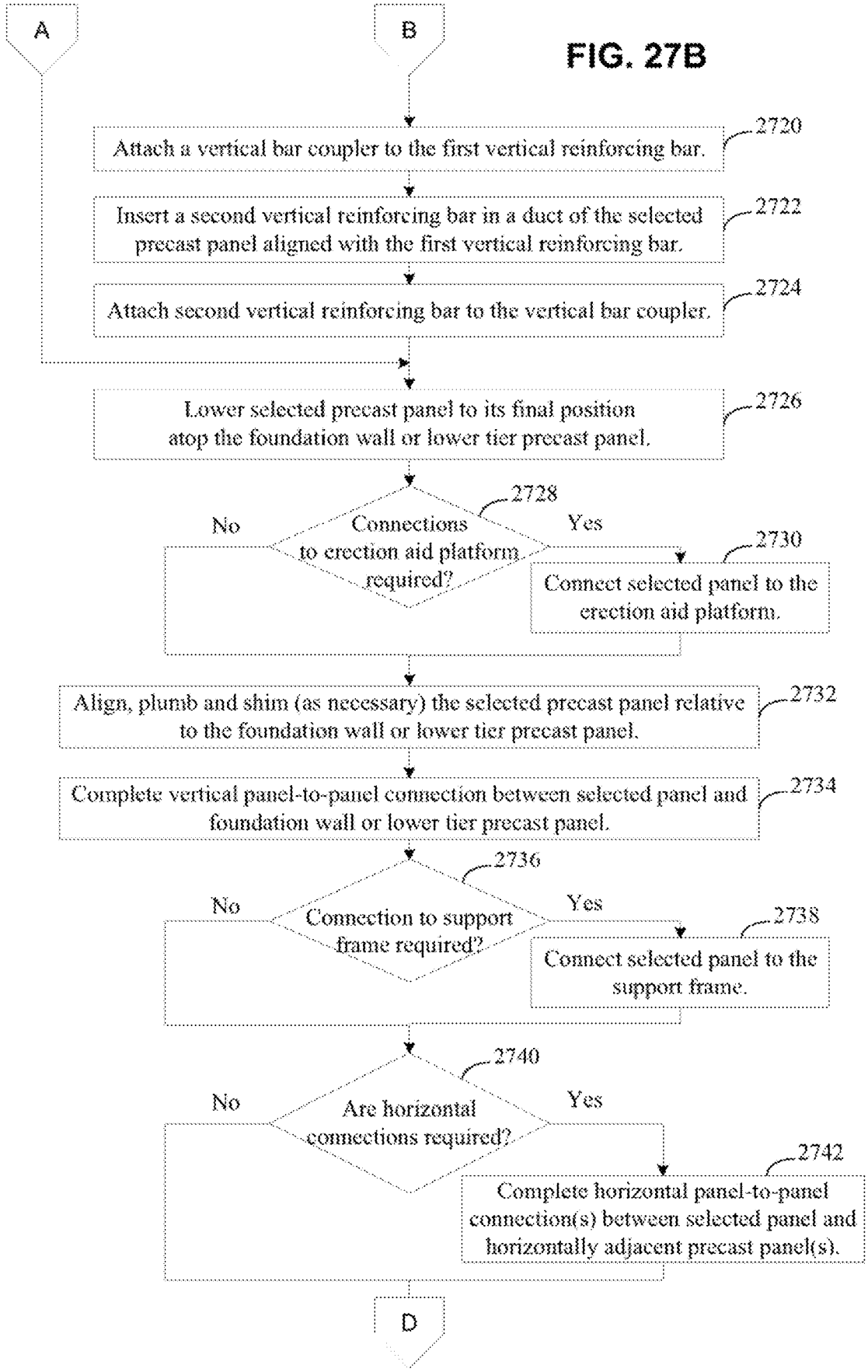
A
B
FIG. 27B
Attach a vertical bar coupler to the first vertical reinforcing bar.
2720
Insert a second vertical reinforcing bar in a duct of the selected precast panel aligned with the first vertical reinforcing bar.
2722
Attach second vertical reinforcing bar to the vertical bar coupler.
2724
Lower selected precast panel to its final position atop the foundation wall or lower tier precast panel.
2726
Connections to erection aid platform required?
2728
No
Yes
Connect selected panel to the erection aid platform.
2730
Align, plumb and shim (as necessary) the selected precast panel relative to the foundation wall or lower tier precast panel.
2732
Complete vertical panel-to-panel connection between selected panel and foundation wall or lower tier precast panel.
2734
Connection to support frame required?
2736
No
Yes
Connect selected panel to the support frame.
2738
Are horizontal connections required?
2740
No
Yes
Complete horizontal panel-to-panel connection(s) between selected panel and horizontally adjacent precast panel(s).
2742
D

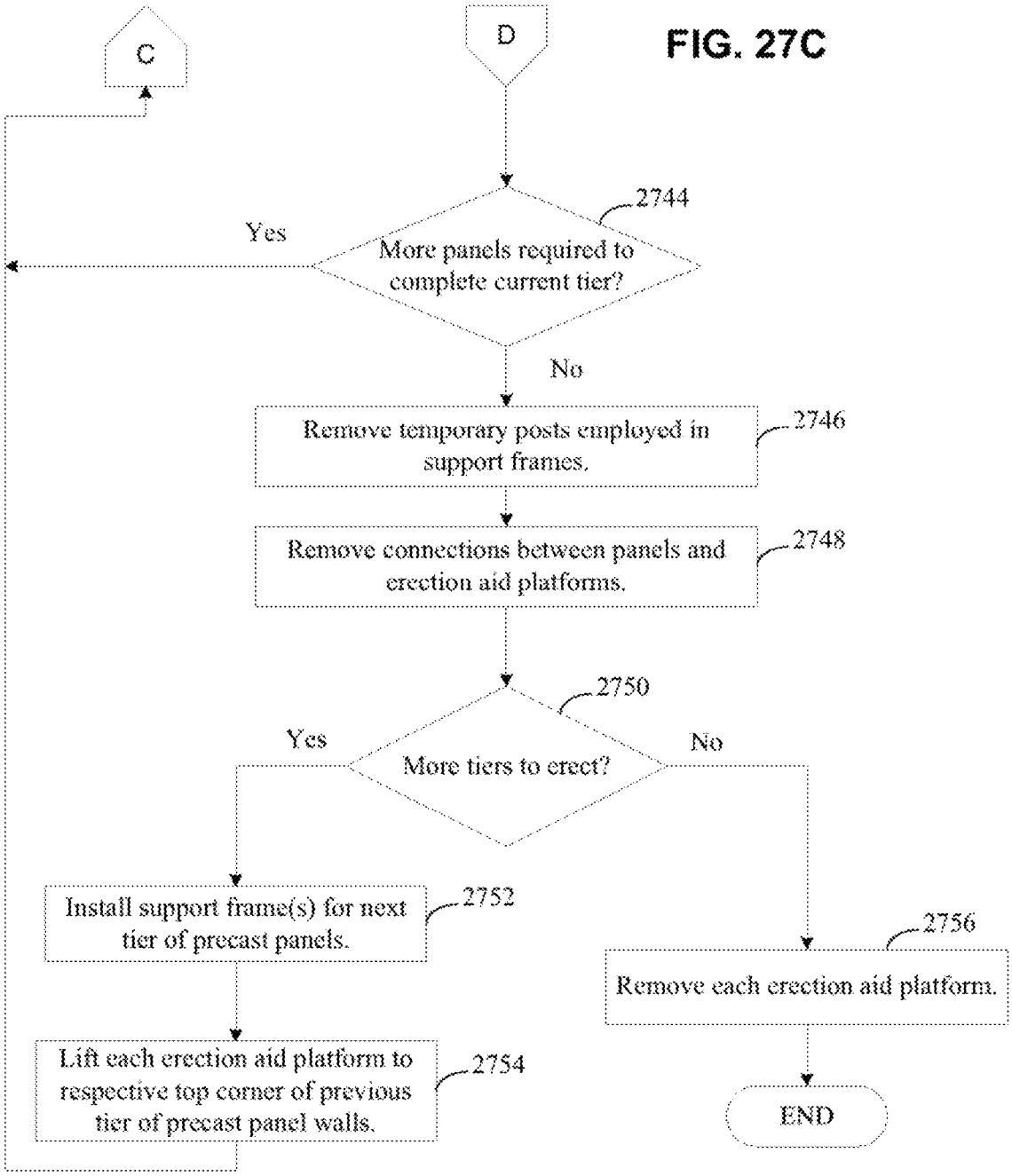
C
D
FIG. 27C
2744
More panels required to complete current tier?
Yes
No
Remove temporary posts employed in support frames.
2746
Remove connections between panels and erection aid platforms.
2748
2750
More tiers to erect?
Yes
No
Install support frame(s) for next tier of precast panels.
2752
Lift each erection aid platform to respective top corner of previous tier of precast panel walls.
2754
2756
Remove each erection aid platform.
END

PRECAST WALL PANELS AND METHOD OF ERECTING A HIGH-RISE BUILDING USING THE PANELS

CROSS-REFERENCE TO RELATED APPLICATIONS

This application is a continuation of U.S. patent application Ser. No. 15/896,362 filed Feb. 14, 2018, which is a continuation of U.S. patent application Ser. No. 13/874,760 filed May 1, 2013, now abandoned, which is a divisional of U.S. patent application Ser. No. 13/023,062 filed Feb. 8, 2011, which has since issued as U.S. Pat. No. 8,631,616 on Jan. 2, 2014, which is a continuation-in-part of U.S. patent application Ser. No. 12/356,414 filed on Jan. 20, 2009, which has since issued as U.S. Pat. No. 8,074,414 on Dec. 13, 2011, the entireties of which are incorporated herein by reference to the extent permitted by law.

BACKGROUND OF THE INVENTION

The present invention relates to static building structures, and more particularly, to precast wall panels that may be interconnected to form a core or perimeter wall system for erecting or constructing a high-rise building or other walled structure.

High-rise buildings typically are constructed to have six or more floors or stories above ground level. The design of a high-rise building is usually governed by wind effects. One of the most efficient structural systems to resist wind loads for a high-rise building is an interior or core wall system. Conventional core wall systems for high-rise buildings are typically constructed from concrete (cast-in-place over rebar cages for reinforcement) for each story of the high-rise building. In certain markets, conventional core wall systems incorporate structural steel columns and floor beams erected prior to the construction of the cast-in-place core walls. In these conventional core wall systems, concrete is cast in place over the structural steel columns and floor beams. A concrete core wall system provides a number of benefits compared to a structural steel system. Concrete core walls have higher structural damping than structural steel systems, therefore reducing the amount of sway and drift due to wind loads. Concrete core walls provide increased safety and security for fire stairs, standpipes, and communications systems. Because of these reasons, following the events of Sep. 11, 2001, there has been even more emphasis on the use of concrete core walls systems for erecting or constructing high-rise buildings.

As previously noted, conventional concrete core systems used to erect a high-rise building have been constructed using cast-in-place reinforced concrete, including concrete cast-in-place over a previously erected steel structure. The disadvantages of cast-in-place concrete cores versus structural steel core frames is the labor intensity, extended construction schedule, miss-located embedded plates, and shrinkage and creep effects. Moreover, construction workers often cannot work on a floor or story of a high-rise building while concrete contractors are working on a story above the construction workers due to the risk of falling concrete. Thus, using cast-in-place concrete core wall systems to construct or erect a high-rise building often increases the time required to erect the building and adds costs if other construction workers are idled while the concrete contractors work to form the cast-in-place concrete core wall systems.

Conventional precast modular components (such as those described in U.S. Pat. Nos. 3,952,471; 4,142,340; 6,076,319; 6,301,851; 6,457,281 and 6,493,996) have been used to construct volumetric enclosures such as low rise building structures, rooms, basements, cisterns, factories, retaining walls, and flood control dykes. However, these conventional precast components are not suitable for constructing or erecting a high-rise building. In particular, these conventional precast components, and structures built from such components, lack sufficient strength to resist and transfer wind and gravity loads as present in core wall systems of a high-rise building.

There is therefore a need for precast wall panels and a method of constructing a precast wall system that overcomes the problems noted above and enables the erection of core walls for a high-rise building.

SUMMARY OF THE INVENTION

Systems and methods consistent with the present invention provide precast wall panels that may be interconnected to form a core or perimeter wall system for erecting or constructing a high-rise building or other walled structure. Precast core or perimeter wall systems (hereinafter a "precast wall system") consistent with the present invention offer an attractive alternative to cast-in-place concrete core systems. Precast wall panels as described herein may be prepared (using concrete or other cementitious material) in advance under controlled conditions providing improved quality control and an opportunity for pre-inspection, verification and correction, if necessary, before being shipped to the construction site, therefore resulting in superior quality products. The precast wall panels also allow construction of a high-rise building even under difficult weather conditions. Furthermore, the construction speed possible with precast wall systems consistent with the present invention reduces construction schedule, minimizes on-site labor costs, and provides significant economy to the high-rise building project.

In accordance with systems consistent with the present invention, a precast wall system is provided. The precast wall system comprises a plurality of interconnected precast panels. Each precast panel has a top end plate, a bottom end plate, a plurality of vertical bars disposed between and attached to the end plates (to effectively function as one means to transfer vertical loads), and a cementitious material (such as concrete) encasing the vertical bars and defining a plurality of sides of the respective panel. In one implementation, a second plurality of the interconnected precast panels are arranged on and vertically adjacent to a first plurality of the interconnected precast panels and the top end plate of each panel corresponding the first plurality is connected to the bottom end plate of a respective one of the panels corresponding to the second plurality. Each of the interconnected precast panels may have a length corresponding to one or more stories of a building.

In addition, in one implementation for vertically connecting the precast panels, the precast wall system may further comprise a panel-to-panel vertical reinforcing member, such as a vertical reinforcing bar or tensioning cable. In this implementation, a first of the first plurality of precast panels has a duct extending from the top end plate of the first panel towards the bottom plate of the first panel. The top end plate of the first panel has a opening extending through the top end plate and in axial alignment with the duct of the first panel. A second of the second plurality of precast panels also has a duct extending from the top end plate of the second panel to the bottom plate of the second panel. The two end plates of the second panel each has a opening extending through the respective plate and in axial alignment with the duct of the second panel. The vertical reinforcing member is disposed in and extends through the duct of the second panel, the opening of the bottom end plate of the second panel, the opening of the top end plate of the first panel and the duct of the first panel.

In one implementation for horizontally connecting the precast panels, a first of the precast panels has a first side plate affixed to a side of the first precast panel and a second of the precast panels has a second side plate affixed to a side of the second precast panel that is adjacent to the first precast panel. The first side plate of the first precast panel is affixed to the second side plate of the second precast panel.

In another implementation for horizontally connecting the precast panels, the precast wall system may include a panel-to-panel horizontal reinforcing member, such as a vertical reinforcing bar or tensioning cable. A first of the first plurality of precast panels has a first duct extending through a first width of the first panel. A second of the second plurality of precast panels has a second duct extending through a second width of the second panel in axial alignment with the first duct of the first panel. The horizontal reinforcing member is disposed in and extends through the first duct of the panel and the second duct of the second panel.

In accordance with systems consistent with the present invention, another embodiment of a precast wall system is provided. The precast wall system comprises a plurality of precast panels. Each precast panel includes a cementitious material (such as reinforced concrete) and has a right side, a left side, a front side and a back side defining a plurality of corner edges extending a height of the respective precast panel. Each precast panel further includes a plurality of structural angles. Each angle is disposed along a respective one of the corner edges of the precast panel. Each angle has a first leg that extends along and is embedded in one of the right side or the left side of the panel and a second leg that extends along and is embedded in one of the front side or the back side of the respective panel. To implement a vertical panel-to-panel connection (in addition to or in lieu of affixing facing end plates of the first and second panels), a first of the precast panels may be arranged vertically on a second of the precast panels and each structural angle of the first precast panel may then be affixed to a corresponding one of the structural angles of the second precast panel. To implement a horizontal panel-to-panel connection, each structural angle of the first precast panel may have a leg embedded on the right side of the first precast panel that is horizontally aligned with and affixed to a corresponding structural angle of another of the precast panels having a leg embedded on the left side of the other precast panel.

Another embodiment of a precast panel is provided, in which the precast panel comprises a cementitious material and has a top end, a bottom end, a front side and a back side. The precast panel further includes a first plurality of lifting lugs. Each lifting lug includes a body and a first end extending and curving away from the body. The body of each lifting lug is configured to be removably attached to one of the front side or back side of the precast panel. The first end of each lifting lug has an attachment point (such as an orifice) for a hoisting rig. The first plurality of lifting lugs are attached in proximity to and spaced about the top end of the precast panel so that the first end of each lifting lug extends beyond and curves away from the top end. In one implementation, the first end of each lifting lug curves away from the top end of the precast panel such that the first end of each lifting lug is effective to capture and guide another vertically adjacent precast panel towards the top end of the precast panel having the first plurality of lifting lugs. In addition, the precast panel having the first plurality of lifting lugs may also have a second plurality of lifting lugs attached in proximity to and spaced about the bottom end of the precast panel. The first end of each of the second plurality of lifting lugs extends beyond and curves away from the bottom end of the precast panel such that the first end of each of the second plurality of lifting lugs effectively captures a top end of another precast panel disposed below the precast panel having the second plurality of lifting lugs.

In accordance with systems consistent with the present invention, another embodiment of a precast wall system is provided. The precast wall system comprises a plurality of horizontally interconnected precast panels. Each precast panel has a top end plate, a bottom end plate, a plurality of vertical bars disposed between the end plates and a cementitious material encasing the vertical bars and defining a plurality of sides of the respective panel. A first of the precast panels has a first column member half defining a right side of the first panel. A second of the precast panels has a second column member half defining a left side of the second panel. When the right side of the first precast panel and the left side of the second precast panel are disposed horizontally adjacent to each other, the first column member half and the second column member half collectively form a column member. The column member has a strength to support a gravity column, providing transition between systems consistent with the present invention and systems with steel columns.

In one implementation, one of the first plurality of horizontally interconnected precast panels is a corner precast panel that includes a column member having an end partially encased in the corner precast panel and another end extending above the top of the corner precast panel. The column member has a strength to support a gravity column.

In accordance with systems consistent with the present invention, another embodiment of a precast wall system is provided. In this embodiment, the precast wall system comprises a transfer member; a connection plate; a second plurality of horizontally interconnected precast panels defining a lower tier; and a first plurality of interconnected precast panels arranged on and vertically adjacent to the second plurality of the interconnected precast panels to define an upper tier. Each precast panel has a top end plate, a bottom end plate, a plurality of vertical bars disposed between the end plates and a cementitious material encasing the vertical bars and defining a plurality of sides of the respective panel. The upper tier precast panels are thinner than the lower tier precast panels. Each precast panel has a plurality of corner edges extending a height of the precast panel and each precast panel further includes a plurality of structural angles. Each angle is disposed along a respective one of the corner edges of the precast panel. The transfer member has a width equal to a change of thickness ($\Delta t$) of the lower and upper tier precast panels. The transfer member is affixed to the structural angle of one of the upper tier precast panels and a portion of the bottom end plate extending from the one upper precast panel. The connection plate spans and is affixed to the transfer member and the structural angle of one of the lower precast panels vertically adjacent to the one upper precast panel.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings:

FIG. 16C is a right elevation side view of another two vertically adjacent precast panels vertically connected in accordance with the present invention, where the top one of the two precast panels is thinner than the bottom precast panel and each panel has structural angles extending along the side edges of the respective panel to implement the vertical connection between the panels;

FIG. 16D is a front elevation view of the vertically adjacent precast panels of FIG. 16C and another two vertically adjacent precast panels in which the four panels are vertically and horizontally connected in accordance with the present invention;

FIG. 16E depicts a horizontal cross-sectional view of two of the four precast panels of FIG. 23D;

FIGS. 27A-27C depict a flow chart illustrating an exemplary process for constructing a precast wall system in accordance with the present invention;

DETAILED DESCRIPTION OF THE INVENTION

Reference will now be made in detail to an implementation in accordance with methods, systems, and products consistent with the present invention as illustrated in the accompanying drawings.

The effects of creep and shrinkage can be considerable in tall or high-rise buildings. In a precast wall system consistent with the present invention, these effects are reduced as compared to cast-in-place constructed walls. As disclosed in further detail herein, precast panels consistent with the present invention are pre-formed using a cementitious material such as concrete such that a large portion of the shrinkage of the concrete occurs during the early stages of curing (i.e., before the precast panel is placed or set in the building or structure). During this period, precast panels as disclosed herein have very little restraint at their edges and therefore develop less shrinkage stresses than comparable cast-in-place walls. Because a large portion of the shrinkage occurs before the precast panels are erected to construct or placed in the building, the dimensional changes to the building are reduced particularly the differential movements between the core and perimeter columns. In addition, because the precast panels are initially loaded (e.g., with an additional story structure for the building) after a later curing age than in cast-in-place construction, the effect of creep is also reduced by precast panels consistent with the present invention. Other advantages of the present invention are disclosed or will become apparent in the description to follow.

Figure 1:
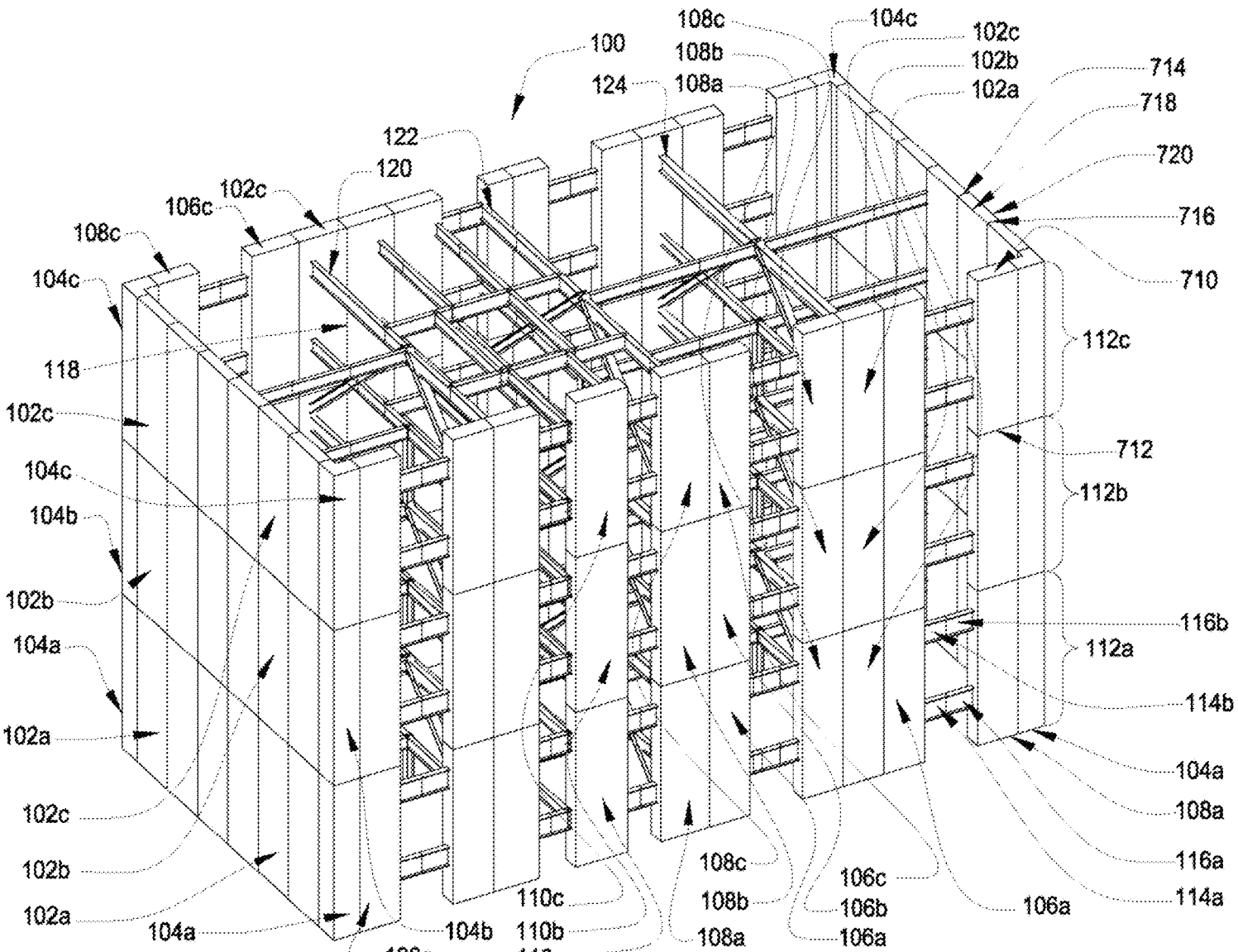
FIG. 1 is a perspective view of an exemplary precast wall system consistent with the present invention.
Figure 2:
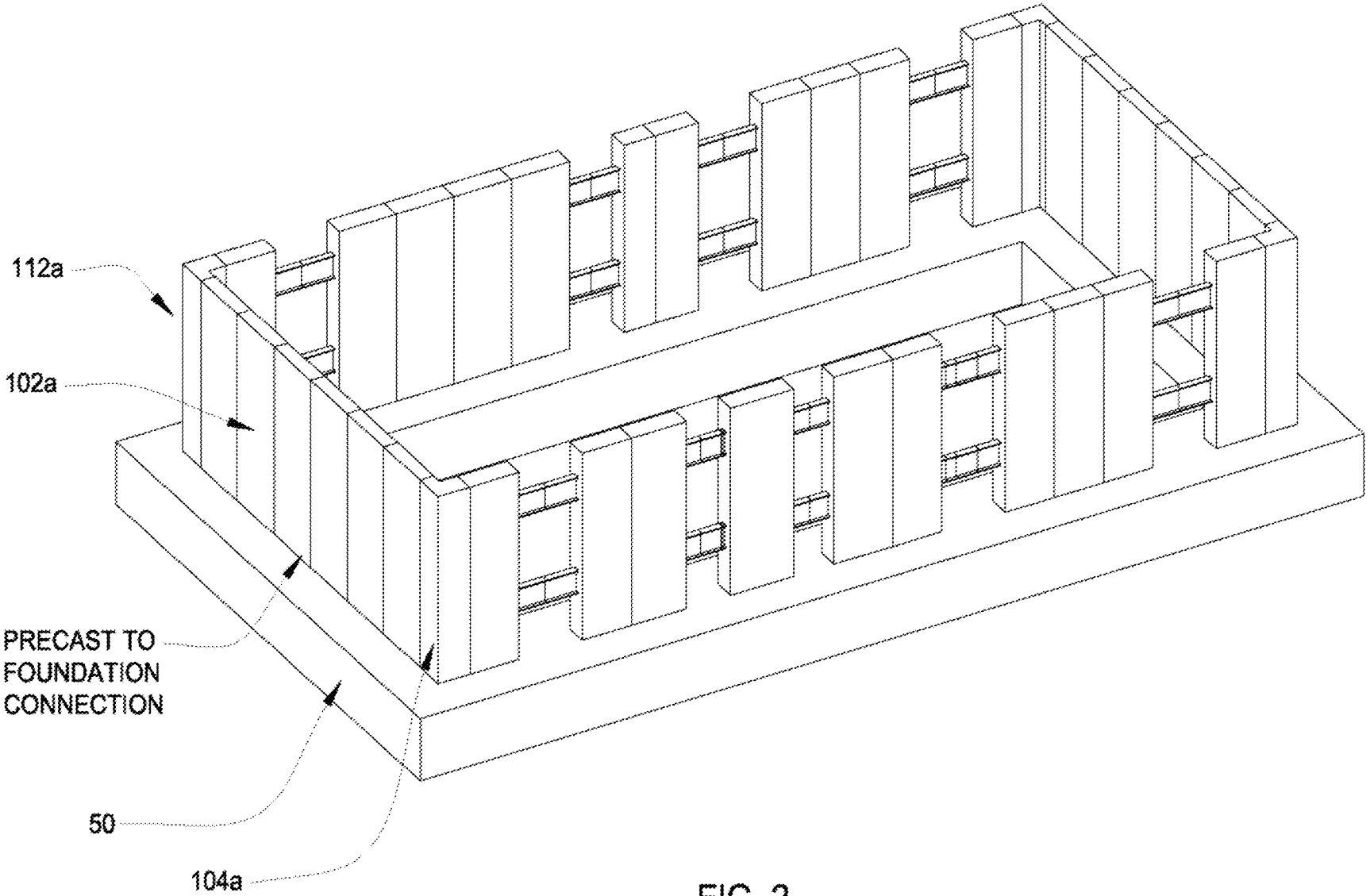
FIG. 2 is a perspective view of one story of the precast wall system of FIG. 1 disposed on a foundation.
Figure 3B:
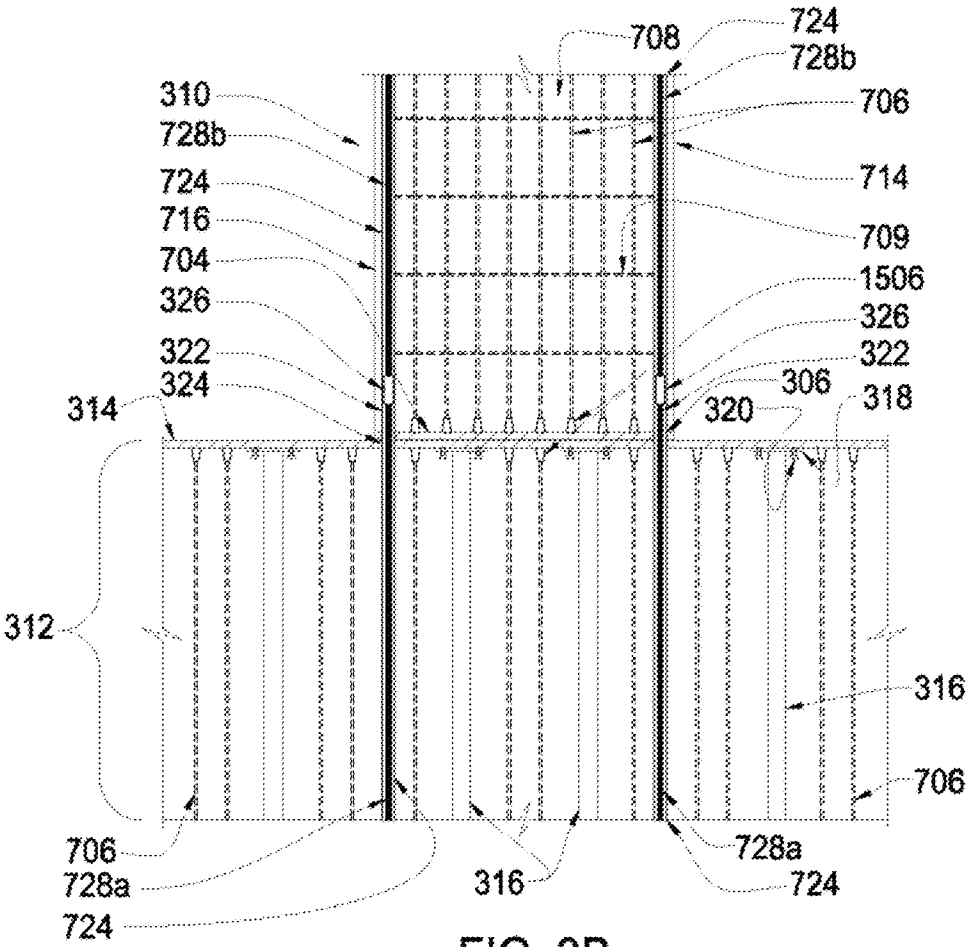
FIG. 3B is a cross-section view of a precast panel of the precast wall system as shown in FIG. 2, illustrating one embodiment for connecting the precast panel to the foundation.

FIG. 1 is a perspective view of an exemplary precast wall panel system 100 consistent with the present invention. The precast wall system 100 may be erected or constructed on a cast-in-place foundation 50 as shown in FIGS. 2 and 3, or on a standard cast-in-place wall system 60 as shown in FIG. 4. The precast wall system 100 comprises multiple precast panels 102, 104, 106, 108 and 110 that may be interconnected horizontally and vertically to construct multiple core or perimeter walls of multiple stories of a high-rise building. In particular, pluralities or groups (112*a*, 112*b* and 112*c*) of the precast panels 102, 104, 106, 108 and 110 are interconnected horizontally or side-by-side to respectively define one or more stories of a building or core walls for the building. After a first group 112*a* of the precast panels are erected on a foundation 50 or a lower wall system 60, additional groups 112*b* and 112*c* of the precast panels 102, 104, 106, 108 and 110 may be arranged on and vertically interconnected to the lower group (e.g., 112*a* or 112*c* in FIG. 1) of precast panels 102, 104, 106, 108 and 110.

In the implementation shown in FIG. 1, each precast panel 102, 104, 106, 108 and 110 in each group 112*a*, 112*b* and 112*c* of precast panels has a length corresponding to two stories of a building such that the precast wall system 100 reflects a six story section. However, the length of each precast panel may vary between groups such that a first group 112*a* of panels may correspond to one story or more stories, and each succeeding group 112*b* and 112*c* may each correspond to the same number or a different number of stories of the building.

Note, for clarity in the discussion to follow, the reference number of the precast panels 102, 104, 106, 108 and 110 is augmented with an "a" designator to indicate that the respective panel 102*a*, 104*a*, 106*a*, 108*a* or 110*a* is included in the first group or plurality 112*a* of precast panels, a "b" designator to indicate the respective panel 102*b*, 104*b*, 106*b*, 108*b* or 110*b* is included in the second group or plurality 112*b* of precast panels, or a "c" designator to indicate the respective panel 102*c*, 104*c*, 106*c*, 108*c* or 110*c* is included in the third group or plurality 112*c* of precast panels.

The precast panels 102, 104, 106, 108 and 110 may correspond to one of three types of panels: an interior panel 102, a corner panel 104, and an opening panel 106, 108 and 110. Each interior panel 102 is disposed between two adjacent panels that may be two other interior panels 102, two corner panels 104, two opening panels 106, 108 or 110, or some combination thereof. Each interior panel 102 preferably has a horizontal rectangular cross-section. However, the interior panel 102 may have another cross-section shape, such as a bowed front side and/or back side. Corner panels 104 are also disposed between two adjacent panels (e.g., two interior panels 102 or two opening panels 106, 108 and 110). In one implementation, each corner panel 104 has a horizontal L-shaped cross-section, enabling walls of the precast wall system 100 to be erected with different orientations (like for example perpendicular walls as shown in FIG. 1). However, corner panels 104 may have a non-right angle shape with sides that define an interior angle that is more or less than 90° (more or less than a right angle) to interconnect core non-orthogonal walls of the precast wall system 100 with a shape that is not rectangular. As described in further detail below, opening panels 106, 108 and 110 have one or more link beams (or beam segments) 114 or 116 that define an opening or gap between the respective opening panel and an adjacent opening panel, where the opening or gap is sufficient to enable a person to pass, or for passage of mechanical, electrical, or plumbing systems. The different precast panels 102, 104, 106, 108 and 110 may be interconnected to each other via one or more of the panel-to-panel vertical connections, horizontal panel-to-panel connections, and/or link beam connections discussed in detail herein.

Figure 16A:
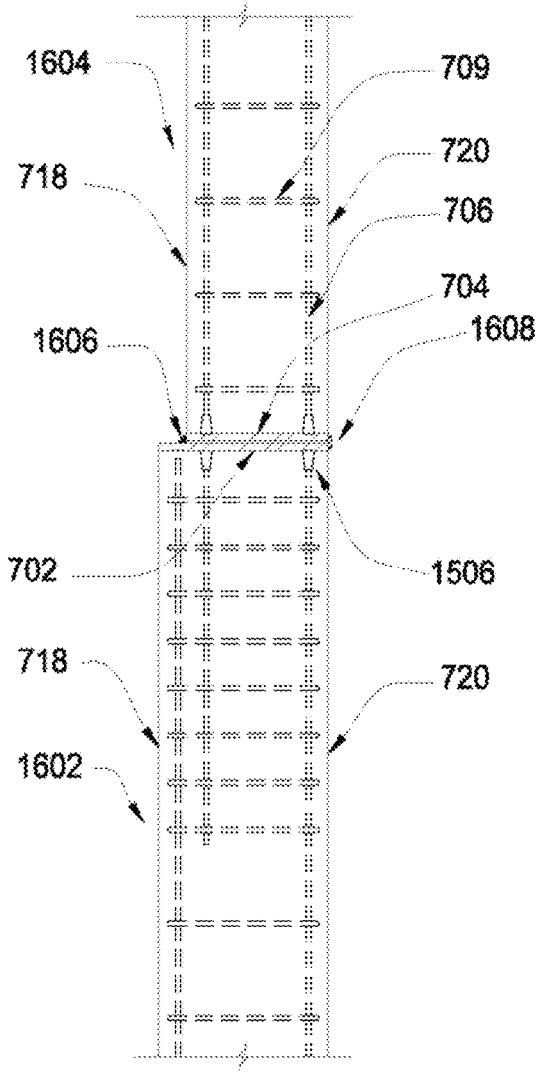
FIG. 16A is a vertical cross-sectional view of two precast panels vertically connected in accordance with the present invention, where the top one of the two precast panels is thinner than the bottom precast panel.

Each precast panel 102, 104, 106, 108 and 110 has a top end plate (e.g., 702 in FIGS. 7-10, 1306 in FIGS. 13A & 13B, 1406 in FIGS. 14A-14E, and 702 in FIGS. 16A & 16B) and a bottom end plate (e.g., 302 in FIG. 3A, 704 in FIGS. 3B & 7-10, 1308 in FIGS. 13A &13B, 1408 in FIGS. 14A-14E and 704 in FIGS. 16A & 16B), where the two end plates define a top side 710 and a bottom side 712 of the respective precast panel. The end plates of each precast panel 102, 104, 106, 108 and 110 enable the respective precast panel to be interconnected to a vertically adjacent precast panel. For example, the first group 112*a* of the interconnected precast panels 102, 104, 106, 108 and 110 shown in FIG. 1 are arranged vertically with the second group 112*b* of the interconnected precast panels 102, 104, 106, 108 and 110 so that the top end plate 702, 1306 or 1406 of each panel 102*a*, 104*a*, 106*a*, 108*a*, and 110*a* corresponding to the first group 112*a* is connected to the bottom end plate 704, 1308 or 1408 of a respective one of the panels 102*b*, 104*b*, 106*b*, 108*b* or 110*b* corresponding to the second group 112*b*. Implementations of such vertical panel-to-panel connections (between end plates of vertically adjacent precast panels) are discussed in further detail herein. Each end plate of a precast panel 102, 104, 106, 108 or 110 preferably has an acceptable flatness tolerance or an exterior milled surface, enabling transferring of large compression stresses (2000 psi to 6,000 psi) by direct bearing between the end plates of vertically adjacent precast panels 102, 104, 106, 108 or 110. The vertical dimension of the end plates of each precast panel 700, 102, 104, 106, 108 or 110 is determined based on the required forces to be transferred.

Figure 7:
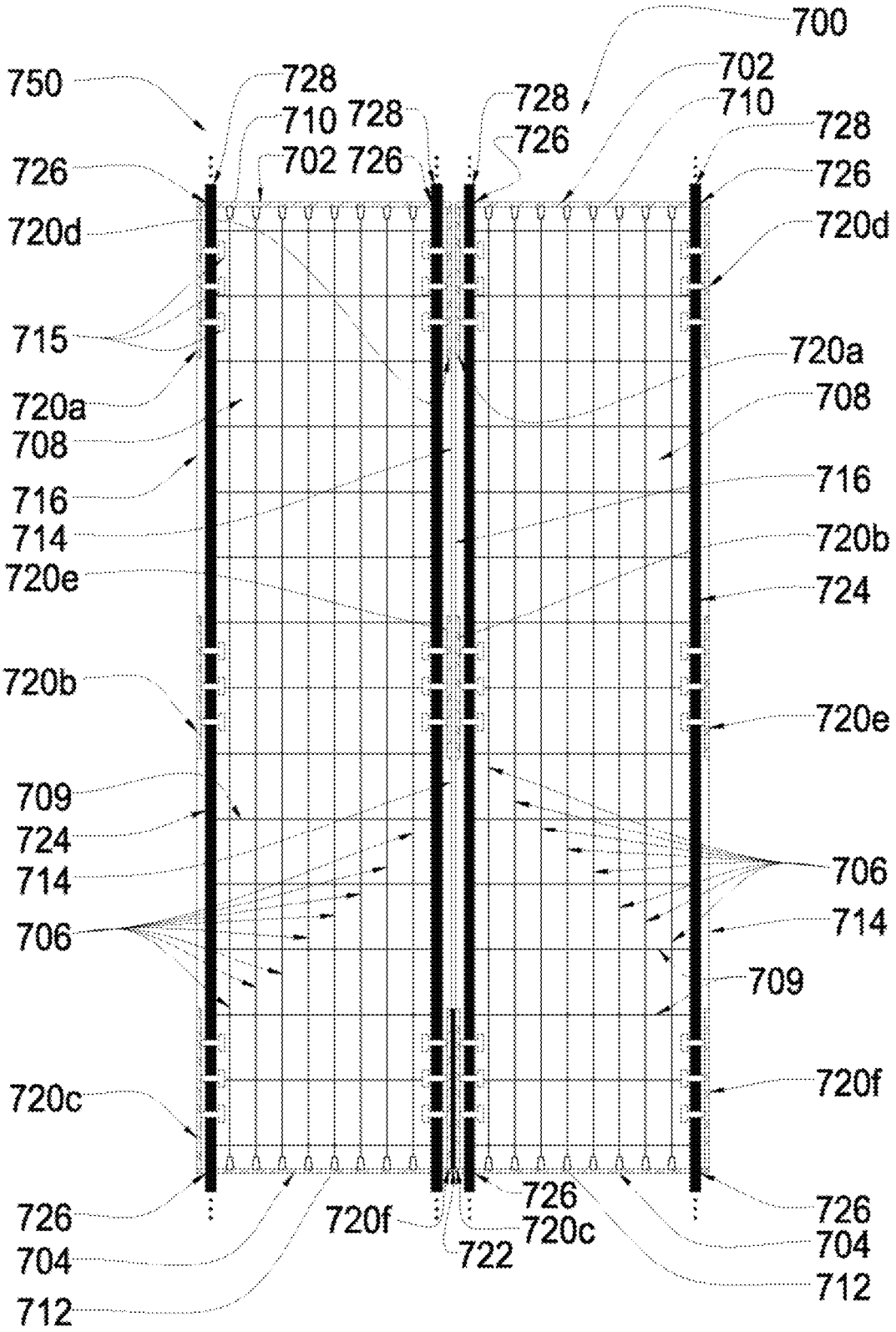
FIG. 7 is a vertical cross-sectional view of an exemplary interior panel that may be employed to construct the precast wall system of FIG. 1 in accordance with the present invention, where the interior panel has side plates for connecting the interior panel to another horizontally adjacent precast panel and one or more vertical ducts adapted to receive a respective reinforcing bar for vertically connecting the interior panel to another vertically adjacent precast panel.

Each precast panel 102, 104, 106, 108 and 110 further includes a plurality of vertical bars (e.g., 706 in FIG. 7) disposed between and attached to the end plates and a cementitious material (e.g., 708 in FIG. 7) encasing the vertical bars 706 and defining a plurality of sides (e.g., right side 714, left side 716, front side 718 and back side 720 in FIGS. 1 and 7) of the respective panel. The end plates may be made of steel or other high strength metal or metal alloy. Each vertical bar 706 may be a rebar, a steel rod, or another bar type made from a high strength material that may be used to reinforce cement or concrete.

The cementitious material 708 may be a standard construction cement (such as Portland cement), epoxy-resins without course aggregate, concrete or combination thereof. The cementitious material 708 is reinforced with vertical bars 706 between the respective end plates 302, 702, 704, 1306, 1308, 1406 or 1408. As discussed herein, one or more of the precast panels 102, 104, 106, 108 and 110 may include a plurality of horizontal bars or transverse ties (e.g., 709 in FIG. 7), each of which is connected to (or wrapped around) at least two vertical bars 706 disposed adjacent to opposing sides of the respective panel in order to further reinforce the cementitious material 708 of the panel.

In one implementation, the cementitious material 708 may comprise fiber and particle reinforced concrete. The fibers may be carbon fibers, metal fibers, or other type of fibers arranged within the respective precast panel 102, 104, 106, 108 or 110 according to a predefined orientation (e.g., for long continuous fibers that may be longer than one inch) or a random orientation (for small fibers that less than one inch).

The strength of the cementitious material 708 (e.g., concrete) that is used to form the precast panels 102, 104, 106, 108 or 110 may be determined based on the required force capacity of the respective panel (i.e., to resist the forces resulting from the combination of the loads acting on the building) and to satisfy serviceability requirements (e.g., to limit building wind deflections and accelerations to acceptable values). For example, the cementitious material 708 may be comprised of concrete having compressive strengths in a range of approximately 5,000 psi to approximately 16,000 psi. However, the cementitious material may comprise concrete having higher strengths that may be achieved, for example, with the addition of pozzolan, aggregate or fibers.

The dimensions of the individual precast panels 102, 104, 106, 108 or 110 are typically determined based on the capacity of the lifting and transportation equipment, which generally enable precast structural panels 102, 104, 106, 108 or 110 to be formed to a length or height of two stories (e.g., approximately 20-30 feet). However, with larger capacity lifting and transportation equipment, the precast panels 102, 104, 106 108 or 110 may be formed to be higher than three or more stories of a building. In one implementation, the width of the interior precast panels 102 is in a range of approximately 5 to 10 feet. Corner precast panels 104 may have a smaller width in each direction, with an outer dimension of about 4 to 6 feet in each direction. Opening precast panels 106, 108 and 110 have larger widths to accommodate the width of the link beams 114 and 116. The thickness of the precast panels 102, 104, 106, 108 or 110 is based on strength and serviceability requirements for the building to be erected and may vary by story (or by two stories or other story multiple) through the height of the building, with thickness values ranging from about 1 to 4 feet.

As discussed in further detail herein, in one implementation as shown in FIG. 1, the precast wall system 100 may include a bracing system 118 that has one or more support frames 120, 122 or 124 that are each disposed between and attached to a respective first pair of vertically interconnected precast panels (e.g., employed in groups 112*a* & 112*b* or groups 112*b* & 112*c* of the precast panels) and a respective second pair of vertically interconnected precast panels (e.g., also employed in groups 112*a* & 112*b* or groups 112*b* & 112*c* of the precast panels) that are disposed opposite to the first pair. The bracing system 118 may be erected in advance of or in conjunction with the first group 112*a* of the precast panels in order to aid in erecting and bracing subsequent groups 112*b* and 112*c* of precast panels. In this implementation of the precast wall system 100, the support frames 120, 122 and 124 employed in the bracing system 118 become an integral part of the lateral force resisting system of the building when connected to the vertically interconnected pairs of precast panels as further described below.

Figure 3A:
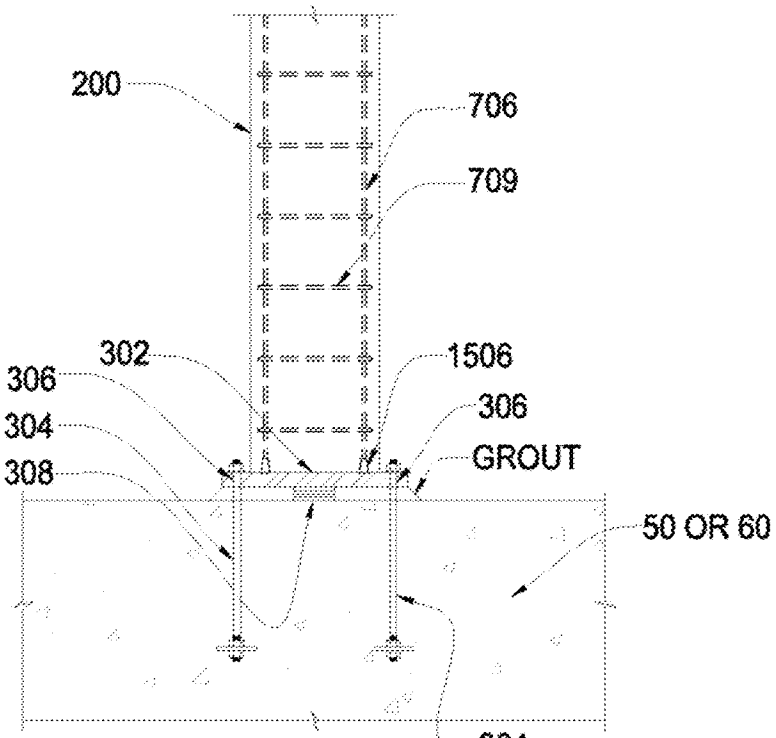
FIG. 3A is a cross-section view of a precast panel of the precast wall system as shown in FIG. 2, illustrating one embodiment for connecting the precast panel to the foundation.
Figure 4:
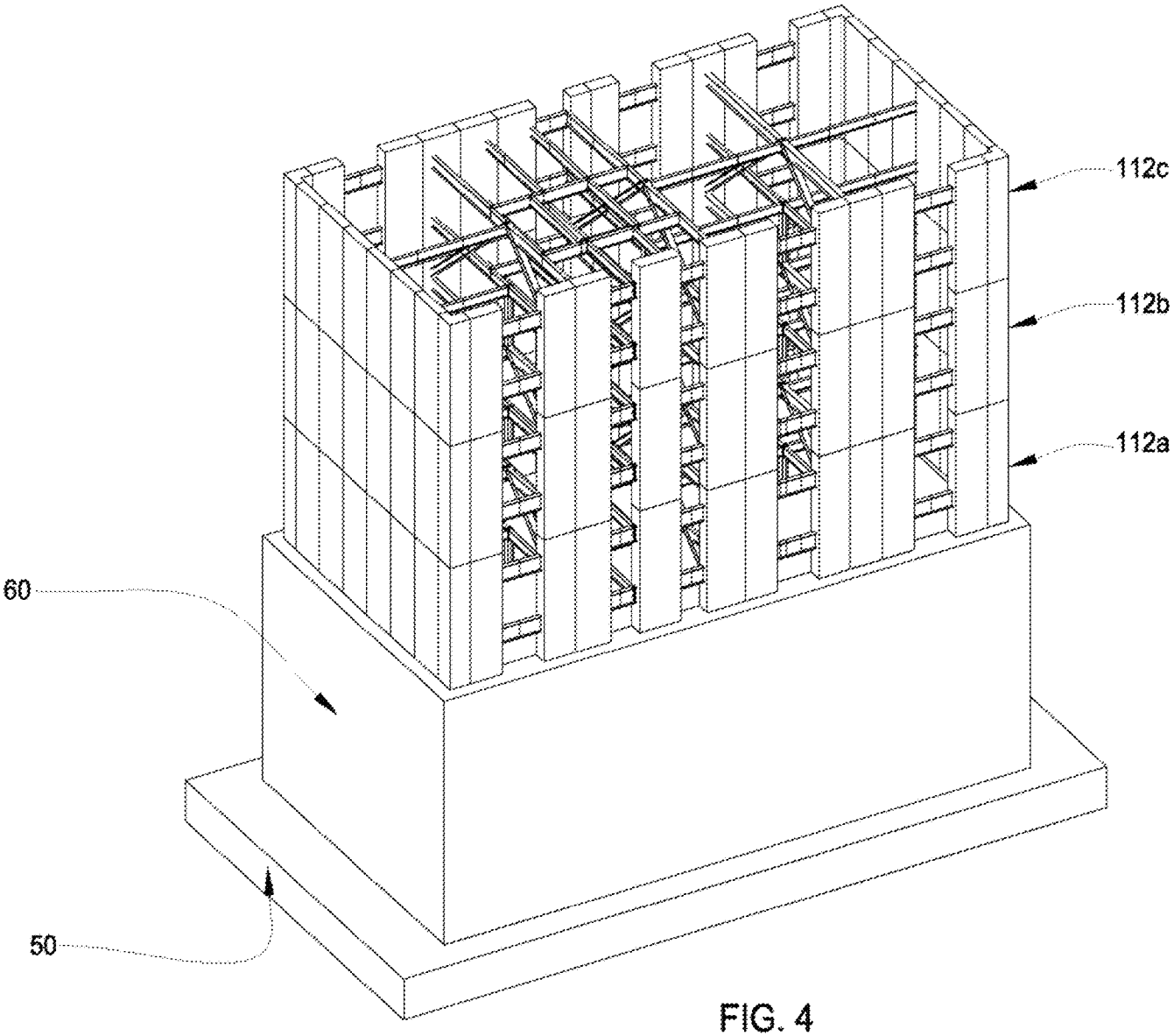
FIG. 4 is a perspective view the precast wall system of FIG. 1 disposed on cast-in-place wall system.

Returning, FIG. 3A is a general cross-section view of a precast panel 200 consistent with the present invention that is representative of one implementation for connecting an interior panel 102, a corner panel 104 or an opening panel 106, 108 or 110 to a foundation 50 or cast-in-place wall 60. As shown in FIG. 3A, the bottom end plate (e.g., 302) of each precast panel 102*a*, 104*a*, 106*a*, 108*a* and 110*a* included in the first group 112*a* of panels (e.g., corresponding to the first two stories of the building) may be anchored to the foundation 50 or a cast-in-place wall 60 using one or more anchor bolts 304 that are disposed in and extend through a respective opening 306 in the bottom end plate 302 and embedded in the foundation or cast-in-place wall 60. The dimensions of the anchor bolts 304 are generally in the range of 1 inch to 4 inches with a yield stress of 36 ksi to 105 ksi for the precast panels. However, anchor bolts 304 having a larger diameter may be used to achieve a greater strength. Moreover, the dimensions of the anchor bolts 304 may vary based on the height, weight or other dimensions of the precast panel 200 in the first group 112*a* of panels to be anchored to the foundation as well as the panels 102, 104, 106, 108 and 110 to be vertically interconnected to the respective panel 200 in the first group 112*a*. Shims 308 may also be employed to align or orient the precast panel 200 relative to the foundation or cast-in-place wall 60.

FIG. 3B is a cross-section view of another exemplary precast panel 310 consistent with the present invention that is representative of an alternate implementation for connecting an interior panel 102, a corner panel 104 or an opening panel 106, 108 or 110 to a foundation 50 or cast-in-place wall 60. The precast panel 310 is precast similar to the precast panel 700 described in further detail below. In particular, in the implementation shown in FIG. 3B, the precast panel 310 has a top end plate 702 (not shown in FIG. 3B), a bottom end plate 704 and a plurality of vertical bars 706 disposed between and attached to the end plates 702 and 704 and a cementitious material 708 encasing the vertical bars 706 and defining the right side 714, left side 716, front side 718 and back side 720 of the panel 310 between the top end plate 702 and the bottom end plate 704. The precast panel 310 also has one or more ducts 724 extending from the top end plate 702 of the panel 310 to the bottom plate 704 of the panel 312. The top end plate 702 and the bottom end plate 704 of the precast panel 310 each has one or more openings 726 extending through the respective end plate 702 and 704 and in axial alignment with a respective duct 724 of the precast panel 310.

In the implementation shown in FIG. 3B, to anchor the precast panel 310 to the cast-in-place foundation 50 or wall 60, a top portion 312 of the foundation 50 or wall 60 (which is the last portion to be formed from concrete poured to from the cast-in-place foundation 50 or wall 60) includes a cap plate 314 that serves as a base for vertically connecting precast panels 310. The top portion 312 may correspond to the approximately 10 feet of the foundation 50 or wall under the cap plate 314. The last or top portion 312 of the cast-in-place foundation 50 or wall 60 may be formed to include one or more support posts 316 upon which the cap plate 314 may be disposed before pouring concrete to encase the support posts 316 and forming the top portion 312. Plates 318 having jacking bolts 320 may be disposed on the top of the support posts 316. Prior to pouring the concrete for the top portion 312 of the foundation 50 or wall 60, shims or jacking bolts 320 may be used (by individually threading each bolt 320 through the respective support plate 318) to adjust the level of the cap plate 314 of the foundation 50 or wall 60. Shims (e.g., 308 in FIG. 3A) may also be employed to level the bottom end plate 704 of the precast panel 310 relative to the cap plate 314.

Figure 24:
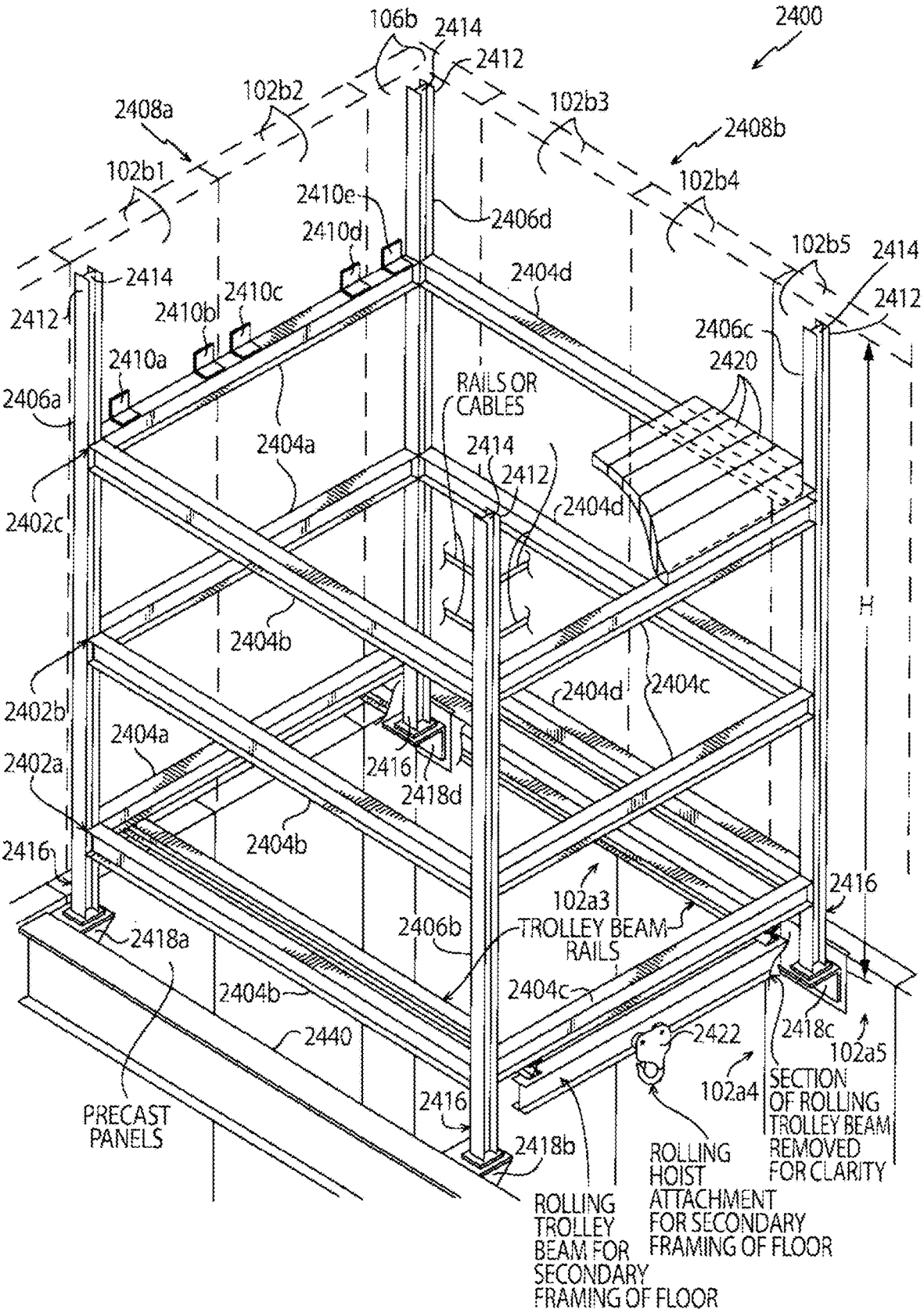
FIG. 24 depicts a precast panel erection aid platform that may be employed to construct a precast wall system in accordance with the present invention.

The precast panel 310 may be further aligned to the top portion 312 of the cast-in-place foundation 50 or wall 60 using erection aids as described herein, such as in reference to FIG. 24.

The bottom end plate 704 and the cap plate 314 may be connected or affixed via high strength welding or bolting as described in further detail herein for vertical panel-to-panel connections, such as in reference to FIGS. 13A-13B and 14A-14E.

Alternatively, or in addition to welding or bolting the bottom end plate 704 of the precast panel 310 to the cap plate 314 of the foundation 50 or wall 60, the precast panel 310 may be vertically connected to the cap plate 314 using one or more vertical reinforcing bars or bar segments 728*a* in a manner similar to the vertical panel-to-panel connection described herein for precast panel 700. In this implementation, each of a first plurality of reinforcing bar segments 728*a* and 728*b* may have one end 323 anchored or embedded in the cast-in-place foundation 50 or wall 60 and another end 322 that extends through a respective opening 324 drilled through the cap plate 314. If the reinforcing bar segment 728*a* is not long enough to extend from the foundation 50 or wall 60 through the duct 724 in the precast panel 310, a bar-to-bar coupler 326 (such as a DYWIDAG THREADBAR® Coupler commercially available from Dywidag-Systems International) may be affixed or threaded to the end 322 of the respective reinforcing bar segment 728*a* extending through the cap plate 314 before the precast panel 310 is lowered into position atop the cap plate 314 of the foundation 50 or wall 60. Once the cap plate 314 is aligned with the precast panel 310, a second reinforcing bar segment 728*b* may then be disposed through a respective opening 726 in the top plate 702 of the precast panel 310 and into a respective duct 724 aligned with the opening 726 so that the second reinforcing bar segment 728*b* may be affixed or threaded to a corresponding coupler 326 to effectively affix the two reinforcing bar segments 728*a* and 728*b* together to form one continuous vertical reinforcing bar 728 through the precast panel 310 and anchored in the cast-in-place foundation 50 or wall 60.

Additional vertical reinforcing bars 728 may be employed in the same manner to further vertically interconnect the precast panel 310 to the cast-in-place foundation 50 or wall 60 for transfer of forces from upper tier precast panels similarly connected to the precast panel 310 to the foundation 50 or wall 60. Additional precast panels 102, 104, 106, 108 and 110 may be anchored to the cast-in-place foundation 50 or wall 60 in a similar manner as precast panel 310 and horizontally interconnected to from the first group 112*a* or precast panels in the precast wall system 100 as further described herein.

Figure 3D:
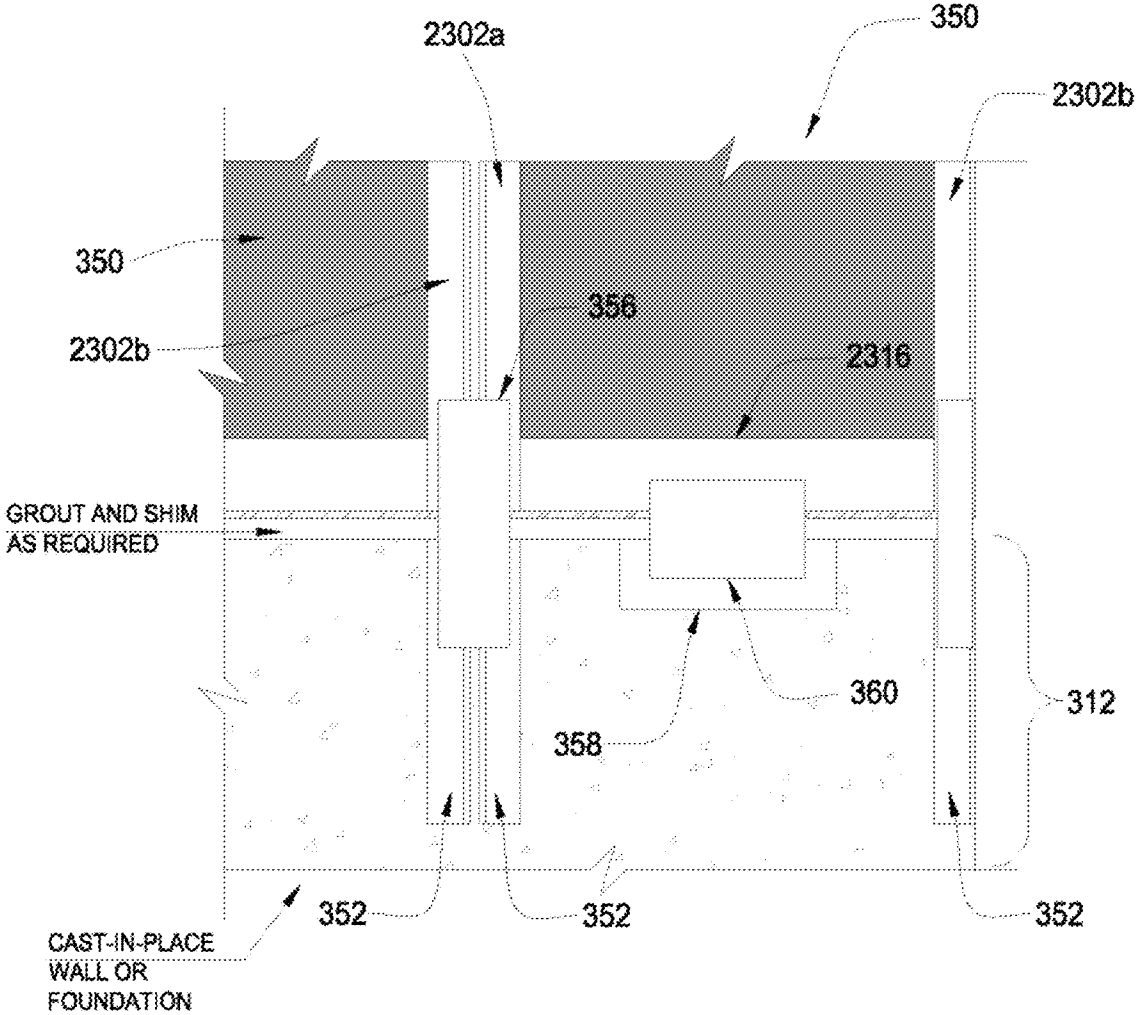
FIG. 3D is a front view of the precast panel of FIG. 3C.
Figure 3C:
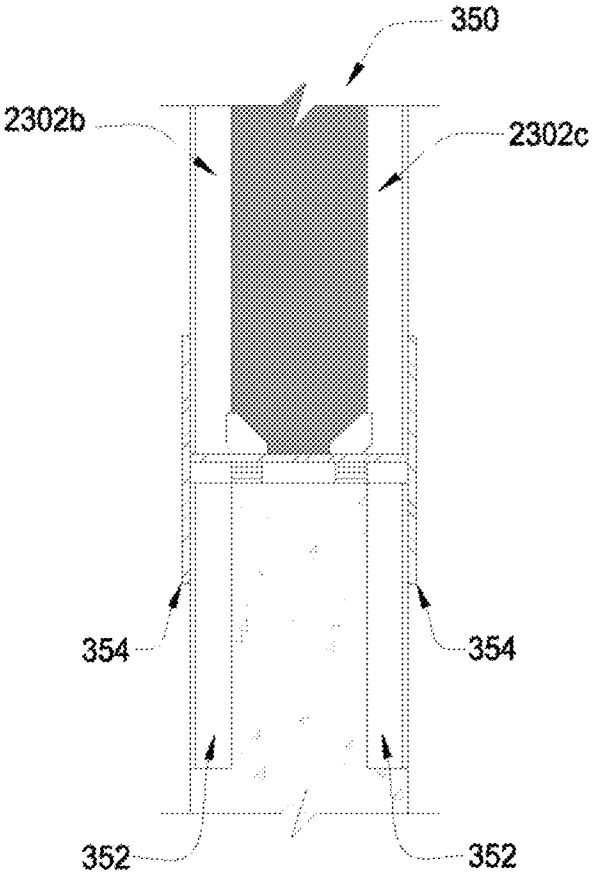
FIG. 3C is a right side view of a precast panel of the precast wall system as shown in FIG. 2, illustrating another embodiment for connecting the precast panel to the foundation, where the precast panel is formed with corner angles.

FIGS. 3C and 3D depict another exemplary precast panel 350 consistent with the present invention that is representative of an alternate implementation for connecting an interior panel 102, a corner panel 104 or an opening panel 106, 108 or 110 to a foundation 50 or cast-in-place wall 60. The precast panel 350 is precast similar to the precast panel 2300 described in further detail below. In particular, in the implementation shown in FIGS. 3C and 3D, the precast panel 350 has structural angles 2302*a*-2302*d* (2302*d* not in view), such as steel angles, disposed along a corner edge 2306*a*, 2306*b*, 2306*c* or 2306*d* (not in view) of the precast panel 350 and may extend between a top corner and a bottom corner of the precast panel 350. As described in further detail below, the structural angles 2302*a*-2302*d* may be employed to implement horizontal panel-to-panel connections and vertical panel-to-panel connections between the precast panel 350 and other horizontally and/or vertically adjacent precast interior panels having similar structural angles 2302*a*-2302*d* disposed along the corners thereof.

In the implementation shown in FIG. 3D, to anchor the precast panel 310 to the cast-in-place foundation 50 or wall 60, a top portion 312 of the foundation 50 or wall 60 (i.e., the last portion to be formed from concrete poured to from the cast-in-place foundation 50 or wall 60) includes structural angles 352 (with shear studs) encased vertically in the foundation 50 or wall 60 at respective spaced apart locations near the top of the foundation 50 or wall 60 so that an exposed surface of each angle 352 will vertically align with a respective one the structural angles 2302*a*-2302*d* of the precast panel 350 when the precast panel 350 is disposed on the top of the foundation 50 or wall 60. In this implementation, a respective lap plate 354 is disposed partially over both a angle 352 encased in the foundation 50 or wall 60 and a corresponding one of the angles 2302*a*-2302*d* of the precast panel 350. Each lap plate 354 is then welded to both the respective foundation or wall angle 352 and the respective angle 2302 of the precast panel 350 to affix the precast panel 350 to the foundation 50 or wall 60.

When the precast panel 350 is to be horizontally connected to another adjacent precast interior panel 350 (e.g., using a horizontal panel-to-panel connection for precast interior panels having structural corner angles 2302*a*-2302*d* as described in reference to FIGS. 23A-F below), a wider lap plate 356 may be employed to partially cover and join (as welded) two horizontally adjacent corner angles (i.e., angles 2302*b* and 2302*a* in FIG. 3D) of the two adjacent precast panels 350 with the corresponding structural angles 352 encased in the foundation 50 or wall 60.

The precast panel 350 may also include a horizontal side plate 2316 (which is further described herein) embedded in the front side and/or back side of the precast panel 350 and connects one leg of one angle (e.g., 2302*a* in FIG. 3D) to one leg of another angle (e.g., 2302*b* in FIG. 3D) of the precast panel 350. In this implementation, a horizontal plate 358 may be encased in the front of the foundation 50 or wall 60 so that a lap plate 360 may extend over the horizontal side plate 2316 embedded in the precast panel 350 and over the horizontal plate 358 encased in the foundation 50 or wall 60 to reinforce the vertical connection between the panel 350 and the foundation 50 or wall 60. To further reinforce the connection, the side plate 2316 and the horizontal plate 358 include shear studs.

Figure 5:
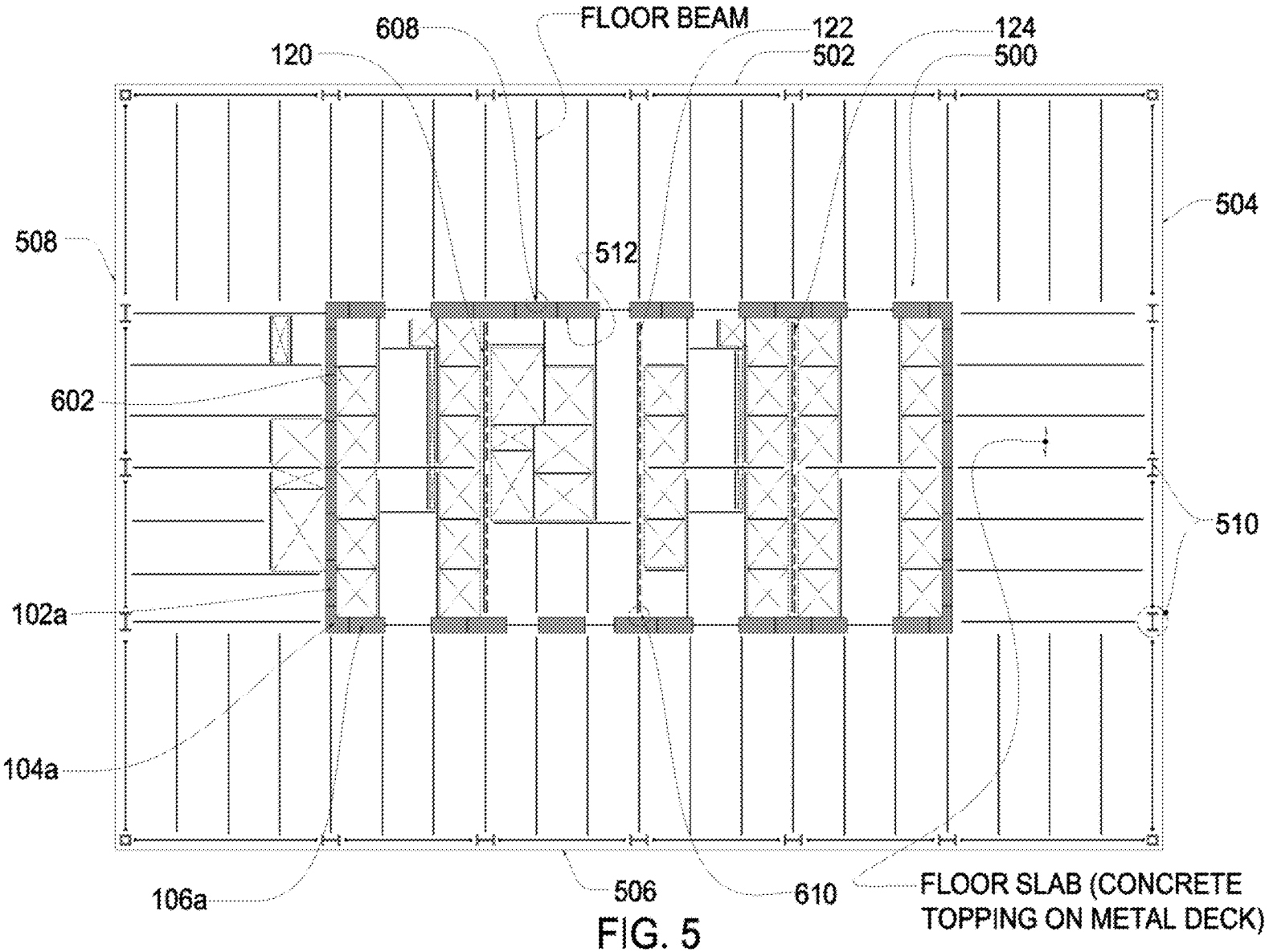
FIG. 5 is a top view of an exemplary story or floor of the precast wall system of FIG. 1.
Figure 5A:
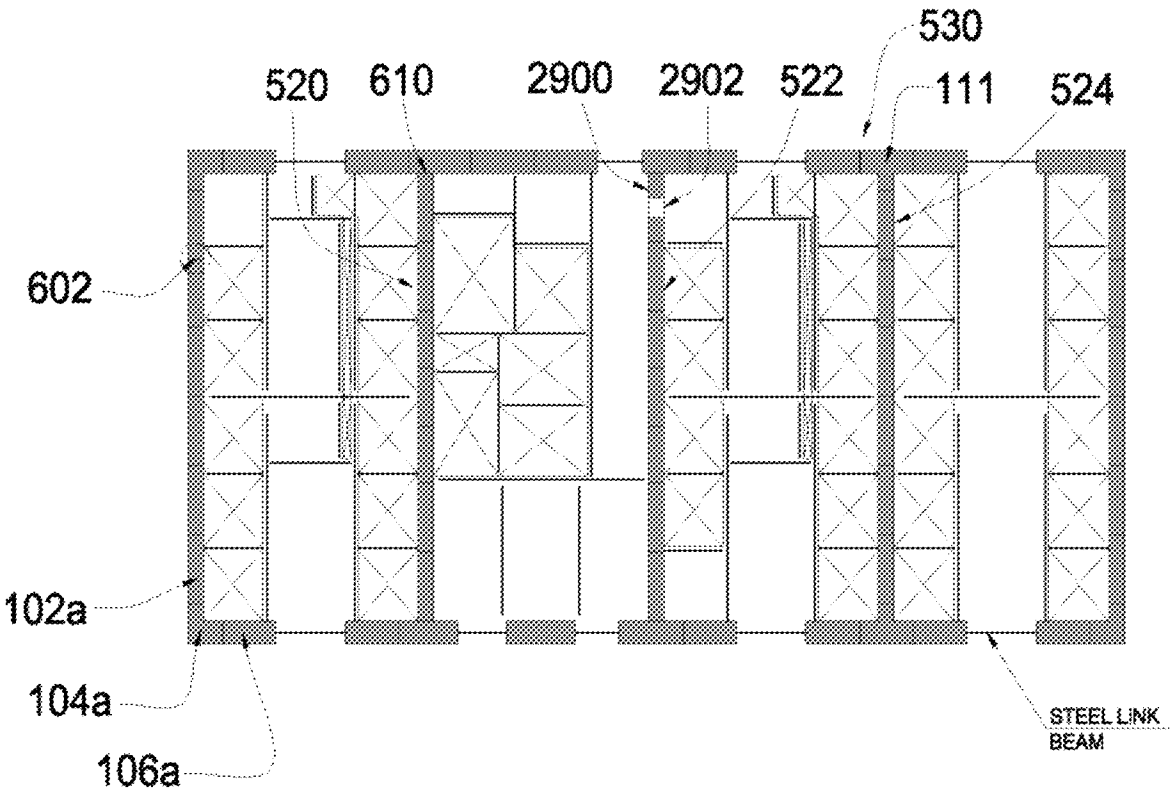
FIG. 5A is a top view of another exemplary story or floor of the precast wall system of FIG. 1.

Turning to FIG. 5, a top view is shown of an exemplary story or floor 500 of the precast wall system 100, in which the precast wall system 100 is employed as all or a portion of the core walls of a building having perimeter walls 502, 504, 506 and 508 connected to the precast panels 102, 104, 106, 108 and 110 corresponding to at least the story or floor 500 of the precast wall system 100. In the implementation shown in FIG. 5, the perimeter walls 502, 504, 506 and 508 are constructed using steel frames 510 and may be interconnected to the back side 720 of the precast panels 102, 104, 106, 108 and 110 employed as core walls of the story or floor 500 of the precast wall system 100 via a floor slab or floor beam spanning from the respective perimeter wall to the precast panel. The floor slab or floor beam is interconnected to the respective precast panel using one of the slab-to-panel connections or beam-to-panel connections further described herein. Although steel braced frames may be employed to form the support frames 120, 122, or 124 for bracing opposing pairs of vertically interconnected precast panels of the precast wall system 100 (or to form other interior web walls 520, 522 or 524 of the precast wall system 100), precast panels 102, 106, 108 or 110 may be used (in lieu of or in combination with steel braced frames used to form the support frames 120, 122, or 124) to form the interior web walls 520, 522 or 524 of the precast wall system 100 as shown in FIG. 5A. In the implementation shown in FIG. 5A, an interior web wall 520, 522 or 524 may be formed using a T-shaped precast panel 111 or a panel to panel horizontal connection employed to interconnect to a precast panel (e.g., an interior panel 102) in an external wall 530 of the precast wall system 100 to a precast panel (e.g., another interior panel 102) in the interior web wall 520, 522 or 524 of the precast wall system 100.

As shown in FIG. 5A, interior web walls 520, 522 or 524 may also include a precast panel 2900 that has an opening 2902 precast in the panel 2900 to form a passage, such as for a plumbing pipe, a HVAC duct, a door or for other mechanical or human passage. The opening 2902 may be circular, rectangular or have another shape. When the opening 2902 is a small opening or perforation at specific location of the core interior web walls, the panel 2900 having the opening 2902 is fabricated to comply with the applicable building code requirements for openings structural walls. In general, an amount of reinforcement at least equal to that interrupted by the opening 2902 is added on the sides of the opening 2902, plus some additional rebars arranged tangentially about the opening 2902 to form a rebar shaped box around the opening 2902. This rebar reinforcement should extend at the sides of the opening 2902 a length enough to develop in tension the capacity of the rebar.

Figure 6:
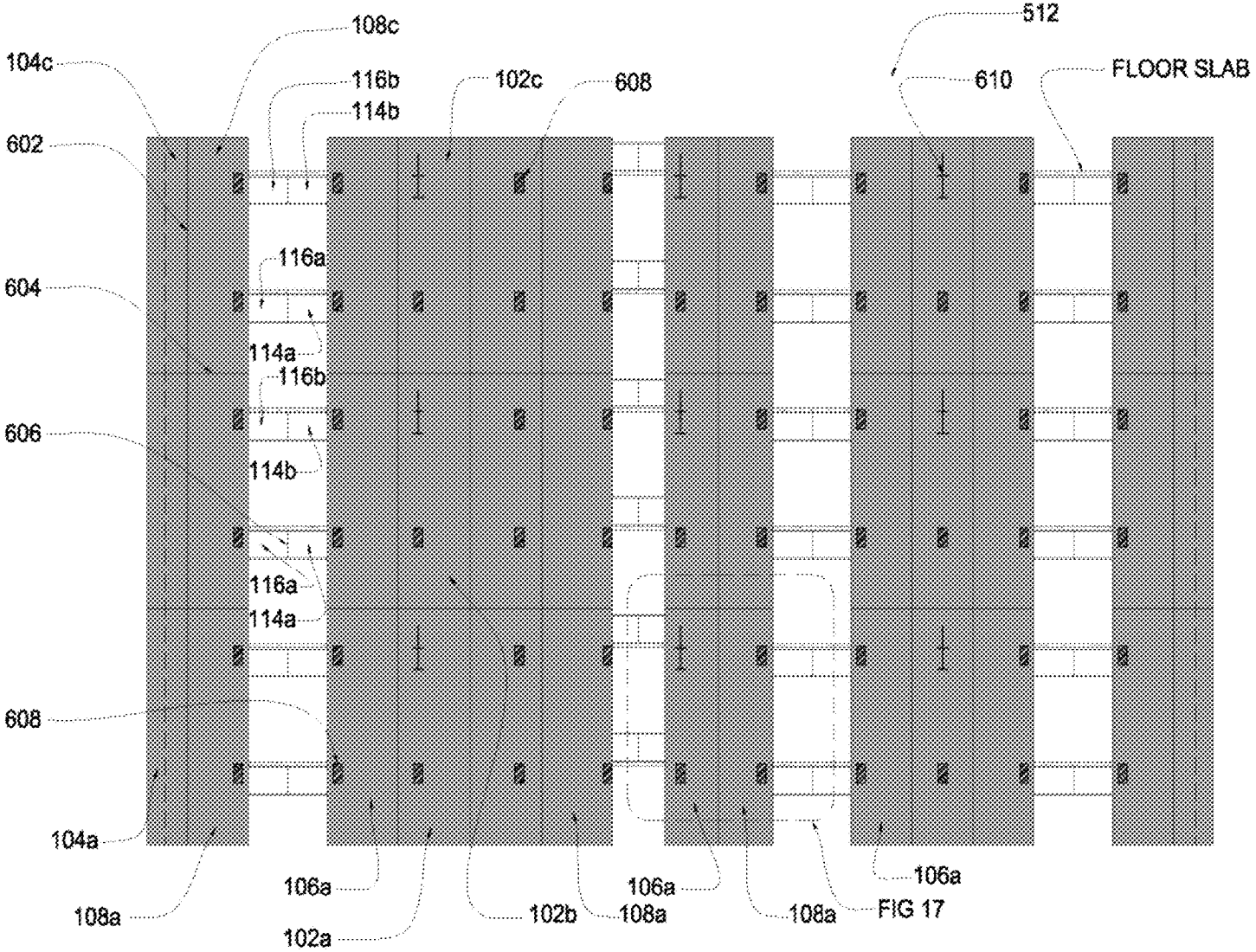
FIG. 6 is a side view of the precast wall system of FIG. 1.

FIG. 6 is an exemplary view of the internal side (e.g., side 512 in FIG. 5) of the precast wall system 100 that illustrates exemplary embodiments of interior precast panels 102, corner precast panels 104, and opening precast panels 106, 108 and 110 and horizontal and vertical panel-to-panel connections 602 and 604 between such panels consistent with the present invention. The internal side 512 of the precast wall shown in FIG. 6 also depicts a link beam connection 606 and embedded plates (1102 in FIG. 11) on the front side 718 of the precast panels 102, 106, 108 or 110 employed to implement a beam-to-panel connection 608 (e.g., for supporting an interior floor slab) as further discussed herein. The internal side 512 of the precast wall system 100 further depicts a brace-to-panel connection 610 employed to interconnect to a support frame 120, 122, or 124 for bracing opposing pairs of vertically interconnected precast panels of the precast wall system 100. The internal structure of embodiments of an interior precast panel 102 and opening precast panels 106, 108 and 110 are described in detail with reference to the figures to follow. Except as noted herein, the internal structure and horizontal and vertical interconnections of a corner precast panel 102 may correspond to the embodiments described for an interior precast panel 102.

FIG. 7 is a vertical cross-sectional view of one exemplary embodiment 700 of an interior precast panel 102 that may be employed to construct the precast wall system 100. FIG. 7 also illustrates implementations of a horizontal panel-to-panel connection and implementations of a vertical panel-to-panel connection between an interior precast panel 102 and adjacent precast panels 102, 104, 106 or 108 consistent with the present invention. As shown in FIG. 7, the interior precast panel 700 includes a top end plate 702, a bottom end plate 704, and a plurality of vertical bars 706 disposed between and attached to the end plates 702 and 704 and a cementitious material 708 encasing the vertical bars 706 and defining the right side 714, left side 716, front side 718 and back side 720 of the panel 700 between the top end plate 702 and the bottom end plate 704. The precast panel 700 may also include a plurality of horizontal bars or transverse ties 709, each of which is connected to at least two vertical bars 706 disposed adjacent to opposing sides 714 and 716 of the panel 700.

In the implementation shown in FIG. 7, the interior precast panel 700 has one or more side plates 720*a*-720*f* (which may transfer shear, tension, moment, compression, or other forces or some combination thereof) to implement a horizontal panel-to-panel connection with one or two precast panels 750 that are horizontally adjacent to the right side 714 and/or left side 716 of the interior precast panel 700. Each precast panel 750 that is disposed adjacent to and has a horizontal panel-to-panel connection with the interior precast panel 700 may be another interior panel 102, a corner panel 104, or an opening panel 106 or 108. Note, as discussed below, an opening panel 110 has link beams 114 and 116 on both sides of the panel 110 that may be but are not typically interconnected to a side plate 720 as discussed herein for a horizontal panel-to-panel connection.

Each side plate 720*a*-720*f* may include one or more shear studs 715 embedded in the cementitious material 708 to further enable the side plate (and, thus, the respective interconnected panels 700 and 750) to resist and transmit shear and other forces that typically are imposed on high-rise buildings. Each side plate 720*a*-720*f* may be embedded in the cementitious material 708 of the respective precast panel 700 or 750 such that the plate 720*a*-720*f* is approximately flush with the side 714 or 716 of the panel 700 or 750, enabling two adjacent panels 700 and 750 to have no or a minimal spacing between the panels. A fire resistant sealant or grout may be applied to any spacing or joint between the precast panels to inhibit smoke from a fire outside the precast wall system 100 from passing through spacing between precast panels interconnected as disclosed herein. Accordingly, the precast wall system 100 may provide additional safety and security for a fire stairs constructed within the precast wall system 100, such as in conjunction with the bracing system 118 (FIG. 1) of the precast wall system 100.

As shown in FIG. 7, the interior precast panel 700 may have one or more side plates 720*a*-720*c* affixed to the left side of the precast panel 700 (e.g., the first precast panel) and the other precast panel 750 (e.g., the second precast panel) has a corresponding one or more side plates 720*e*-720*f* affixed to the right side 714 of the other precast panel 750 that is adjacent to the interior precast panel 700. In the implementation shown in FIG. 7 for a horizontal panel-to-panel connection, each side plate 720*a*-720*c* on the left side 716 of the interior precast panel 700 is affixed to a corresponding one of the side plates 720*d*-720*f* on the right side 714 of the other adjacent precast panel 750 via a respective weld 722, such as a high-strength weld having a strength in a range of 60 ksi to 110 ksi.

In an alternative implementation for a horizontal panel-to-panel connection, each side plate 720*a*-720*f* of two adjacent precast panels 700 and 750 (or 102, 104, 106, or 108) has a width (into the page in FIG. 7) that is greater than the thickness of the respective panel 700 or 750, such that each side plate 720*a*-720*f* has lip on the front side 718 and back side 720 relative to the respective panel similar to the end plates 1306 and 1308 discussed in reference to FIGS. 13A and 13B below. In this implementation, the lips of each side plate 720*a*-720*f* on a first side (e.g., right side 714 or left side 716) of a first precast panel 700, (or 102, 104, 106, or 108) and the lips of each corresponding side plate 720*d*-720*f* on an adjacent second side (e.g., left side 716 or right side 714) of a second precast panel 750 may be clamped or bolted together so that the respective side plates of the two adjacent precast panels are affixed to each other to transfer shear, tension, moment, compression or other forces (or some portion thereof) between the two adjacent panels 700 and 750. For example, ¾ inch diameter A325 bolts spaced at 12 inches on center to 1 inch diameter A490 bolts spaced at 4 inches on center may be used to affix together the respective side plates of the two adjacent precast panels.

One implementation of a vertical panel-to-panel connection between the interior precast panel 700 and a vertically adjacent precast panel (e.g., another interior precast panel 102*b*, an opening precast panel 104*b*, or a type of opening precast panel 106*b*, 108*b* or 110*b*) is depicted in and described in reference to FIG. 13. In this implementation, the top end plate 702 of the interior precast panel 700 is clamped or bolted to the bottom end plate 704 of the vertically adjacent precast panel (not shown in FIG. 7).

A vertical panel-to-panel connection implemented as described herein using a top end plate and a corresponding bottom end plate of vertically adjacent panels 102, 104, 106, 108 or 110 may be positioned at a floor level of the building, or above the floor level (for example about one to four feet above floor level.

In another implementation of a vertical panel-to-panel connection between the interior precast panel 700 and a vertically adjacent precast panel (e.g., 102*b*, 104*b*, 106*b*, 108*b* or 110*b*), the top end plate 702 of the interior precast panel 700 is welded to the bottom end plate 704 of the vertically adjacent precast panel (not shown in FIG. 7).

In yet another implementation of a vertical panel-to-panel connection, the precast panel 700 corresponds to a first interior precast panel 102*a* of the first group 112*a* of precast panels in the precast wall system 100. In this implementation, the precast panel 700 has one or more ducts 724 extending from the top end plate 702 of the panel 700 (e.g., the first panel 102*a*) towards the bottom plate 704 of the respective panel 700. The top end plate 702 of the precast panel 700 (e.g., 102*a*) has one or more openings 726 extending through the top end plate 702 and in axial alignment with a respective duct 724 of the precast panel 700. A second precast panel (e.g., 102*b*, 104*b*, 106*b*, 108*b* or 110*b* in FIG. 1 or 6) of the second group 112*b* of precast panels also has a duct 724 extending from the top end plate 702 of the second precast panel to the bottom plate 704 of the second panel (e.g., 102*b*, 104*b*, 106*b*, 108*b* or 110*b*), such as shown for the panel 700 in FIG. 7. The two end plates 702 and 704 of the second panel (e.g., 102*b*, 104*b*, 106*b*, 108*b* or 110*b*) each has one or more openings 726 extending through the respective plate and in axial alignment with a respective duct 724 of the second panel (e.g., 102*b*, 104*b*, 106*b*, 108*b* or 110*b*). Each opening 726 of the two end plates 702 and 704 of the second panel 102*b*, 104*b*, 106*b*, 108*b* or 110*b* may be the same size or larger than the opening 726 of the top plate 702 of the precast panel 700 (e.g., 102*a*) to which the second panel is to be vertically connected.

In this implementation of a vertical panel-to-panel connection, the precast wall system also includes one or more vertical reinforcing bars 728. Each reinforcing bar 728 is disposed in and extends through a respective one of the ducts 724 of the second panel 102*b*, 104*b*, 106*b*, 108*b* or 110*b*, a respective opening 726 of the bottom end plate 704 of the second panel 102*b*, 104*b*, 106*b*, 108*b* or 110*b*, a respective opening 726 of the top end plate 702 of the first panel 700 or 102*a* and a respective duct of the first panel 700 or 102*a*. As described in further detail herein, each reinforcing bar 728 may be formed from coupled vertical reinforcing bar segments 728*a* and 728*b* to define a single continuous vertical reinforcing bar 728 for implementing a vertical panel-to-panel connection among multiple vertically adjacent precast panels employed in separate tiers 112*a*, 112*b* and 112*c* of the precast wall system 100.

In one implementation, each duct 724 of each of the first panel 700 or 102*a* and the second panels 102*b*, 104*b*, 106*b*, 108*b* or 110*b* is wider than the vertical reinforcing bar 728. In this implementation, a grout or other cement material may be disposed in each duct 724 of each of the first panel 700 or 102*a* and the second panel 102*b*, 104*b*, 106*b*, 108*b* or 110*b* to secure or affix the vertical reinforcing bar 728 to the first and second panels that are vertically connected via the respective reinforcing bar 728. Each end of each vertical reinforcing bar 728 may be anchored to the top side 710 of the second or last precast panel (e.g., 102*b* or 102*c*) to be vertically connected via the respective reinforcing bar 728.

In addition, each reinforcing bar 728 may have a length sufficient to extend through three or more vertically adjacent precast panels (e.g., 102*a*, 102*b* and 102*c*) of the precast wall system 100. Thus, each reinforcing bar 728 may have a length corresponding to or greater than the six-story section of the precast wall system 100 depicted in FIG. 1, where each precast panel 102, 104, 106, 108 and 110 has a respective length corresponding to two stories or floors of a building. Because the reinforcing bars 728 bars (which may be formed from coupled bar segments 728*a* and 728*b*) extend continuously through multiple vertically aligned precast panels (e.g., 102*a*, 102*b* and 102*c*), they provide vertical continuity throughout the building formed using the precast panels. The bars 728 may comprise or be made entirely of mild or high-strength steel (for example, steel having a strength in a range of 60 ksi to 150 ksi), and used to resist significant tension forces on the walls. The bars 728 may be post-tensioned or not, depending on the expected force levels on the walls formed by the precast panels. The size or diameter of each vertical panel-to-panel reinforcing bar 728 is preferably in the range of about 1 inch to 2½ inch in diameter. However, smaller or larger diameter vertical panel-to-panel reinforcing bar 728 may be used depending on the vertical reinforcement requirements (e.g., axial loads) of the respective precast panel. The number and location of the vertical panel-to-panel reinforcing bars 728 within a precast panel 102, 104, 106, 108 and 110 may vary. However, each precast panel to be vertically interconnected with an adjacent precast panel preferably has two or more bars 728 per panel (to provide redundancy). The vertical panel-to-panel reinforcing bars 728 may be arranged symmetrically about the vertical centerline of the respective panel 102, 104, 106, 108 and 110. In the one implementation shown in FIG. 11, the bars 728 are preferably disposed within the outer quarters of the respective panel with a horizontal bar 709 wrapped around the reinforcing bars 728 to provide lateral support of the bars 728. Each of the vertical reinforcing bars or bar segments 728*a* and 728*b* may be a rod or other reinforcing member. In particular, tensioning cables may be used as an alternative to reinforcing bars 728. Tensioning cables may be anchored to a foundation 50 or wall 60 in a similar manner as described herein for reinforcing bars 728 (for example, as described in reference to FIG. 3B). Tensioning cable may also be anchored within or to a precast panel in a similar manner as described for reinforcing bars 728 (for example, as described in reference to FIG. 16B). In addition, tensioning cables or cable segments may be joined via a coupler to form a continuous panel-to-panel vertical reinforcing member as described herein for reinforcing bars 728.

The precast panel 700 (as well as other precast panels 102, 104, 106, 108 and 110 described herein) may be manufactured using forms (not shown in figures) that temporarily hold or retain the end plates 702 and 704 relative to the vertical bars 706 and hold or retain the one or more side plates 720*a*-720*f* while the cementitious material 708 is poured inside the forms and allowed to set or cure. In one implementation, tubes or pipes, such as metal or plastic pipes, having a diameter greater than the vertical reinforcing bars 728 may be inserted in and extend between the openings of the end plates 702 and 704 to form the vertical ducts 724 in the precast panel 700 before the cementitious material 708 sets or cures to form the precast panel 700. The tubes or bars are preferably corrugated to aid in the transfer of forces to the respective precast panel 700.

Figure 8:
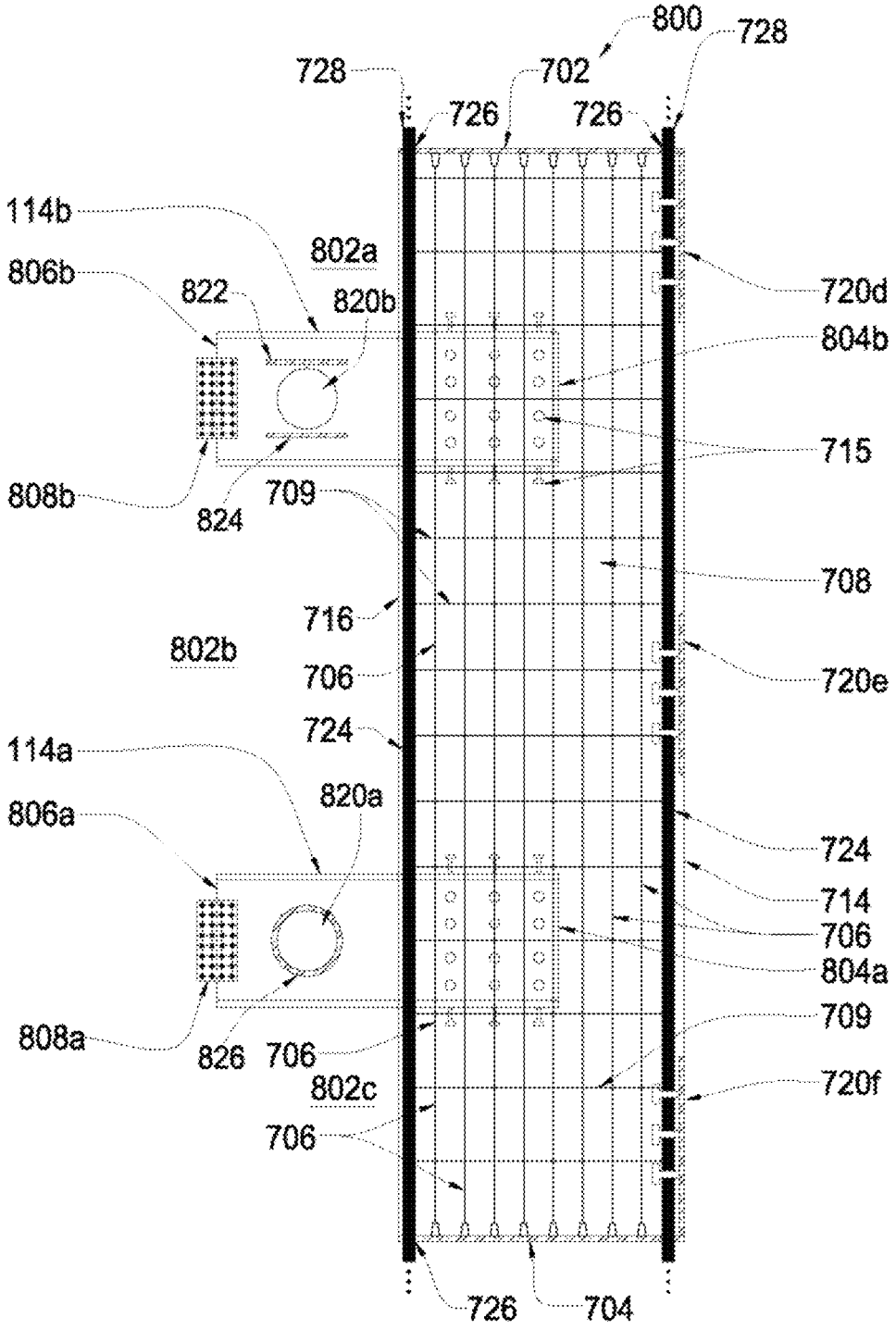
FIG. 8 is a vertical cross-sectional view of an exemplary opening precast panel that may be employed to construct the precast wall system of FIG. 1 in accordance with the present invention, where the opening panel has one or more link beams that define a passage for persons, plumbing, ducts or other mechanical systems.

Turning to FIG. 8, a vertical cross-sectional view is shown of an exemplary embodiment 800 of a "left" opening precast panel 106 (as viewed from the internal or front side 718 of the panel) that may be employed to construct the precast wall system 100. Except as noted herein, the opening precast panel 800 may have an internal structure corresponding to an interior precast panel 700. In particular, the opening precast panel includes a top end plate 702, a bottom end plate 704, and a plurality of vertical bars 706 disposed between and attached to the end plates 702 and 704 and a cementitious material 708 encasing the vertical bars 706 and defining the right side 714, left side 716, front side 718 and back side 720 of the panel 800 between the top end plate 702 and the bottom end plate 704. The precast panel 800 may also include a plurality of horizontal bars or transverse ties 709. The precast panel 800 may also be formed to include vertical ducts 724 to receive vertical reinforcing bars 728 for a vertical panel-to-panel connection with a vertically adjacent precast panel 102, 104, 106, 108 or 110.

In the implementation shown in FIG. 8, the opening precast panel 800 has side plates 720*d*-720*f* affixed to the right side 714 of the panel 106 to enable the panel 106 to form a horizontal panel-to-panel connection with an adjacent precast panel 102, 104 or 108 in a similar manner as described for the interior precast panel 700. As shown in FIG. 8, the opening precast panel 106 also includes one or more link beams 114*a* and 114*b* affixed to the left side 716 of the panel 106. Each link beam 116*a* and 116*b* defines a respective passage or opening 802*a*, 802*b*, and 802*c* above and/or below the respective link beam 114*a* and 114*b* relative to an adjacent precast panel 108 or 110 to which the link beam 114*a* and 114*b* is interconnected. Each link beam 114*a* and 114*b* may be spaced along the side 716 of the panel 106 to permit the passage or opening 802*a*, 802*b*, and 802*c* to accommodate persons, plumbing, ducts or other mechanical systems required to pass through the wall formed by the respective panel 106. As discussed in further detail herein, the link beams 114*a* and 114*b* may each be employed to support a floor slab for a respective story or level of the building erected using the precast wall system 100.

Note, a "right" opening precast panel 108 as shown in FIGS. 1 and 6 has a similar structure to the opening precast panel 106 except that the panel 108 has side plates 720*a*-720*c* affixed to the left side 716 of the respective opening panel 108 and one or more link beams 116*a* and 116*b* affixed to the right side 714 of the panel 108 such that each link beam 116*a* and 116*b* defines a respective passage or opening 802*a*, 802*b*, and 802*c* above and/or below the respective link beam 114*a* and 114*b* relative to an adjacent precast panel 106 or 110 to which the link beam 116*a* and 116*b* is interconnected. Similarly, a "left and right" opening precast panel 110 as shown in FIGS. 1 and 6 has a similar structure to the opening precast panel 108 except that the panel 110 has one or more link beams 116*a* and 116*b* affixed to the right side 714 of the panel 110 and one or more link beams 114*a* and 114*b* affixed to the left side 716 of the panel 110. For clarity and brevity in the discussion, the description herein of link beams 114*a* and 114*b* for a left opening precast panel 106 (consistent with panel 800) is applicable to the link beams 116*a* and 116*b* of a right opening precast panel 108 and a left and right opening precast panel 110.

As shown in FIG. 8, each link beam 114*a* and 114*b* has a first end 804*a* or 804*b* encased in the cementitious material 708 of the left opening precast panel 800 or 108 and a second end 806*a* or 806*b* extending from the left side 716 of the opening precast panel 800. Similarly, each link beam 116*a* and 116*b* of a right opening precast panel 108 (or 902 shown in FIG. 9) has a first end 804*a* or 804*b* encased in the cementitious material 708 of the respective panel 108 or 902 and a second end 806*a* or 806*b* extending from the right side 716 of the opening precast panel 106. A right opening precast panel 108 (or the right side 714 of an opening panel 110) may be disposed adjacent to a left opening precast panel 106 (or to the left side 716 of an opening panel 110) such that the second ends 806*a* and 806*b* of the link beams 116*a* and 116*a* of the right opening precast panel 108 (or the right side 714 of the opening panel 110) and the second ends 806*a* and 806*b* of the link beams 114*a* and 114*b* of the left opening precast panel 106 or 800 (or the left side 716 of the opening panel 110) are disposed in proximity to each other and substantially axially aligned as shown in FIGS. 1 and 7. The second ends 806*a* and 806*b* of the link beams 114*a* and 114*b* of the left opening precast panel 106 or 110 may then be interlinked or connected to the second ends 806*a* and 806*b* of the link beams 116*a* and 116*b* of the right opening precast panel 108 or 110, for example, via a respective bolted or welded shear splice plate 808*a* or 808*b*. In this implementation, when the first link beam 114*a* and/or 114*b* of the left opening precast panel 106 or 110 is disposed in proximity to the second link beam 116*a* and/or 116*b* of the right opening precast panel 108 or 110, the respective two link beams 114 and 116 define the gap or opening 802*a*, 802*b*, or 802*c* between the left side 714 (or first side) of the left (or first) opening precast panel 106 or 110 and the right side 716 (or second side) of the right (or second) opening precast panel 108 or 110.

In one implementation, the link beams 114 and 116 may comprise or be made of steel or other high-strength metal or material. In another implementation, the link beams 114 and 116 may be made of the same cementitious material 708 as the precast panel and reinforced using vertical bars 706 and/or horizontal bars 709 in a manner similar to the precast panel 700. The link beams 114 and 116 may have a standard I beam shape or other shape that enables the first end 804*a* or 804*b* of the beam 114 or 116 to be embedded and/or anchored in the respective opening precast panel 106, 108 or 110 with enough length to transfer the forces from the link beam 114 or 116 to the precast panel 106, 108 or 110. Each of the link beams 114 and 116 may also have one or more shear studs 715 extending from the portion of the link beam 114 or 116 embedded in the panel to effectively further reinforce the link beam 114 or 116 connection to the precast panel 700 and assist in the transfer of forces from the link beam 114 or 116 to the precast panel 700.

As shown in FIG. 8, an opening 820*a* or 820*b* may be formed in the vertical webbing of one or more of the link beams 114*a* and 114*a* formed in a precast panel 800 to function as passage for plumbing or mechanical devices. Each opening 820*a* or 820*b* preferably has a circular shape to limit the weakening of the link beam 114*a* or 114*b*. In the implementation shown in FIG. 8, the upper link beam 114*b* has a first steel plate 822 affixed (e.g., via a weld) above the opening 820*b* and orthogonal to the webbing of the link beam 114*b*. The upper link beam 114*b* also has a second steel plate 824 affixed (e.g., via a weld) below the opening 820*b*, orthogonal to the webbing of the link beam 114*b*, and parallel to the first steel plate 822. The two parallel steel plates 822 and 824 provide additional reinforcement to the opening 820*b*. Additional reinforcement for the opening 820*a* through the webbing of the lower link beam 114*a* comprises a circular steel pipe 826 having an outside diameter substantially equal to the diameter of the opening 820*a*, and extending out from the webbing of the link beam 114*a* on both sides of the opening 820*a*.

Figure 9:
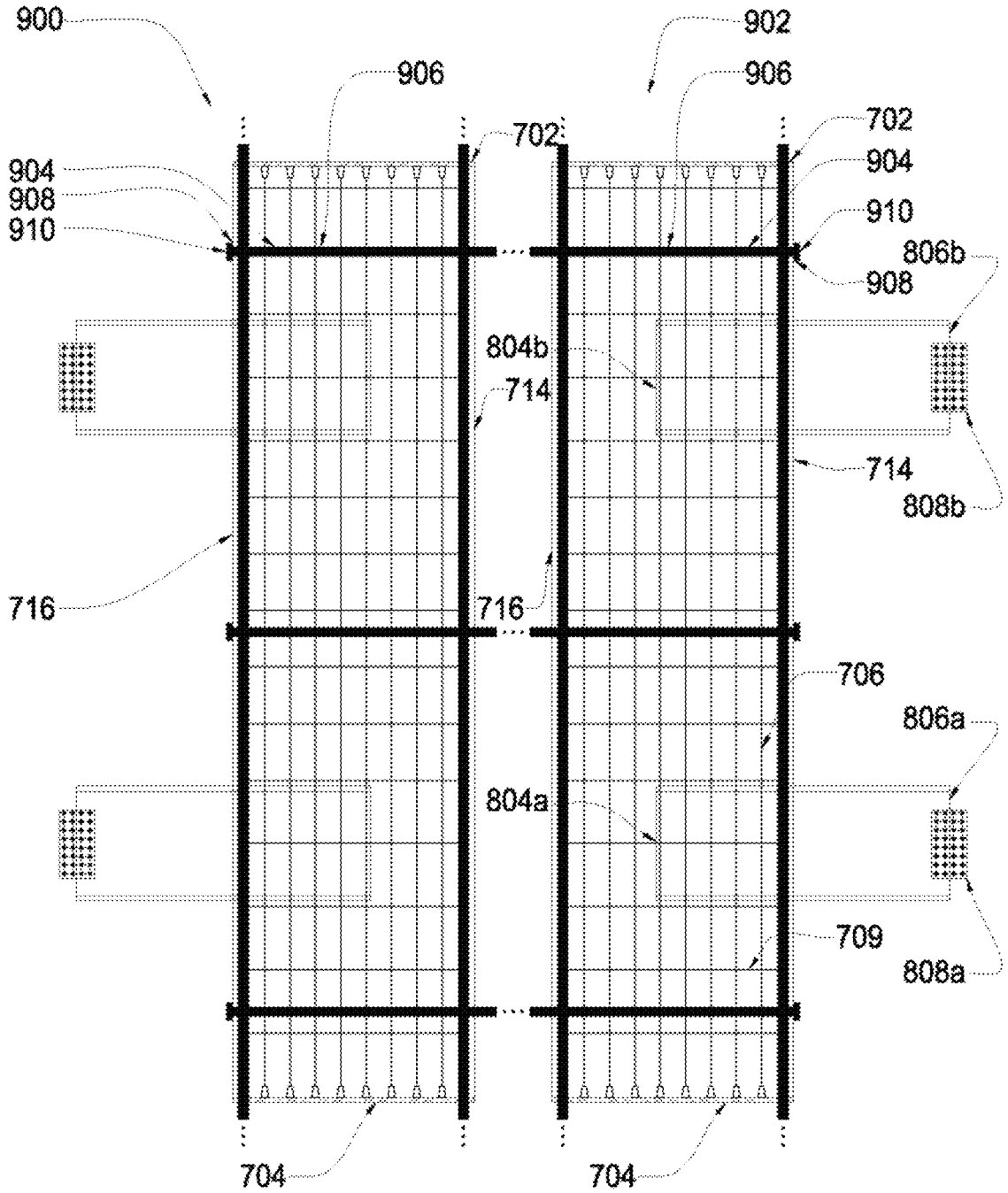
FIG. 9 is a vertical cross-sectional view of two or more exemplary precast panels that may be employed to construct the precast wall system of FIG. 1 in accordance with the present invention, where the precast panels have one or more horizontal ducts adapted to receive a respective reinforcing bar for horizontally connecting the precast panels to each other.

FIG. 9 is a vertical cross-sectional view of two or more exemplary precast panels 900 and 902 that may be employed to construct the precast wall system 100. The precast panels 900 and 902 each has one or more horizontal ducts 904 adapted to receive a respective panel-to-panel horizontal reinforcing bar 906 for horizontally connecting the precast panels 900 and 902 to each other to implement another panel-to-panel horizontal connection alternative in accordance with the present invention. Although the two precast panels 900 and 902 illustrated in FIG. 9 are opening precast panels 106 and 108, this panel-to-panel horizontal connection may be employed to horizontally interconnect any combination of interior, corner, or opening precast panels 102, 104, 106, 108 or 110. In the implementation shown in FIG. 9, each precast panel 900 and 902 of a group of precast panels (e.g., group 112*a*, 112*b* or 112*c*) has a duct 904 extending through a left side 714 to right side 716 width of the respective panel 900 or 902 and in axial alignment with the duct 904 of a horizontally adjacent precast panel 902 or 900. A horizontal reinforcing bar 906 (which may be a rod or other reinforcing member) is disposed in and extends through each of the axially aligned ducts 904 of the horizontally adjacent precast panels 900 and 902. Because the reinforcing bars 906 bars extend continuously through multiple horizontally aligned precast panels 900 and 902, they provide horizontal continuity throughout the building formed using the precast panels. The bars 906 may comprise or be made entirely of mild or high-strength steel, such as steel having a strength of 60 ksi to 150 ksi. The horizontal reinforcing bars 906 are anchored at each end of the group of precast panels 900 and 902 through which the respective bar 906 extends. In the implementation shown in FIG. 9, each horizontal reinforcing bar 906 may have a bar anchor 910 attached to at least one end of the horizontal reinforcing bar 906. The bar anchor 910 has a shape adapted to inhibit the movement of the horizontal reinforcing bar 906 in at least one direction within the ducts 906 of the panels 900 and 902 through which the respective bar 906 extends. In one implementation, the bar anchor 910 has a greater width than the horizontal reinforcing bar 906 to inhibit movement of the reinforcing bar 906 beyond the side 714 or 716 of the precast panel 900 or 902 to which the bar anchor 910 is adapted to engage. The bar anchor 910 may be, for example, a high-strength nut that is affixed to a threaded end 908 of the respective horizontal reinforcing bar 906. In one implementation, a plate functioning as a washer may be placed between the nut and the edge of the precast panel 900 or 902 to further inhibit the movement of the horizontal reinforcing bar 906 beyond the side 714 or 716 of the respective panel.

When the horizontal reinforcing bars 906 are anchored at each end of the group of precast panels 900 and 902 through which the respective bar 906 extends, the ducts 904 through which each bar 906 extends do not need to be grouted. The number (and size) of horizontal reinforcing bars 906 extend through a group of horizontally adjacent panels 900 and 902 and level of post-tensioning of the bars 906 are derived based on a predetermined horizontal compressive (clamping) stress on the panels 900 and 902 that enables the shear forces on the plane of the horizontal connection to be transferred by friction between the panels 900 and 902. The horizontal reinforcing bars 906 may each be a rod or other reinforcing member. In particular, tensioning cables may be used as an alternative to horizontal reinforcing bars 906. Tensioning cables may be anchored at each end of the group of precast panels 900 and 902 in a similar manner as described herein for horizontal reinforcing bars 906. In addition, tensioning cables or horizontal reinforcing bars 906 may be joined via a coupler to form a continuous panel-to-panel horizontal reinforcing member in a similar manner as described herein for reinforcing bars 728.

Figure 10:
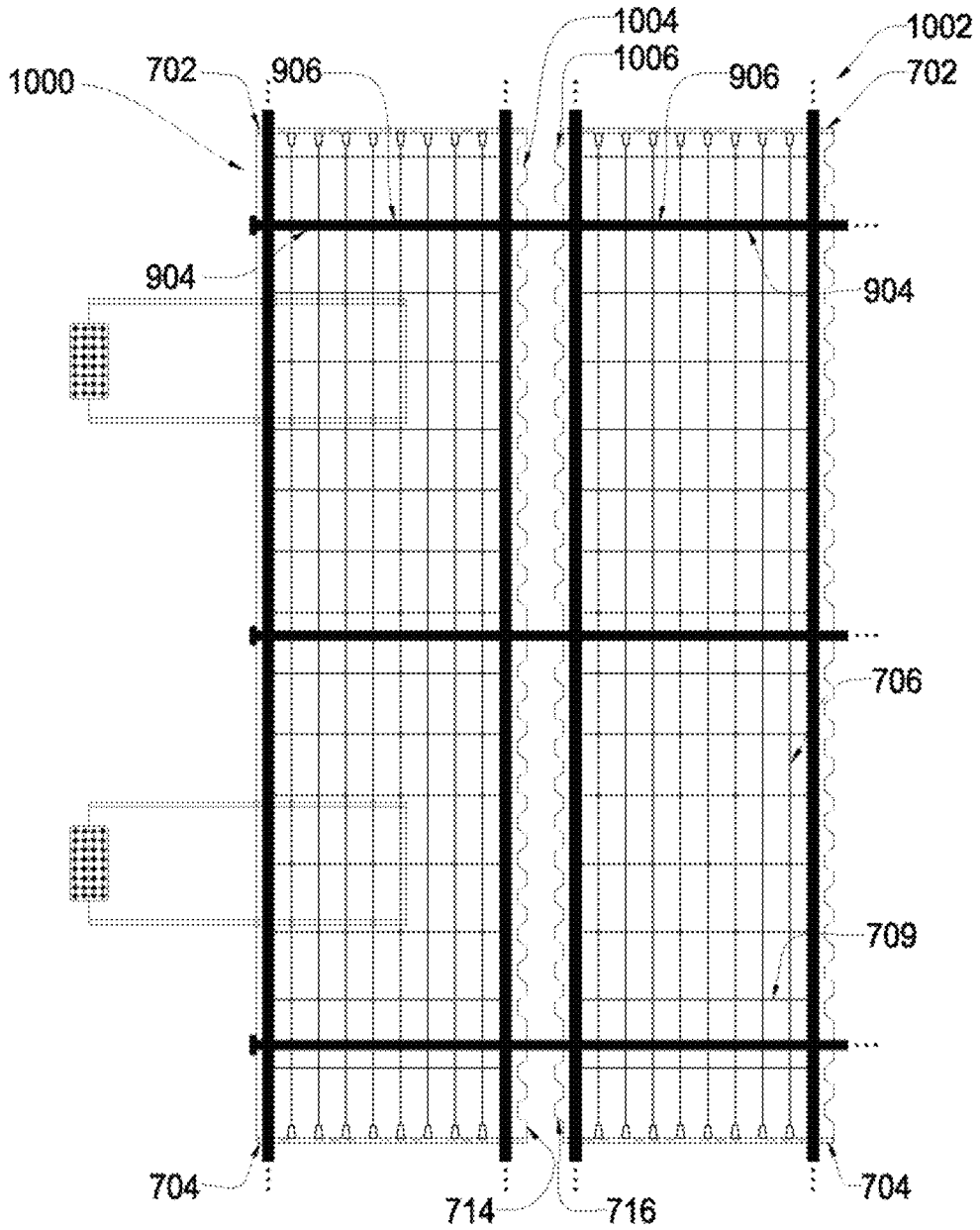
FIG. 10 is a vertical cross-sectional view of another two or more exemplary precast panels that may be employed to construct the precast wall system of FIG. 1 in accordance with the present invention, where the precast panels each has a side and a shear key disposed or formed on the side of the respective panel for horizontally mating or aligning the panel to another precast panel.

Turning to FIG. 10, a vertical cross-sectional view of another two or more exemplary, horizontally adjacent precast panels 1000 and 1002 that may be employed to construct the precast wall system 100. The precast panels 1000 and 1002 each has a side 714 or 716 and one or more shear keys 1004 or 1006 disposed or formed on the side of the respective panel for horizontally mating or aligning the respective panel 1000 or 1002 to another precast panel 1002 or 1000. In the example shown in FIG. 10, the first panel 1000 (e.g., an opening precast panel 108) has a first shear key (or set of shear keys) 1004 attached to the right or first side 714 of the first panel 1000. The second panel 1002 (e.g., an interior precast panel 102) has a second shear key (or set of shear keys) 1006 disposed or formed on the left or second side 716 of the second panel 1002 facing the right or first side 714 of the first panel 1000. The second shear key or key set 1006 is formed to complementary mate the first shear key or key set 1004 such that the one or more horizontal ducts 904 of the first panel 1000 are each axially aligned with the corresponding one or more horizontal ducts 904 of the second panel 1002 when the first shear key or key set 1004 is mated to the second shear key or key set 1006. In this implementation of a panel-to-panel horizontal connection shown in FIG. 10 employing mating shear keys 1004 and 1006, the combination of friction (due to a compressive clamping stress) and shear keys 1004 and 1006 enables the transfer of vertical shear forces between the precast panels 1000 and 1002. Employing mating shear keys 1004 and 1006 as described also provides the additional advantage that the required amount of horizontal post-tensioned reinforcement is reduced, as compared to the implementation in which the horizontal reinforcing bars 906 are used to connect adjacent panels 900 and 902 that do not have mating shear keys 1004 and 1006.

Although the two precast panels 1000 and 1002 illustrated in FIG. 10 are depicted as an opening precast panel 108 and an interior precast panel 102, respectively, the mating shear keys 1004 or 1006 may be employed on any two abutting sides 714 and 716 of any combination of interior, corner, or opening precast panels 102, 104, 106 or 108.

Figure 11:
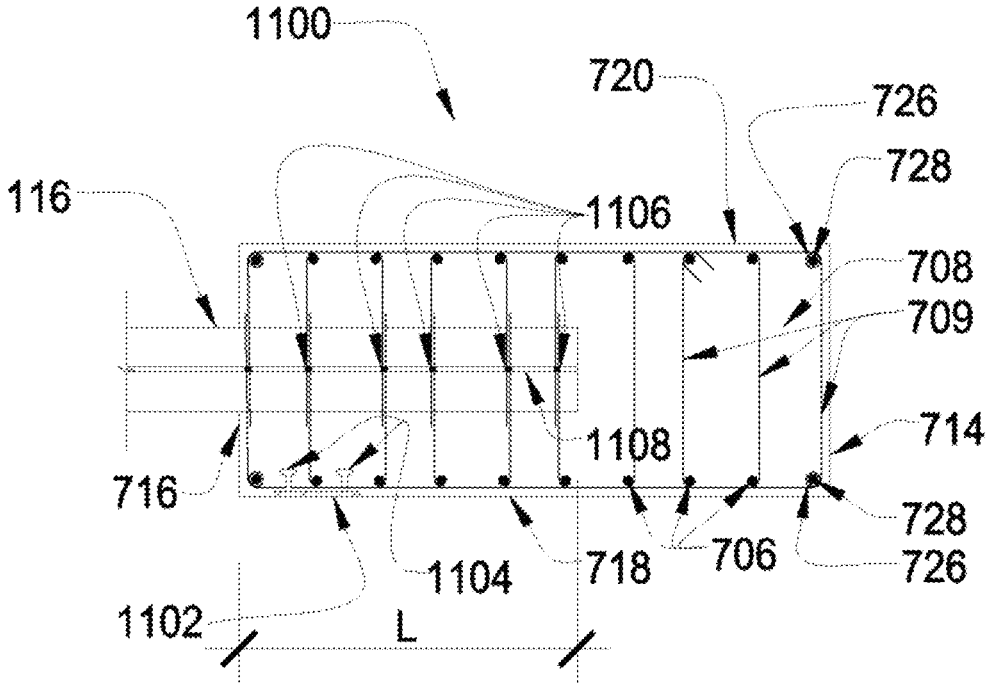
FIG. 11 is a horizontal cross-sectional view of an exemplary precast panel (e.g., an opening precast panel) that may be employed to construct the precast wall system of FIG. 1 in accordance with the present invention, where the precast panel has a plurality of horizontal bars and a plurality of vertical bars encased in concrete within the precast panel.

FIG. 11 is a horizontal cross-sectional view of an exemplary precast panel 1100 that may be employed to construct the precast wall system 100 in accordance with the present invention. The precast panel 1100 corresponds to an opening precast panel 108 having a link beam 116 embedded a length (L) within the panel 1100. However, the precast panel 1100 also has a plate 1102 embedded on the front side 718 of the panel 1100 for implementing a beam-to-panel connection 608 or a floor slab-to-panel connection 1904 in FIG. 19A as further described herein for opening precast panels as well as interior precast panels 102. As shown in FIG. 11, each plate 1102 has shear studs 1104 embedded in the cementitious material 708 of the precast panel 1100 to enable the respective plate to transfer forces between the precast panel 1100 and the beam or floor slab connected to the precast panel 1100 via the embedded plate 1102. Note, although the embedded plate 1102 is also referenced as a shear plate 1102 herein, one of ordinary skill in the art would recognize that the plate 1102 enables forces in addition to shear forces (e.g., compression, moment or tension forces) to be transferred between the respective precast panel 1100, 102, 104, 106, 108 or 110 and the beam or floor slab to which the precast panel is connected via the embedded plate 1102.

The precast panel 1100 further has a first arrangement of horizontal bars 709, vertical bars 706 connected between the two end plates 702 and 704 of the panel 1100 and vertical panel-to-panel reinforcing bars 728 extending through the precast panel 1100. In this first arrangement, a respective horizontal bar 709 transverses or wraps around a respective set of at least two and preferably four vertical bars 706 or the set of two and preferably four vertical panel-to-panel reinforcing bars 728.

The number of horizontal bars 709, the number of vertical bars 706 and the number of vertical panel-to-panel reinforcing bars 728 are based on the predetermined strength required to resist and transfer the predicted forces and moments on the respective precast panel 1100, 102, 104, 106, 108 or 110. As previously described herein, because the precast wall system 100 may be employed to construct a high-rise building, the precast panels 1100 (and other embodiments of the precast panels 102, 104, 106 108 and 110) may be subjected to high axial forces due to gravity loads (such as the self-weight of the structure and imposed loads) and lateral loads (such as wind). For this reason and due to the proportions of panels required for high-rise buildings, the vertically adjacent precast wall panels 102, 104, 106, 108 and 110 may be considered as individual columns. Therefore, the amount of vertical reinforcement (i.e., the number of vertical bars 706 and the number of vertical panel-to-panel reinforcing bars 728) is based on the predetermined strength required to resist and transfer the imposed forces and moments. For precast panels 102, 104, 106, 108 and 110 in which the predicted axial and moment load force levels are relatively small, minimum amounts of reinforcement are required, and the number of vertical bars 706 and vertical panel-to-panel reinforcing bars 728 may be based on applicable building codes for reinforced concrete walls or foundation. Thus, the amount of vertical reinforcement (i.e., the combination of vertical bars 706 and vertical panel-to-panel reinforcing bars 728) may range from approximately 0.12 percent to 8 percent of the horizontal cross section of the precast panel as shown in FIG. 11.

Horizontal bars 709 may be provided to enclose and laterally support the vertical bars 706. Horizontal bars 709 also provide additional strength to the precast panel 1100, 102, 104, 106, 108 and 110 for resisting horizontal shear forces and torsional moments (moments acting in the direction of the vertical axis of the respective panel). For precast panels 1100, 106, 108 and 110 with embedded steel link beams (i.e., opening precast panels), small openings 1106 are formed through the beam web 1108 to allow passing of the horizontal bars 709.

As previously noted, grout or other cement material may be inserted into the vertical ducts 726 through which the vertical panel-to-panel reinforcing bars 728 extend in order to affix the bars 728 within the ducts 726 of the respective precast panels 102, 104, 106, 108 and 110.

Figure 12:
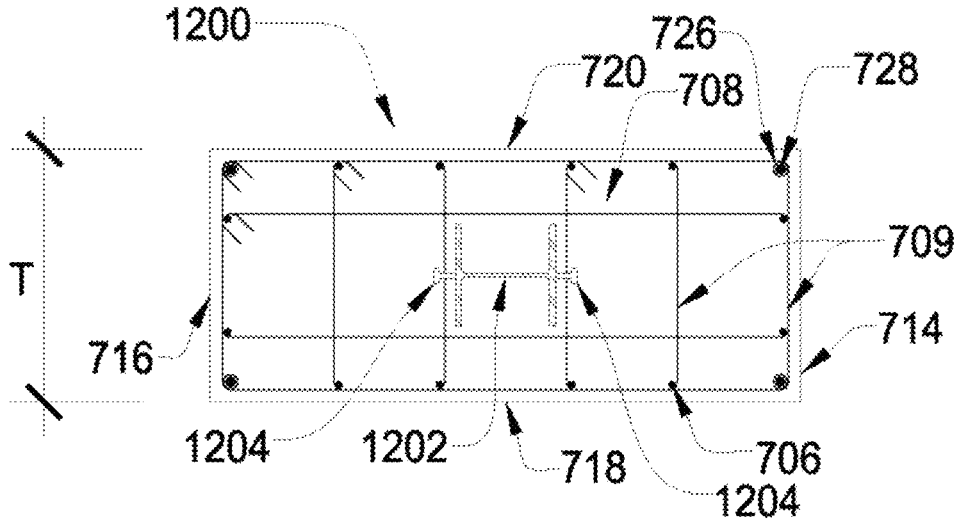
FIG. 12 is a horizontal cross-sectional view of another exemplary precast panel (e.g., an interior precast panel) that may be employed to construct the precast wall system of FIG. 1 in accordance with the present invention, where the precast panel has one or more support members encased in concrete within the precast panel to provide additional strength to the precast panel.

FIG. 12 is a horizontal cross-sectional view of another exemplary precast panel 1200 (e.g., an interior precast panel 102) that may be employed to construct the precast wall system 100 in accordance with the present invention. The precast panel 1200 has a support member or column 1202 disposed vertically within the precast panel 1200 and encased in the cementitious material 708 between the two end plates 702 and 704 (not shown in FIG. 11) of the panel of the panel to provide additional strength to the precast panel 1200. The support member 1202 may have a non-circular shape that is different than the vertical bars 706 or 728 and extends vertically within the panel 1200. In the implementation shown in FIG. 12, the support member 1202 has an I shape and includes headed shear studs 1204 extending laterally from the I shape portion of the support member 1202. Although not shown in FIG. 12, respective ends of the support member or column 1202 may be welded or bolted to the top and bottom end plates 702 and 704 of the precast panel 1200. The support member or column 1202 may comprise or be made of steel or other high-strength material (e.g., having a yield strength of 36 ksi to 65 ksi) to provide the panel 1200 with additional strength. The non-circular shape of the support member or column 1202 provides further reinforcement to the precast panel 1200. Therefore, the support member or column 1202 reduces the amount of vertical bars 706 needed in the precast panel 1200 to meet the same predetermined strength as required for the precast panel 1100. Thus, employing the support member or column 1202 in the precast panel 1200 as shown and described is particularly useful when the predicted axial stresses on the panel are significant (e.g., service stresses up to 6,000 psi), and the amount of vertical reinforcement required is rather large.

Building codes may specify the location and minimum amounts of vertical and horizontal rebar reinforcement for cast-in-place concrete columns with encased steel members (i.e., composite columns). The combination of vertical bars 706 and vertical reinforcing bars 728 of the precast panel 1200 comprises an area of at least 0.4% of the horizontal cross sectional area of the panel 1200. The support member 1202 (when employed) preferably comprises an area of at least 1% of the horizontal cross sectional area of the panel 1200. In the implementation shown in FIG. 12, the vertical reinforcing bars 728 are disposed at every corner of the panel 1200 and vertical bars 706 are spaced apart no further than one-half the thickness (T) of the precast panel 1200. In this implementation, the precast panel 1200 has a total area of vertical reinforcement (grouted reinforcing bars 728 and vertical bars 706) of at least 0.4% of the panel's 1200 cross sectional area. Horizontal bars 709 may be provided to enclose and laterally support the vertical bars 706 and the vertical panel-to-panel reinforcing bars 728.

Figure 13B:
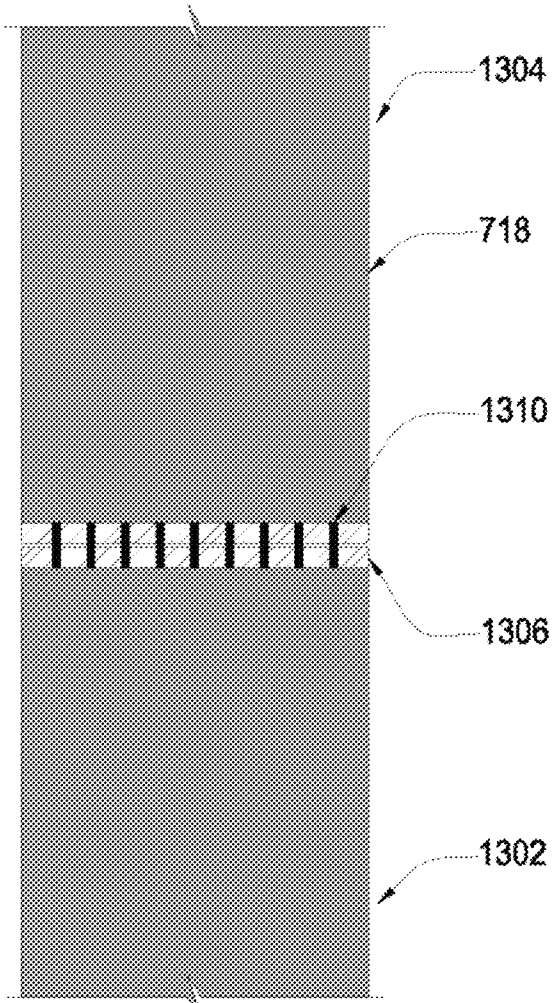
FIG. 13B is a side view of the two vertically connected precast panels in FIG. 13A.
Figure 13A:
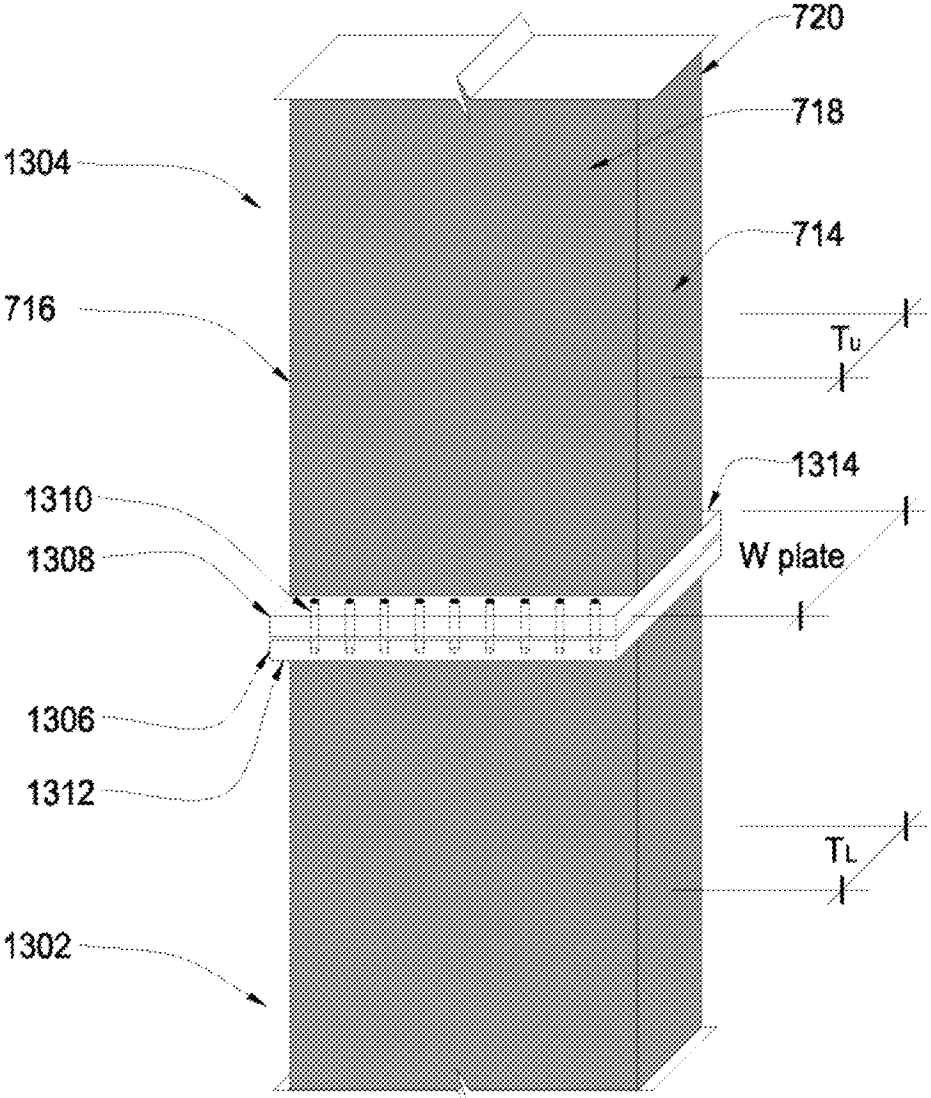
FIG. 13A is a perspective view of two exemplary precast panels of the precast wall system of FIG. 1, where the two precast panels each have end plates that are vertically connected in accordance with one embodiment of the present invention.

FIGS. 13A and 13B depict one implementation for a vertical panel-to-panel connection 604 between two exemplary precast panels 1302 and 1304 of the precast wall system 100. The two precast panels 1302 and 1304 are representative of any vertically adjacent combination of an interior panel 102, a corner panel 104, and an opening panel 106, 108 or 110. The lower precast panel 1302 has a top end plate 1306 that is aligned with and affixed to a bottom end plate 1308 of the upper precast panel 1304. In this implementation, the top end plate 1306 and the bottom end plate 1308 each has a width (Wplate) that is greater than the thickness ($T_U$ or $T_L$) of the respective vertically adjacent upper panel 1304 and lower panel 1302 such that each end plate 1306 and 1308 has a lip 1312 or 1314 on the front side 718 and back side 720 relative to the respective panel 1306 and 1308. In this implementation of a vertical panel-to-panel connection 604, the lips 1312 of the bottom end plate 1306 and the lips 1314 of the top end plate 1308 are affixed to each other using high-strength bolts 1310 that are inserted through bores in the lips 1312 and 1314 of the end plates 1306 and 1308. The end of each bolt 1310 may be affixed to a corresponding nut (not shown in the figures) to further secure the ends plates 1306 and 1308 to each other.

Figure 14A:
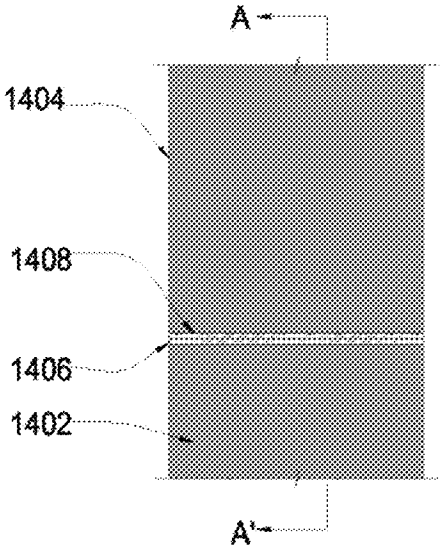
FIG. 14A is a vertical cross-sectional view of two exemplary precast panels of the precast wall system of FIG. 1, where the two precast panels each have end plates that are vertically connected in accordance with another embodiment of the present invention.
Figure 14B:
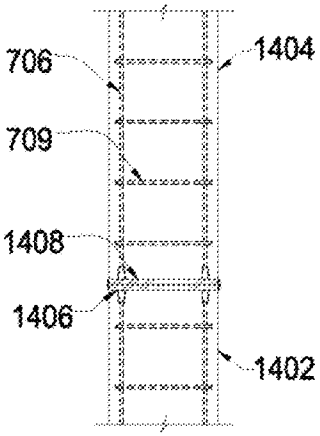
FIG. 14B is a vertical cross-sectional view of the two vertically connected precast panels in FIG. 14A.
Figure 14C:
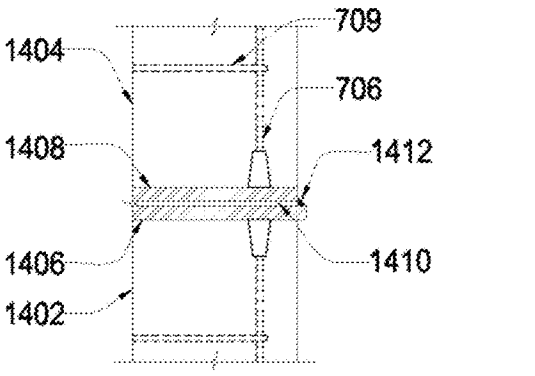
FIG. 14C is a magnified view of the two vertically connected precast panels in FIG. 14B, where one of the end plates is longer than the other to define a weld joint between the two end plates.
Figure 14D:
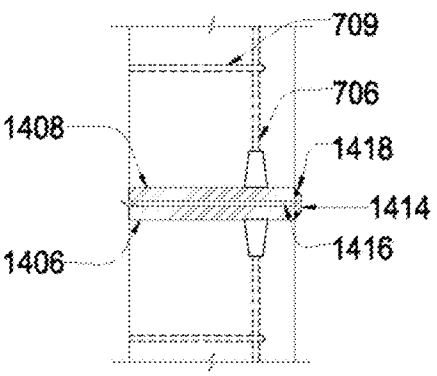
FIG. 14D is a magnified view of the two vertically connected precast panels in FIG. 14B, where a lap plate is employed to affix together the end plates of the panels.
Figure 14E:
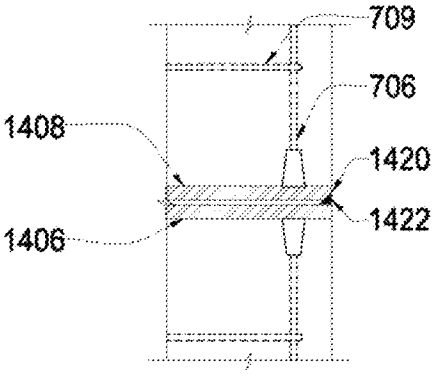
FIG. 14E is a magnified view of the two vertically connected precast panels in FIG. 14B, where one of the end plates is beveled to enable a weld joint penetration between the two the end plates of the panels.

FIGS. 14A and 14B depict a vertical cross-sectional view of two exemplary precast panels 1402 and 1404 of the precast wall system 100 that may employ one of the vertical panel-to-panel connections depicted in FIGS. 14C, 14D and 14E to vertically interconnect the panels 1402 and 1404. The two precast panels 1402 and 1404 are representative of any vertically adjacent combination of an interior panel 102, a corner panel 104, and an opening panel 106, 108 or 110. The lower precast panel 1402 has a top end plate 1406 that may be affixed to a bottom end plate 1408 of the upper precast panel 1404 in accordance with one of the implementations depicted in FIG. 14C, 14D or 14E. In the implementation depicted in FIG. 14C, the top end plate 1406 of the lower precast panel 1402 is longer than the bottom end plate 1408 of the higher precast panel 1404, defining a gap 1410 between the two end plates 1406 and 1408 to support a high strength weld joint 1412 that affixes the two end plates 1406 and 1408 to each other.

In the implementation depicted in FIG. 14D, the bottom end plate 1408 and the top end plate 1406 are the same size. In this implementation, a lap plate 1414 is disposed partially over both the bottom end plate 1406 and the top end plate 1408 to at least cover a joint 1416 between the two end plates 1406 and 1408. The lap plate 1414 is then welded to both the bottom end plate 1406 and the top end plate 1408 to affix the two end plates to each other.

In the implementation depicted in FIG. 14E, the bottom end plate 1408 and the top end plate 1406 are the same size. In this implementation, one of the end plates (e.g., the bottom end plate 1408 of the upper precast panel 1404) is beveled at one end 1420 to enable a weld joint 1422 penetration between the two end plates 1406 and 1408 to affix the two end plates to each other.

Figure 15A:
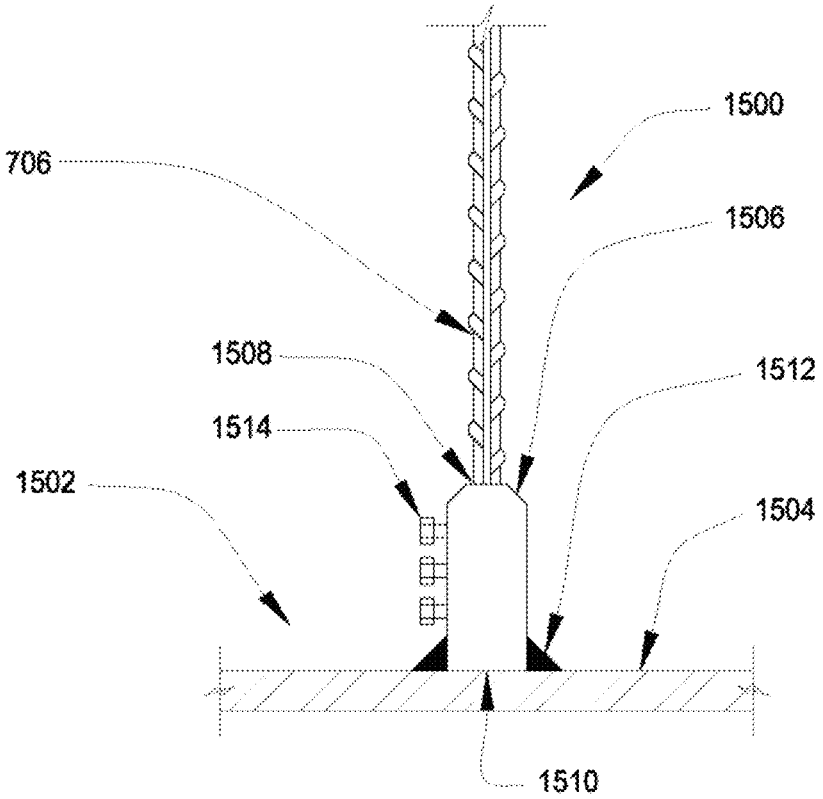
FIG. 15A is a magnified view of a vertical bar encased in an exemplary precast panel consistent with the present invention, where the vertical bar is attached to an internal surface of an end plate of the precast panel via a coupler, such as a rebar coupler.

Turning to FIG. 15A, a magnified view is shown of a vertical bar 706 encased in an exemplary precast panel 1500 and connected to a top or bottom end plate 1502 consistent with one aspect of the present invention. The precast panel 1500 is representative of each embodiment of an interior precast panel 102, corner precast panel 104, or opening precast panel 106, 108, or 110 that employs a vertical bar 706 affixed between end plates 702 and 704 as discussed herein. As shown in FIG. 15A, the vertical bar 706 is attached to an internal surface 1504 of the end plate 1502 of the precast panel 1500 via a coupler 1506 that is welded to the respective end plate 1502. The coupler 1506 has one end 1508 adapted to receive an end of the vertical bar 706 and another end 1510 that is welded (via a weld joint 1512) to the end plate 1502. In one implementation, the vertical bar 706 is retained in the coupler 1506 using one or more bolts or screws 1514 that are threaded through openings in the side of the coupler 1506 until the bolts or screws engage the vertical bar 706. In another implementation, the one end 1508 of the coupler 1506 may be threaded to receive and retain the end of the vertical bar 706. When rebar is employed to implement the vertical bar 706, the coupler 1506 may be a standard Type I or Type II rebar coupler, such as a model D-250 Bar Lock Structural Steel Connector commercially available from Dayton Superior.

Figure 15B:
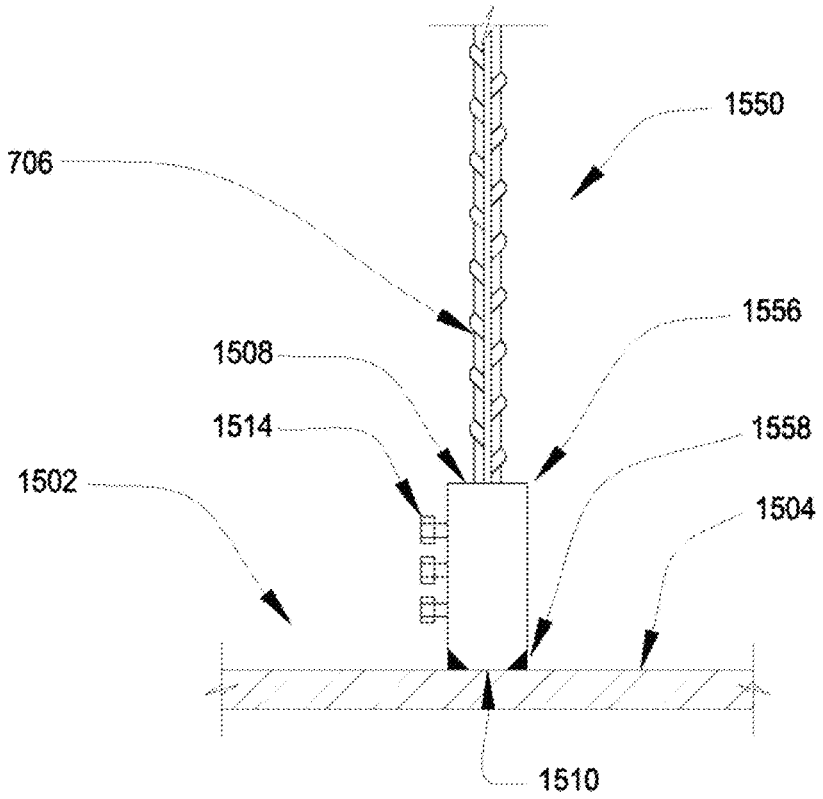
FIG. 15B is a magnified view of another coupler and welding arrangement for attaching a vertical bar encased in an exemplary precast panel consistent with the present invention.

FIG. 15B is a magnified view of another coupler and welding arrangement for attaching a vertical bar 706 encased in an exemplary precast panel 1550 consistent with the present invention. In this arrangement, the end 1510 of the coupler 1556 that is welded to the end plate 1502 is tapered inwards to enable a complete-joint penetration weld joint 1512 to be employed to affix the coupler 1556 to the end plate 1502.

FIG. 16 illustrates a vertical cross-sectional view of two exemplary precast panels 1602 and 1604 vertically connected in accordance with the present invention. The two precast panels 1602 and 1604 are representative of any vertically adjacent combination of an interior panel 102, a corner panel 104, and an opening panel 106, 108 or 110. As shown in FIG. 16, the top one 1604 of the two precast panels may be thinner than the bottom precast panel 1602. In this implementation, the bottom end plate 704 of the top precast panel 1604 may be shorter (in the thickness direction or front side 718 to back side 720) than the top end plate 702 of the bottom precast panel 1602, enabling the two end plates 702 and 704 to be welded together via a lap weld joint 1606 and/or a lap plate welded to both end plates 702 and 704. In an alternative implementation, the end plates 702 and 704 each may be longer in the thickness direction of the two panels 1602 and 1604 so that each end plate 702 and 704 has a respective lip through which the end plates 702 and 704 may be bolted using high strength bolts as discussed herein, for example, in reference to FIG. 13.

Figure 16B:
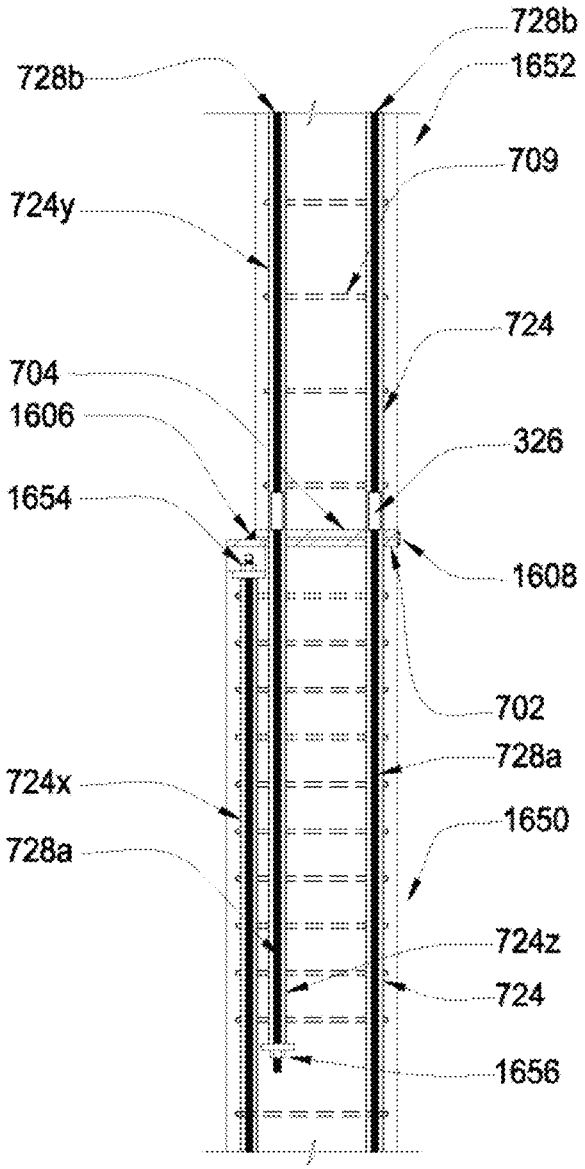
FIG. 16B is a vertical cross-sectional view of another two precast panels vertically connected in accordance with the present invention, where the top one of the two precast panels is thinner than the bottom precast panel and each panel has one or more vertical ducts adapted to receive a respective reinforcing bar for vertically connecting the two panels to each another.

FIG. 16B is a vertical cross-sectional view of another two precast panels 1650 and 1652 vertically connected in accordance with the present invention. The two precast panels 1650 and 1652 are representative of any vertically adjacent combination of an interior panel 102, a corner panel 104, and an opening panel 106, 108 or 110. Similar to the precast panels 1602 and 1604 in FIG. 16A, the upper or top one of the two precast panels is thinner than the lower or bottom precast panel 1650. In this implementation, each panel 1650 and 1652 has one or more vertical ducts 724 adapted to receive a respective reinforcing bar segment 728*a* or 728*b* that are connected via a bar-to-bar coupler 326 to form a single continuous vertical reinforcing bar 728 that vertically connects the two panels to each another. Since the lower precast panel 1650 is thicker than the upper precast panel 1652, the lower precast panel 1650 may include more ducts 724 than the upper precast panel 1652 or have one or more ducts (e.g., duct 724*x* in FIG. 16B) that does not align with corresponding duct in the upper precast panel 1652. In this implementation, the additional duct 724*x* in the lower precast panel 1650 may have a bar anchor 1654 at one end of the duct 724*x* to anchor a vertical reinforcing bar segment 728*b* that extends from the lower precast panel 1650 to a vertically adjacent precast panel in a tier (e.g., 112*a*) below the panel 1650 or to a foundation wall (not shown in FIG. 16B). Similarly, if there is no duct 724 in a panel or foundation wall below the panel 1650 that is in axial alignment with a duct 724*y* in the upper precast panel 1652, the lower precast panel 1650 may be cast to have a duct 724*z* that does not extend through the bottom end plate 704 of the panel 1650 and is axially aligned with the duct 724*y* of the upper precast panel 1652. In this implementation, the duct 724*z* may have a bar anchor 1656 at the one end of the duct 724*z* that is closest to the bottom end plate 704 of the lower precast panel 1650.

FIGS. 16C-16E depict four precast interior panels 1660, 1662, 1664 and 1666 that are vertically and horizontally connected in accordance with the present invention. The top two 1660 and 1662 of the four precast panels are thinner than the bottom two precast panels 1664 and 1666. In this implementation, each panel 1660, 1662, 1664 and 1666 has a plurality of structural angles 2302*a*-2302*d* (such as steel right angles) consistent with the precast panel 2300 described herein. Each angle 2302*a*-2302*d* is disposed along a corner edge of the respective precast panel 1660, 1662, 1664 and 1666 and may extend between a top corner and a bottom corner of the precast panel 1660, 1662, 1664 and 1666 such that each angle 2302*a*-2302*d* is adapted to connect (for example, via a high strength weld) the respective precast panel (e.g., 1660) to another horizontally adjacent precast panel (e.g., 1662) and/or to another vertically adjacent precast panel (e.g., 1666).

Since the lower precast panels 1664 and 1666 are thicker than the upper precast panels 1660 and 1662, the angles 2302*a* and 2302*b* on the front side edges of the upper precast panels 1660 and 1662 do not align with the angles 2302*a* and 2302*b* on the front side edges of the lower precast panels 1664 and 1666. To form a vertical panel-to-panel connection 604 in this implementation, the panel system includes one or more transfer members 1670 having a width equal to the change of thickness ($\Delta t$) of the lower and upper precast panels (e.g., difference in front to back sides of panels 1662 and 1664 in FIG. 16C). Each transfer member 1670 may be a solid steel bar, a hollow rectangular steel tube, or other transfer member having a yield strength in a range of 36 ksi to 65 ksi. Each transfer member 1670 is affixed (e.g., via a weld) to the vertical structural angle 2302*a* or 2302*b* of the upper precast panel 1660 or 1662 and a portion or lip 1672 of the bottom end plate 704 extending from the upper precast panel 1660 or 1662. The lip 1672 of the bottom end plate has a width corresponding to the change of thickness ($\Delta t$) of the lower and upper precast panels 1660,1662 and 1664, 1666. Each transfer member 1670 may be affixed to the respective upper precast panel during the precast fabrication process of the respective upper precast panel. To complete this vertical panel-to-panel connection 604, a connection plate 1772 as shown in FIG. 16C spans and is affixed to (e.g., via a weld) the corner edge angle 2302*a* and 2302*b* of the lower precast panel and the transfer member 1670 that is affixed to the corresponding corner edge angle 2302*a* and 2302*b* of the upper precast panel. Each connection plate 1772 may be comprised of steel or other comparable high strength material. To reinforce or augment the vertical panel-to-panel connection 604 between each upper precast panel 1660 and 1662 and each lower precast panel 1664 and 1666, the bottom end plate 704 of each upper precast panel 1660 and 1662 is affixed to the top end plate 702 of the vertically adjacent lower precast panel 1666 or 1664 using a partial joint penetration weld. To further reinforce each upper precast panel at the transfer member location, an embedded horizontal plate 1774 (with shear studs) is embedded in and spans the sides 712 and 714 of the upper precast panel (e.g., panel 1662 in FIG. 16C) to connect the vertical corner angles 2302*b* and 2302*c* (or 2302*a* and 2302*d*) on opposing sides of the panel.

Figure 17:
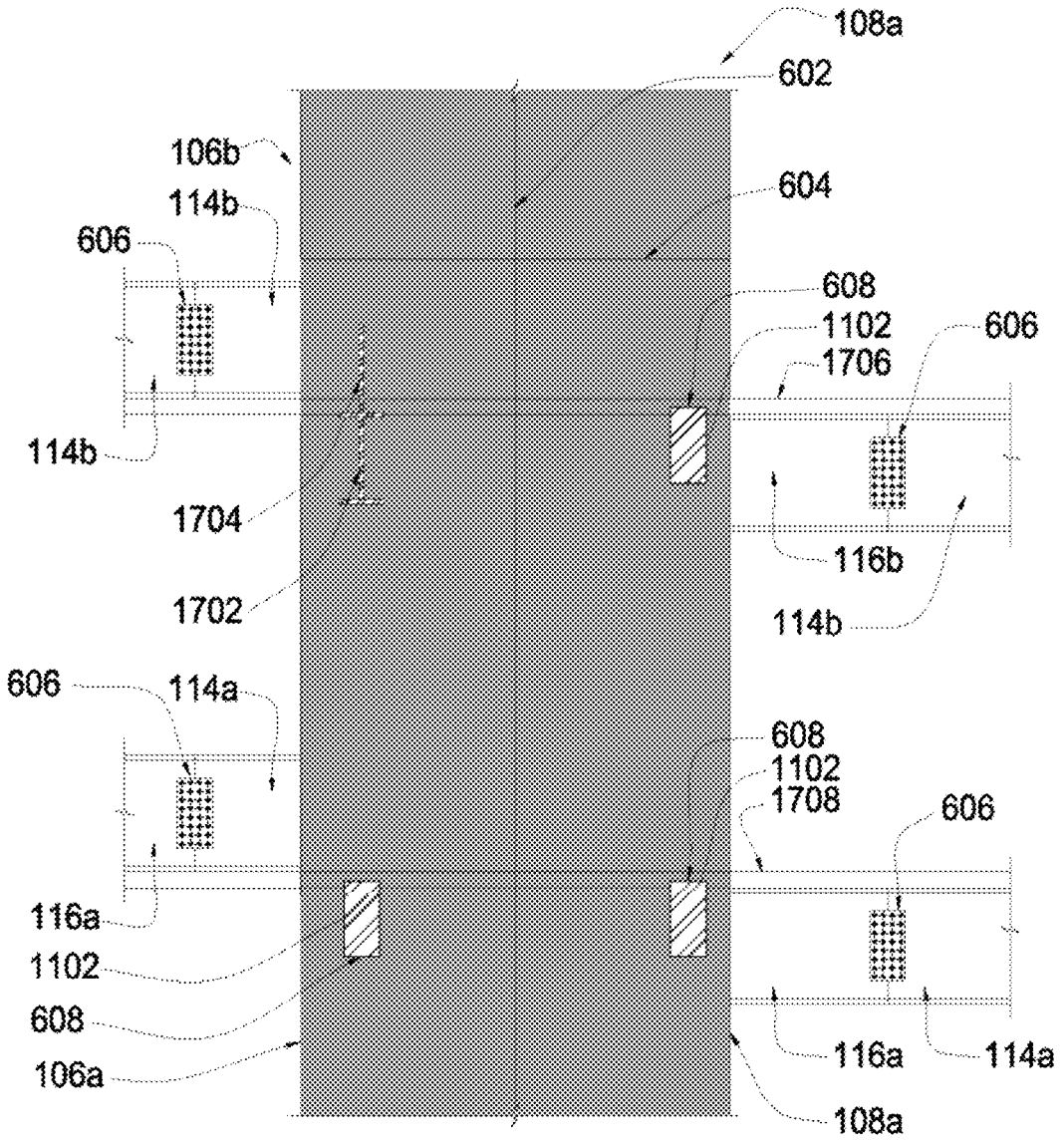
FIG. 17 depicts two precast panels horizontally connected in accordance with the present invention, where an internal surface of at least one of the precast panels includes an embedded beam segment for connecting to a floor beam and an embedded gusset plate for connecting a brace member at an angle diagonal to the internal surface of the precast panel.

FIG. 17 depicts an exploded view of two precast panels 106*a* and 108*a* (depicted in the precast wall shown in FIG. 6) that are horizontally connected in accordance with a horizontal panel-to-panel connection 602 and vertically connected to two other precast panels 106*b* and 108*b* in accordance with a vertical panel-to-panel connection 604. An internal surface or front side 718 of at least one of the precast panels (e.g., precast panel 108*a*) includes an embedded beam segment 1702 for connecting to a beam disposed orthogonal to the panel 108*a* and an embedded gusset plate 1704 for connecting a brace member (of a support frame 120, 122, or 124 of the precast wall system 100) at an angle diagonal to the internal surface 718 of the precast panel 108*a* as described in further detail herein and, in particular to FIGS. 20 and 21. Each of the precast panels 108*a* and 106*a* also include one or more embedded plates 1102 for implementing a beam-to-panel connection 608 to support, for example, a respective floor slab 1706 and 1708.

Although the embedded beam segment 1702 and embedded gusset plate 1704 are depicted in FIG. 17 as included in a left opening precast panel 108, each may be employed in a similar manner in an interior panel 102, a corner panel 104, or another type of opening precast panel 106 or 110 in order to interconnect to a support frame 120, 122, or 124 of the precast wall system 100. In addition, although each embedded plate 1102 is depicted in FIG. 17 as included in an opening precast panel 106 or 108, each may be employed in a similar manner in an interior panel 102, a corner panel 104, or another type of opening precast panel 110 in order to implement a beam-to-panel connection 608 to support, for example, a respective floor slab 1706 and 1708.

Figure 18B:
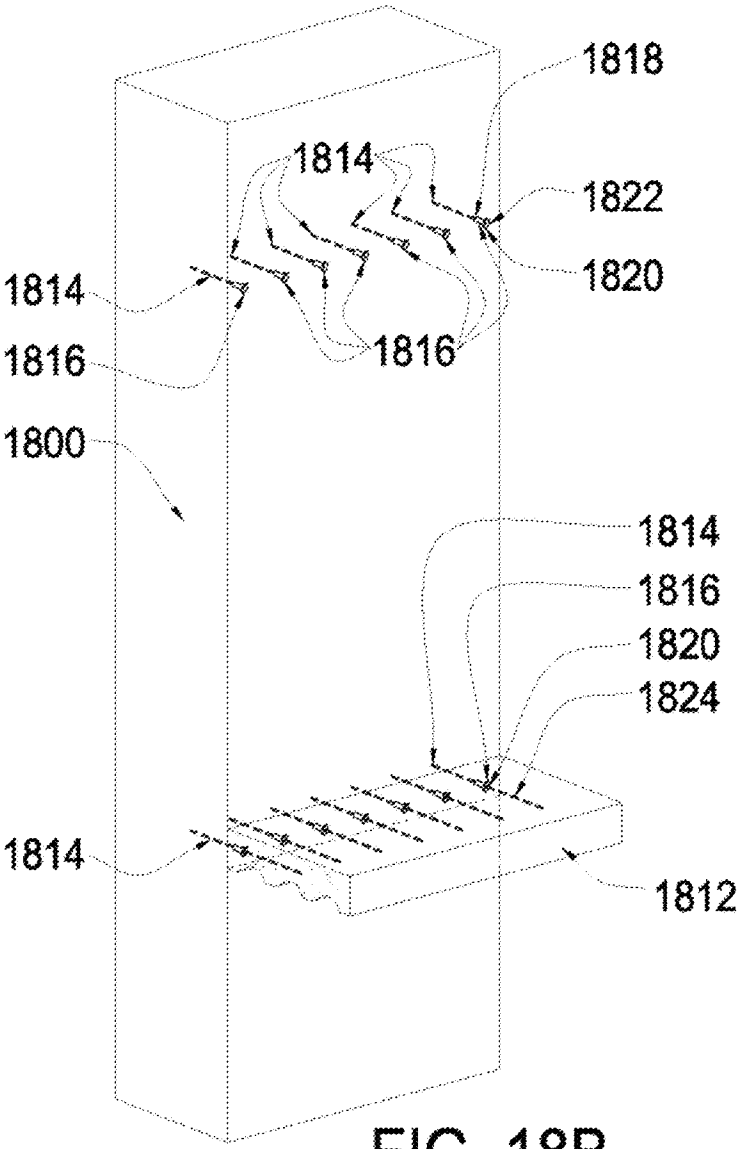
FIG. 18B is a perspective view of one embodiment of the precast panel in FIG. 18A, illustrating one implementation for connecting a floor slab (composed of concrete topping on metal deck and disposed over a floor beam) to the precast panel.
Figure 18A:
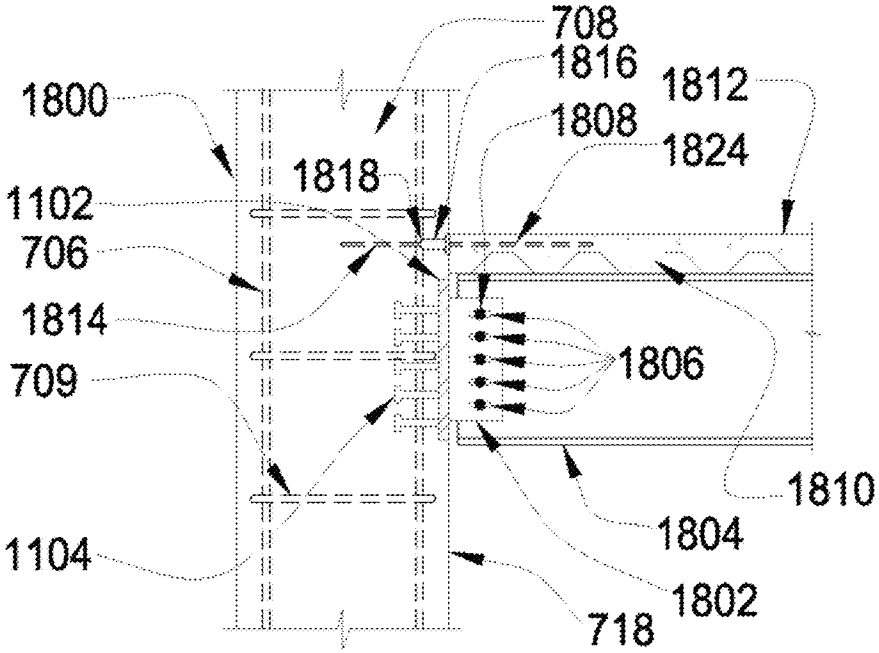
FIG. 18A is a vertical cross-sectional view of a portion of one of the precast panels in FIG. 17, illustrating one implementation for connecting a floor beam to the embedded plate in the precast panel and a floor slab to the precast panel.

Turning to FIG. 18A, a vertical cross-sectional view is shown of a portion of one of the precast panels (e.g., 108*a*) in FIG. 17 that is referenced generally as the precast panel 1800. FIG. 18A illustrates one implementation for a beam-to-panel connection 608 in accordance with one aspect of the present invention. As shown in FIG. 18A, the precast panel 1800 includes a shear tab 1802 that is affixed (via a high-strength weld or other bond) to an embedded plate 1102 of the precast panel 1800 so that the shear tab 1802 is orthogonal to the front side 718 of the precast panel. In one implementation, the shear tab 1802 may be affixed or welded to the beam 1804. In another implementation, the shear tab 1802 may have one or more bolt openings 1806 for bolting (via high-strength bolts 1808) the shear tab 1802 to the end of the beam 1804.

The embedded plate 1102 of each panel 102, 104, 106, 108 and 110 may have shear studs 1104 attached to the shear plate 1102 and embedded in the cementitious material 708 of the respective precast panel 102, 104, 106, 108 and 110. In an alternative implementation of a beam-to-panel connection 608, the beam 1804 may be welded directly to the embedded plate 1102 of the precast panel 1800.

Once the beam-to-panel connection 608 has been formed, a metal deck or web 1810 may then be disposed on the beam 1804 and a horizontally adjacent beam (not shown in FIG. 18A). A floor slab 1812 may then be formed (e.g., using concrete or another cementitious material) over the the metal deck 1810 and floor beam 1804.

To attach the floor slab 1812 to the precast panel 1800 (i.e., to form one implementation of a floor slab-to-panel connection), the precast panel 1800 may be precast to include a plurality of horizontal bars 1814 as shown in FIGS. 18A and 18B. In the implementation shown in FIG. 18B, each horizontal bar 1814 is attached to one end 1818 of a respective Type I or Type II coupler 1816 that has a socket 1820 at the other end 1822 of the coupler 1816. When the precast panel 1800 shown in FIG. 18B is precast or formed, the couplers 1816 are disposed along a lateral (side 714 to side 716) axis of the panel 1800 relative to a predetermined floor slab level and encased in the cementitious material 708 of the precast panel 1800. Before or after the precast panel 1800 is set in place to form the precast wall system 100 of the building, another horizontal end bar 1824 may be inserted or threaded in the socket 1820 of each coupler 1816 of the panel 1800. Once each horizontal bar 1824 is engaged in a respective coupler socket 1820, concrete or other cementitious material may be poured over the metal deck or web 1810 and the horizontal bars 1824 to form the floor slab 1812 and to encase the horizontal bars 1824 in the floor slab 1812, connecting the floor slab 1812 to the panel 1800.

Figure 18C:
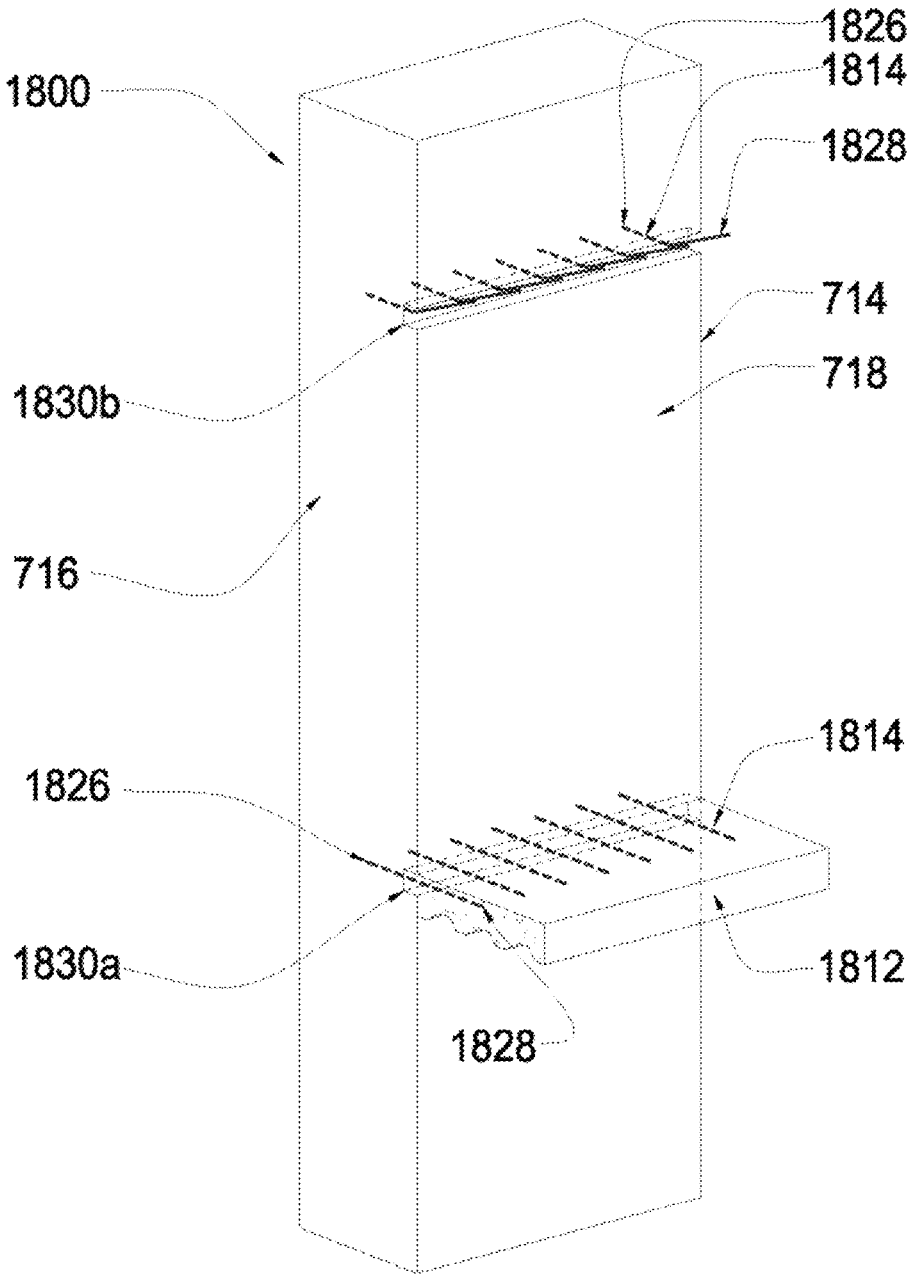
FIG. 18C is a perspective view of another embodiment of the precast panel in FIG. 18A, illustrating another implementation for connecting a floor slab (that is composed of concrete topping on metal deck) to the precast panel.

In an alternative implementation for a floor slab-to-panel connection shown in FIG. 18C, the horizontal bars 1814 of the precast panel 1800 are not connected to a respective coupler 1816. Instead, each horizontal bar 1814 has one end 1826 encased in the cementitious material 708 of the precast panel 1800 and another end 1828 that extends though a trench 1830 running in a lateral axis (e.g., side 714 to side 716) of the panel 1800 and extending beyond the front side 718 of the panel. The trench 1830 has a depth sufficient to enable the end 1828 of each of the horizontal bars 1814 to be bent within the trench 1830 towards the right side 714 or the left side 716 of the panel 1800 such that the portion of each horizontal bars 1814 that extends beyond the front side 718 of the panel 1800 before bending are disposed within the trench or extend to the right or left sides 714 and 716 of the panel as shown in FIG. 18C. After the precast panel 1800 is set in place to form the precast wall system 100 of the building, each of the horizontal bars 1814 may be bent back or straightened so that the end 1828 extends beyond the front side 718 of the panel 1800 in a plane corresponding to the plane of the floor slab 1812 to be formed. In this implementation, concrete or other cementitious material may then be poured over the metal deck or web 1810 (or other temporary or permanent forms for a floor slab) and the portion of the horizontal bars 1814 extending beyond the trench 1830 to form the floor slab 1812 and to encase the portion of the horizontal bars 1814 extending beyond the trench 1830 in the floor slab 1812, connecting the floor slab 1812 to the panel 1800.

Figure 18E:
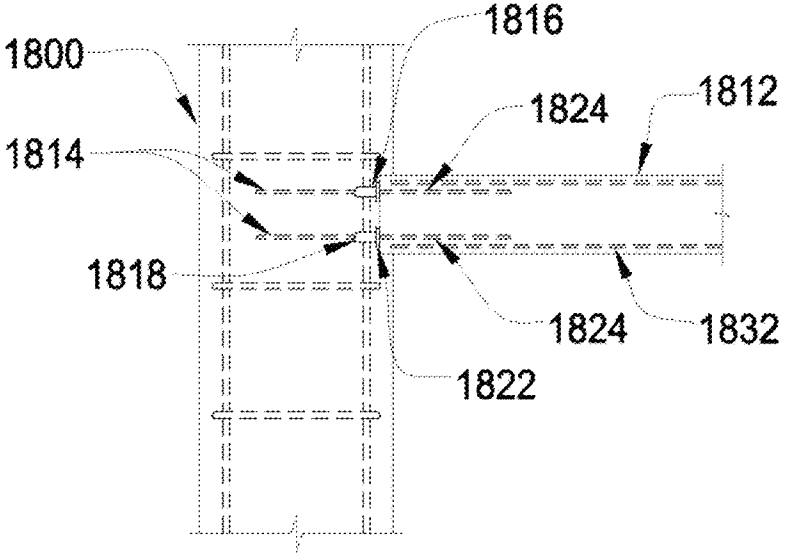
FIG. 18E is a vertical cross-sectional view of the precast panel in FIG. 18D, illustrating the connection of the floor slab to the precast panel.
Figure 18D:
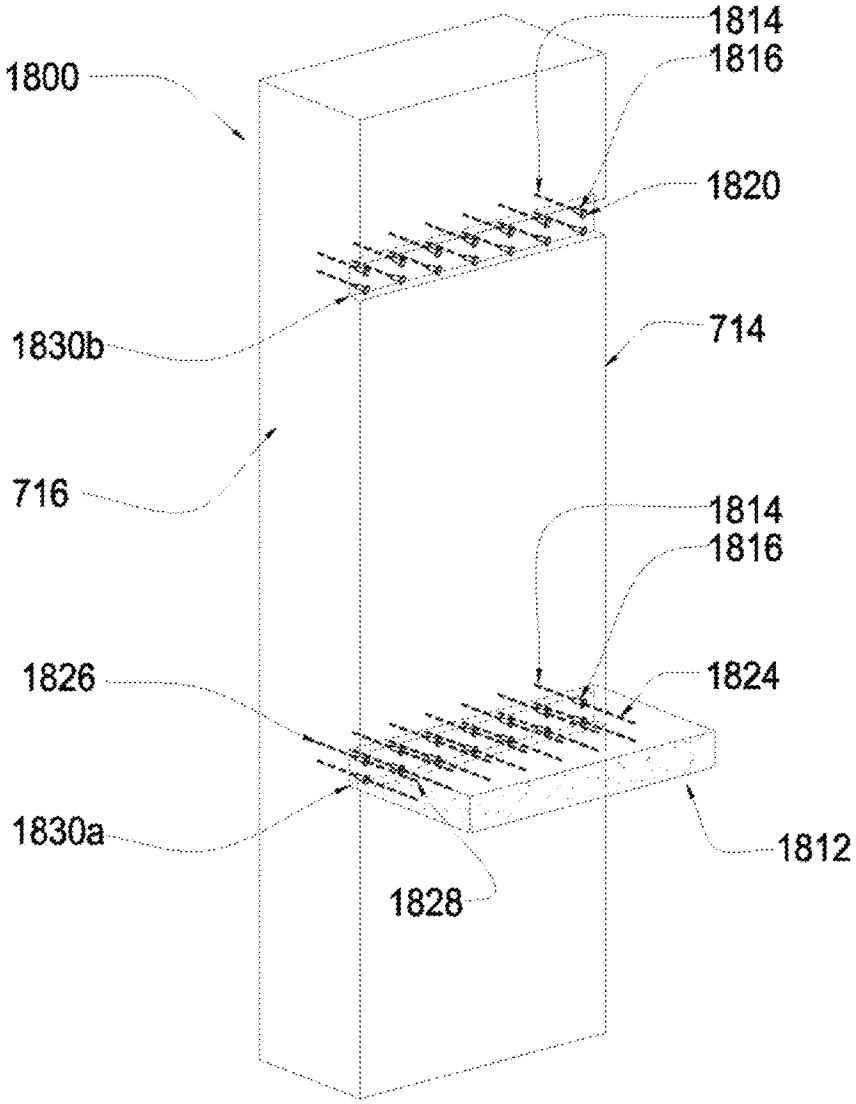
FIG. 18D is a perspective view of another embodiment of a precast panel consistent with the present invention, illustrating another implementation for connecting a floor slab that is not composed of concrete topping on metal deck to the precast panel.
Figure 18F:
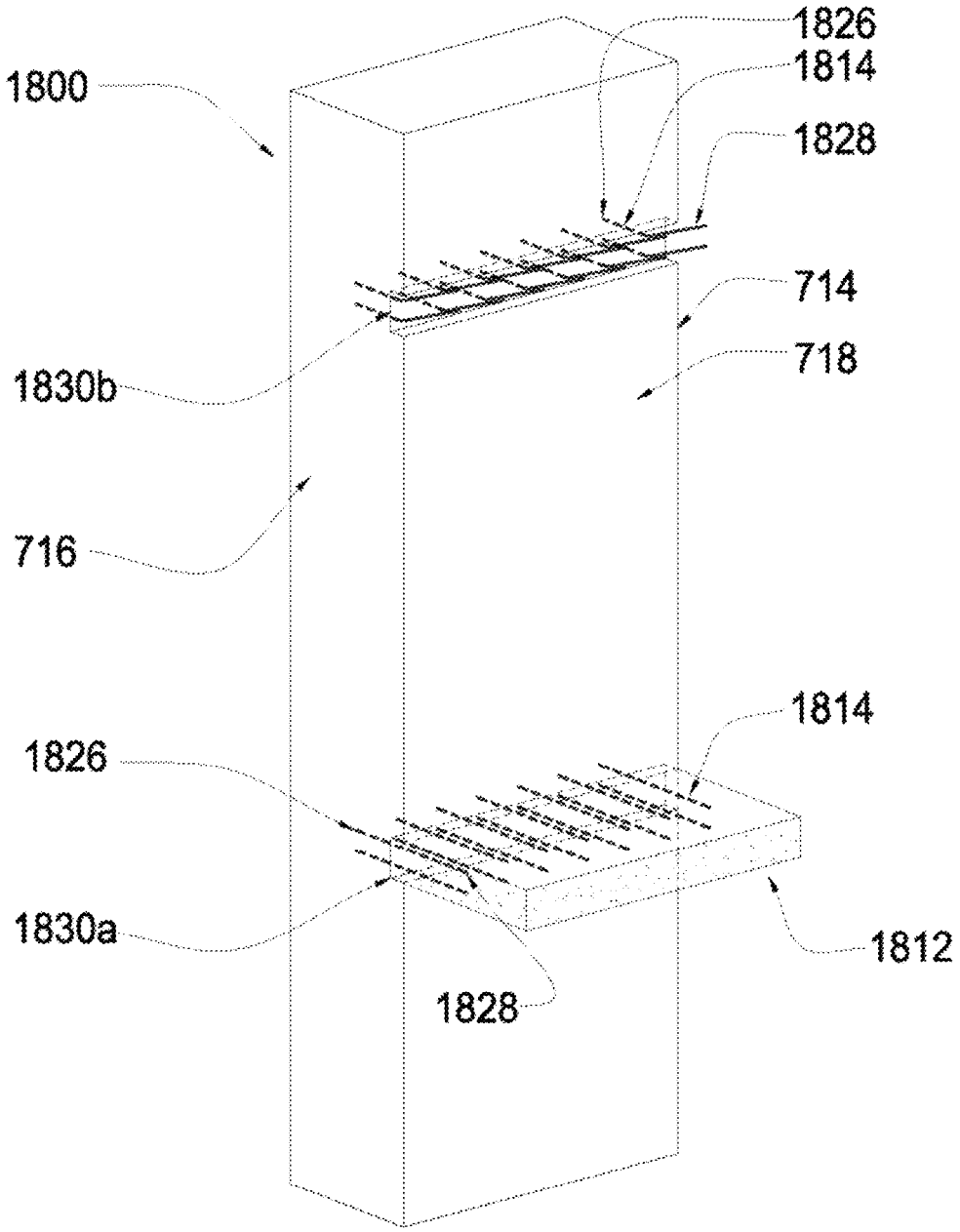
FIG. 18F is a perspective view of another embodiment of a precast panel consistent with the present invention, illustrating another implementation for connecting a floor slab that is not composed of concrete topping on metal deck to the precast panel

FIG. 18D is a perspective view and FIG. 18E is a vertical cross-section view of another embodiment of the precast panel 1800 consistent with the present invention, illustrating another implementation for connecting a floor slab that is not disposed over a floor beam or metal deck to the precast panel. The implementation shown in FIGS. 18D and 18E, the panel 1800 combines the trench 1830 feature with the horizontal bar 1814 and coupler 1816 feature to form a floor slab connection without the support of a lower floor beam. In this implementation, the panel 1800 has a trench 1830*a* and 1830*b* running in a lateral axis (e.g., side 714 to side 716) of the panel 1800 for each floor slab 1812 to be connected to the panel 1800. The precast panel 1800 in this implementation is precast to include a plurality of horizontal bars 1814 that are encased in the panel 1800 (in two rows in FIGS. 18D-18E) along each trench 1830*a* and 1830*b*. Each horizontal bar 1814 is attached to one end 1818 of a respective Type I or Type II coupler 1816 that has a socket 1820 at the other end 1822 of the coupler 1816 as shown in FIG. 18E. When the precast panel 1800 shown in FIGS. 18D and 18E is precast or formed, the couplers 1816 are disposed along to be flush with a bottom side of the respective trench 1830*a* or 1830*b*. Before or after the precast panel 1800 is set in place to form the precast wall system 100 of the building, another horizontal end bar 1824 may be inserted or threaded in the socket 1820 of each coupler 1816 of the panel 1800. As previously noted, once each horizontal bar 1824 is engaged in a respective coupler socket 1820, concrete or other cementitious material may be poured over the metal deck or web 1810 or other form supports for forming the floor slab 1812 within the respective trench 1830*a* or 1830*b*, connecting the floor slab 1812 to the panel 1800. Each floor slab 1812 may be formed with rebar or other reinforcement bars 1832.

Figure 19B:
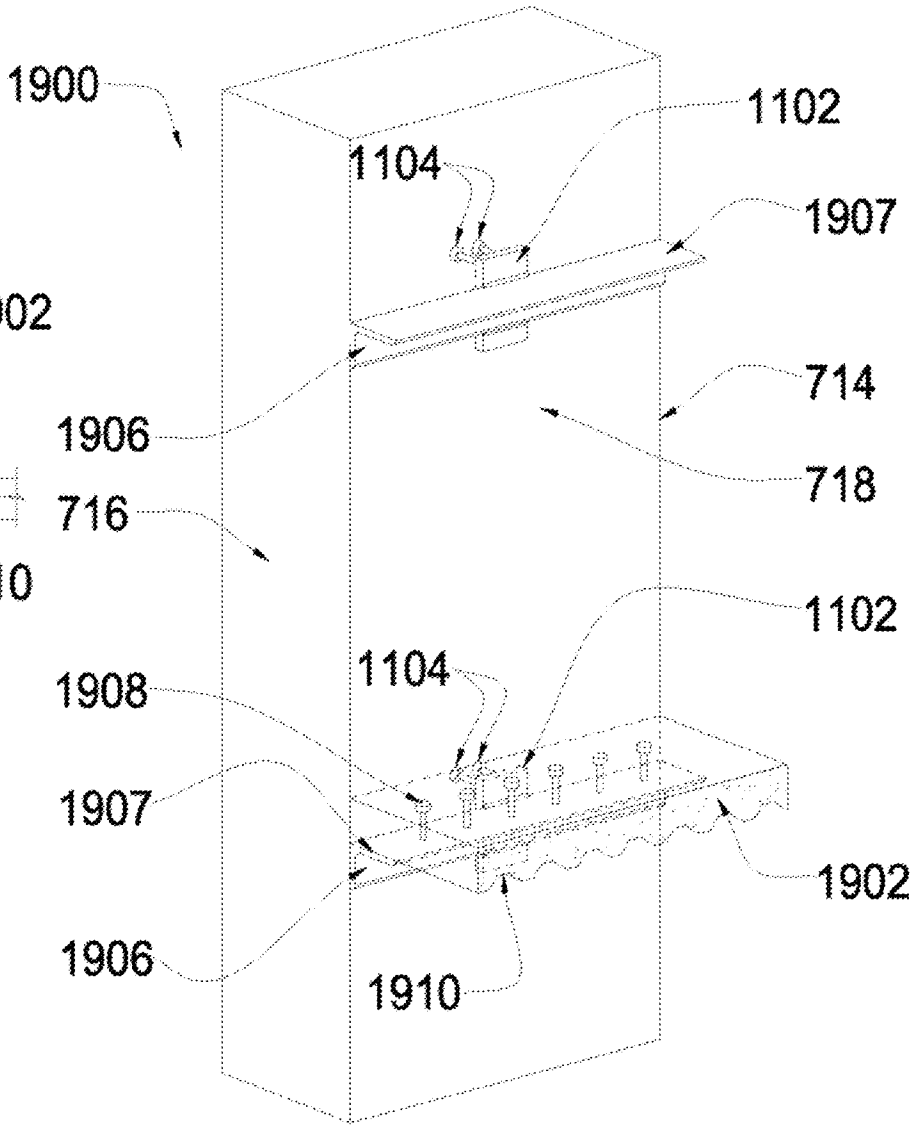
FIG. 19B is a perspective view of the precast panel in FIG. 19A, illustrating the connection of the floor slab to the precast panel.
Figure 19A:
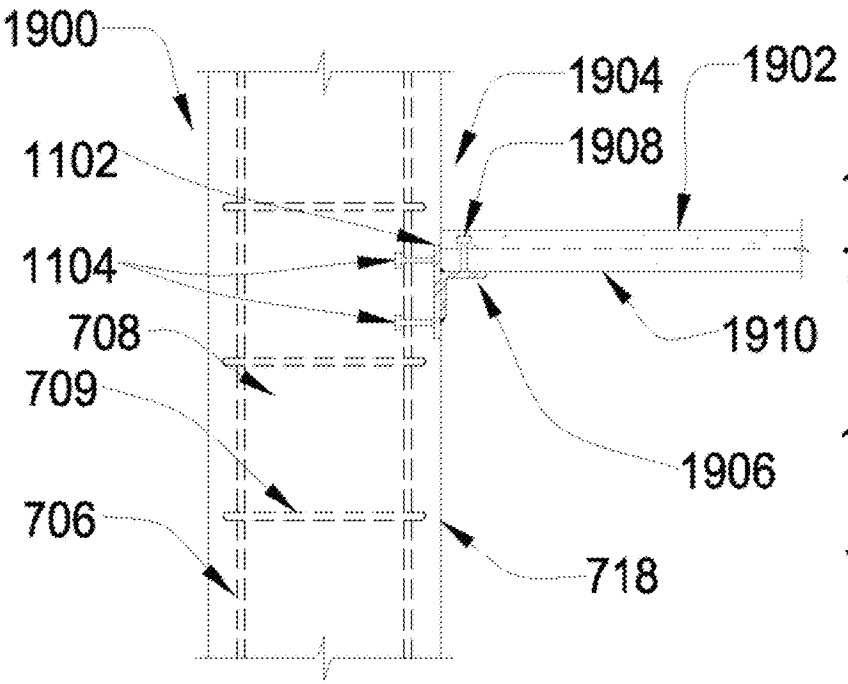
FIG. 19A is a vertical cross-sectional view of the portion of an exemplary precast panel, illustrating one implementation for connecting a floor slab that is not disposed over a floor beam to the precast panel.

FIG. 19A is a vertical cross-sectional view of the portion of another exemplary precast panel 1900, illustrating another implementation for connecting the precast panel 1900 to a floor slab 1902 that is not disposed over a floor beam. FIG. 19B is a perspective view of the precast panel 1900 and the floor slab-to-panel connection 1904 between the floor slab 1902 and the precast panel 1900. The precast panel 1900 is representative of an interior panel 102, a corner panel 104, and an opening panel 106, 108 or 110 that may be required to support a floor slab. As shown in FIGS. 19A and 19B, the precast panel 1900 may include one or more plates 1102 embedded on the front side 718 of the panel 1900 for implementing a respective floor slab-to-panel connection rather than a beam-to-panel connection. Each embedded plate 1102 may have one or more shear studs 1104 extending into and embedded in the cementitious material 708 of the precast panel 1900. As previously noted, each embedded plate 1102 as employed in a precast panel 1900 (or other precast panel embodiment 102, 104, 106, 108 or 110) is adapted to transfer shear forces as well as tension or other forces that may be imposed on the respective panel to another precast panel interconnected via the embedded plate 1102.

In the implementation shown in FIGS. 19A and 19B, a bracket or L-shaped angle 1906 is affixed to each embedded plate 1102 such that a shelf 1907 defined by the bracket or angle 1906 is disposed parallel to a lateral (or side 714 to side 716) axis of the panel 1900. A metal deck or web 1910 may then be disposed on the shelf 1907 of the panel 1900 as well as the shelf 1907 or beam 1804 connected to other panels 1900 or 1800 of the group 112*a*, 112*b* or 112*c* of precast panels 102, 104, 106, 108 or 110 that are horizontally interconnected to form a floor of the stories of the building defined by the respective group 112*a*, 112*b* or 112*c* of precast panels. One or more headed shear studs 1908 may be welded or otherwise attached to the bracket or angle 1902 through the metal deck or web 1910 so that each shear stud 1908 extends from the shelf 1907 of the bracket or angle 1906. A floor slab 1902 may then be formed (e.g., using concrete or another cementitious material) over the the metal deck 1910 and the shear studs 1908 of the bracket or angle 1906 supporting the metal deck 1910.

Figure 19D:
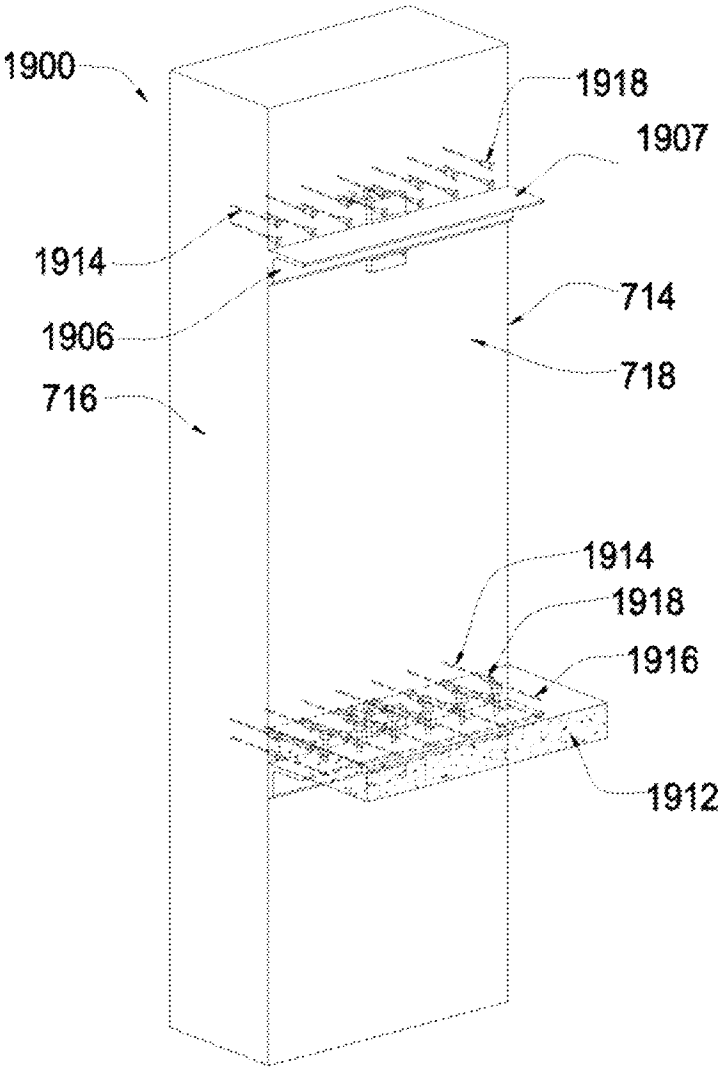
FIG. 19D is a perspective view of the precast panel in FIG. 19C, illustrating the connection of the floor slab to the precast panel.
Figure 19C:
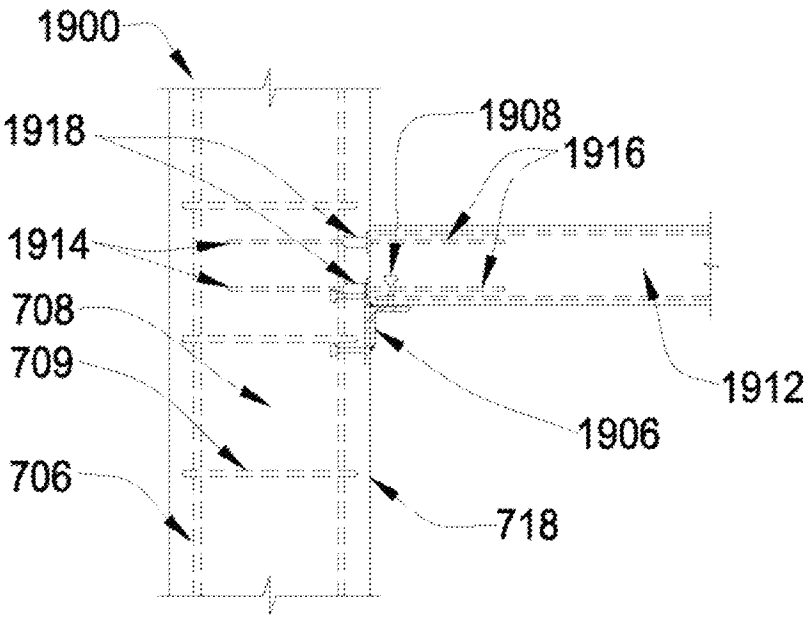
FIG. 19C is a vertical cross-sectional view of the portion of an exemplary precast panel, illustrating one implementation for connecting a floor slab that is not disposed over a floor beam to the precast panel.

In another embodiment consistent with the present invention, the metal deck or web 1910 is replaced with a solid concrete slab 1912 as depicted in FIGS. 19C and 19D. Consistent with this embodiment, metal rebar 1914 may be embedded in the precast panel 1900 and may connected to at least one horizontal threaded tie bar 1916 embedding in the solid concrete floor slab 1912 via a coupler 1918.

Figure 20A:
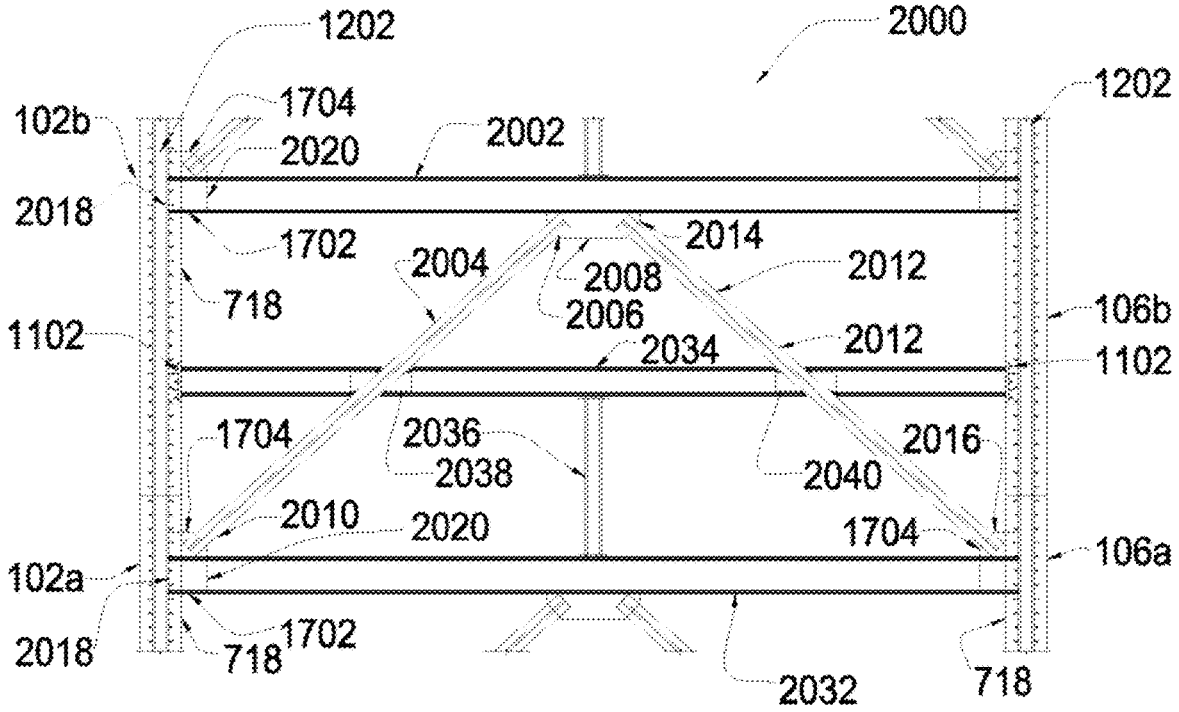
FIG. 20A depicts an exemplary support frame that may be employed between and connecting opposing precast panels in the precast wall system of FIG. 1 in accordance with the present invention.
Figure 20B:
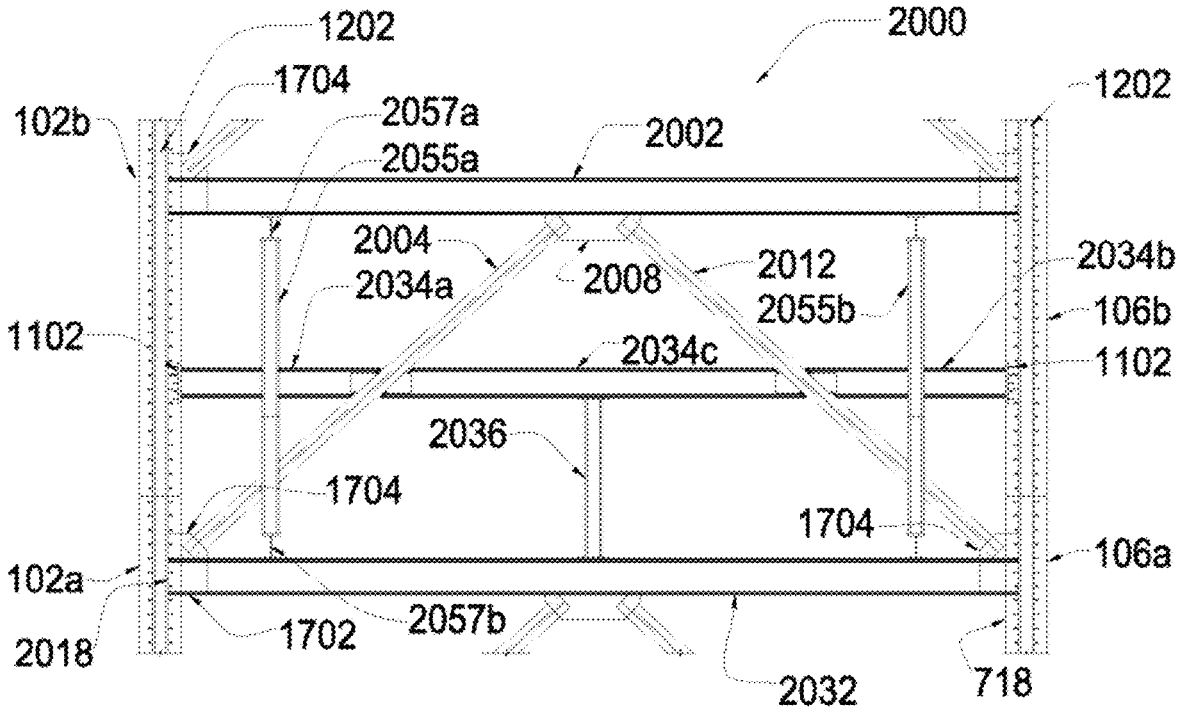
FIG. 20B depicts one embodiment of the support frame of FIG. 20A in which temporary posts are employed to support the support frame when attached to a foundation, foundation wall, or previously erected precast tier before a first or next level of the precast panels is erected to form the precast wall system.

Turning to FIG. 20A, an exemplary support frame 2000 is depicted that may be employed between and connecting opposing precast panels 102, 104, 106, 108 or 110 in the precast wall system 100 in accordance with the present invention. FIG. 20B depicts one embodiment of the support frame 2000 in which temporary posts 2055*a* and 2055*b* are employed to support the support frame 2000 when attached to a foundation 50 or foundation wall 60 before a first of the precast panels in the first tier 112*a* is erected to form the precast wall system 100.

In the implementation shown in FIGS. 20A and 20B, when erected in the precast wall system 100, the support frame 2000 is used as the permanent core floor framing. The exemplary support frame 2000 is representative of one embodiment of the support frames 112*a*, 112*b*, or 112*c* that may be employed to brace opposing precast panels 102, 104, 106, 108 or 110. Each support frame 2000 is disposed between and attached to a respective first pair of vertically interconnected precast panels and a second pair of vertically interconnected precast panels that are disposed opposite to the first pair in the precast wall system 100. For example, referring to FIG. 6, the first pair of vertically interconnected precast panels may correspond to the first pair of vertically interconnected interior panels 102*a* and 102*b*, where the interior panel 102*a* is one of the first group 112*a* of horizontally connected precast panels 102, 104, 106, 108 and 110 and the interior panel 102*b* is one of the second group 112*b* of horizontally connected precast panels 102, 104, 106, 108 and 110 employed in the precast wall system 100. In this example, the second pair of vertically interconnected precast panels may be a pair of vertically interconnected opening panels 106*a* and 106*b* that disposed opposite to the first pair of vertically interconnected interior panels 102*a* and 102*b* of the precast walls system as reflected in FIGS. 1 and 6. However, the first pair of precast panels 102*a* and 102*b* and the second pair of precast panels 106*a* and 106*b* may be any vertical pair combination and opposing vertical pair combination of the precast panels 102, 104, 106, 108 and 110 of the precast wall system 100, where the vertical pair of precast panels are formed to have connections to the support frame 2000 as described herein.

As depicted in FIGS. 6, 17, 20A and 20B, each support frame 2000 includes one or more cross beams 2002, 2032, and 2034 that provide bracing support for opposing walls of a tier of precast panels to be erected as well as function as floor framing when installed in the precast wall system 100. In the implementation shown in the figures, each precast wall panel (e.g., panels 102*b* and 106*b*) is connected to two cross beams (e.g., 2002 and 2034) to provide floor framing for two respective levels or floors of the precast wall system 100 and the building erected using the precast wall system 100. However, without deviating from the scope of the invention, each precast wall panel 102*b* and 106*b* may be precast to be connected to one respective cross beam (e.g., to provide floor framing corresponding to one floor of a single story precast wall system 100 and building).

Figure 21:
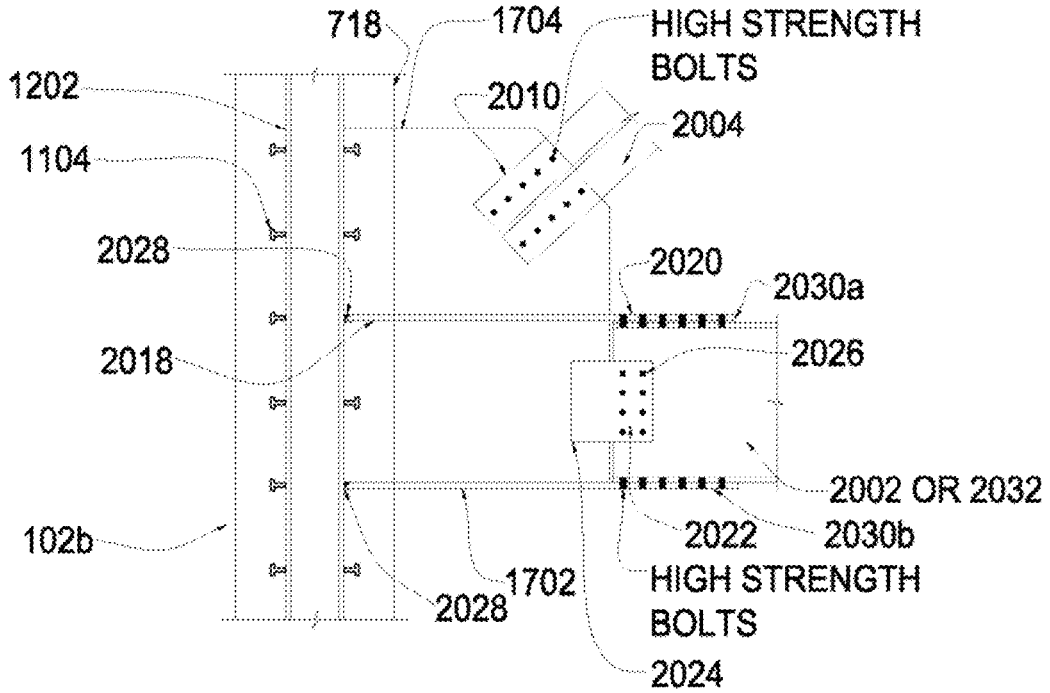
FIG. 21 depicts one implementation for connecting a diagonal brace of the support frame to an embedded gusset plate of one of the opposing precast panels in the precast wall system of FIG. 1.

In the implementation shown in FIGS. 20A and 20B, the cross beam 2032 may be erected or installed first and may be connected to the opposing foundation walls 60 or previously erected opposing precast panels (e.g., lower precast panels 102*a* and 106*a* in FIGS. 20A and 20B) of a first tier 112*a* of the precast wall system 100. Although support frame connections to opposing lower precast panels 102*a* and 106*a* are shown in FIGS. 20A and 20B, opposing foundation walls 60 may be formed in accordance with the present invention to have the same support frame connections. Thus, opposing foundation walls 60 or each of the lower one (e.g., 102*a* and 106*a*) of the opposing pairs of vertically interconnected precast panels (e.g., 102*a* & 102*b* and 106*a* & 106*b*) includes a beam segment 1702 having a first end 2018 encased in the cementitious material 708 of the respective panel 102*b* or 106*b* (or foundation wall 60) and a second end 2020 extending from an internal or front side 718 of the respective panel 102*b* or 106*b* (or foundation wall 60). The cross beam 2032 is connected to the beam segment 1702 of each of opposing lower precast panels 102*a* and 106*a* (or opposing foundation walls 60). As shown in FIG. 21, the end segment 1702 of each precast panel 102*a* and 106*b* may be affixed to the cross beam 2032 via a web splice plate 2022 that may affixed to the respective end segment 1702 and the cross beam 2032 via a high strength weld 2024 or high strength bolts 2026 or rivets, or a combination thereof. In one implementation, the connecting end 2020 of the respective end segment 1702 has two flanges 2030*a* and 2030*b* that define an opening through which a respective end of the cross beam 2032 may be inserted. In this implementation, each flange 2030*a* and 2030*b* may be bolted or welded to the respective end of the cross beam 2032 to provide additional reinforcement to the connection between the beam segment 1702 and the cross beam 2032.

In addition, in one implementation as shown in FIG. 21, each precast panel 102*a*, 102*b*, 106*a* and 106*b* that has a beam segment 1702 for connecting to a support frame 2000 may also include a support member or column 1202 centrally and vertically encased in the cementitious material 708 of the respective precast panel. In this implementation, the embedded end 2018 of the beam segment 1702 may be affixed to the support member or column 1202 via a high strength weld 2028 or bolts (not shown in FIG. 21) to provide further strength to the beam-to-panel connection formed using the embedded beam segment 1702.

Figure 20C:
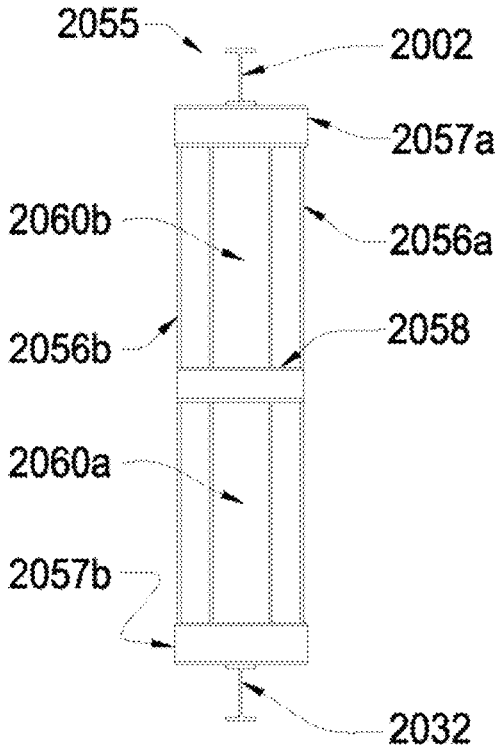
FIG. 20C depicts one embodiment of one of the temporary posts employed in support the support frame in FIG. 20B.

As shown in FIG. 20B, the support frame 2000 may include one or more removable temporary posts 2055*a* and 2055*b* or false works that are used to aid in the erection of the one or more cross beams 2002 and 2034, which will then be connected between the opposing upper precast panels 102*b* and 106*b* as each of these panels are erected. As shown in FIG. 20C, each temporary post 2055*a* and 2055*b* may include two inner posts 2056*a* and 2056*b* each having a top and a bottom, a top cross member 2057*a* removably attached to the top of each inner post 2056*a* and 2056*b*, and a bottom cross member 2057*b* removably attached to the bottom of each inner post 2056*a* and 2056*b*. The cross members 2057*a* and 2057*b* may be removably attached to the inner posts 2056*a* and 2056*b* via bolts (not shown in the figures) or other removable fasteners standard to the construction industry. In one implementation, the inner posts 2056*a* and 2056*b* and the top cross member 2057*a* and bottom cross member 2057*b* define a space 2060*a* to enable the passage of a brace member 2004 or 2012 of the support frame 2000 through the respective temporary post 2055*a* or 2055*b* as further described herein. Each temporary post 2055*a* or 2055*b* may also have 2058 an intermediate cross member 2058*a* removably attached to and disposed between (or external to) the inner posts 2056*a* and 2056*b* at the elevation of the underside of the beam 2034 so that the intermediate cross member 2058 may be used to aid in the positioning and temporary support of a portion of beam 2034 (e.g., beam segment 2034*a*). The inner posts 2056*a* and 2056*b*, the top cross member 2057*a* and the intermediate cross member 2058 define an upper space 2060*b* to enable the passage of a portion of beam 2034 (e.g., beam segment 2034*a*). In this implementation in which each temporary post 2055*a* and 2055*b* includes an intermediate cross member 2058 as shown in FIG. 20C, the inner posts 2056*a* and 2056*b*, the bottom cross member 2057*b* and the intermediate cross member 2058 define a lower space 2060*a* to enable the passage of a brace member 2004 or 2012 of the support frame 2000 through the respective temporary post 2055*a* or 2055*b*.

As shown in FIGS. 20B and 20C, one of the temporary posts 2055*a* may be erected and positioned at one end of beam 2032. Another temporary post 2055*b* may then be erected on the opposite end of beam 2032. Each of the temporary posts 2055*a* and 2055*b* are oriented on the beam 2032 interconnected between the lower precast panels 102*a* and 106*a* so that the opening or spaces 2060*a* and 2060*b* between the inner posts 2056*a* and 2056*b* of each of the temporary posts 2055*a* and 2055*b* are axially aligned with the beam 2032 and with the beam 2034 to be interconnected between the upper precast panels 102*b* and 106*b* as further described below. Once the temporary posts 2055*a* and 2055*b* are oriented on the beam 2032, the beam 2002 may be erected and supported on top of the temporary posts 2055*a* and 2055*b*.

To provide additional support and stiffening to the support frame 2000 and, in particular, to the cross beams 2002 and 2034 to be connected between the opposing upper precast panels 102*b* and 106*b*, the support frame 2000 may include one or more diagonal brace members 2004 and 2012. In this implementation, each of the lower precast panels 102*a* and 106*a* (or opposing foundation walls 60) has a gusset plate 1704 extending from an internal or front side 718 of the respective lower precast panel (or foundation wall 60). The lower end of each brace member 2004 and 2012 is inserted through the space 2060*a* between the inner posts 2056*a* and 2056*b* of a respective temporary post 2055*a* or 2055*b* and then connected to the gusset plate 1704 of a respective one of the lower precast panels 102*a* and 106*a* (or opposing foundation walls 60). The top end of each brace member 2004 and 2012 is connected to a gusset plate 2008 that is affixed to and extends from the cross beam 2002 as shown in FIGS. 20A and 20B. The gusset plate 1704 of each of the lower precast panels 102*a* and 106*a* may be supported by or rest on (and be welded to) the beam segment 1702 of the respective lower precast panel 102*a* or 106*a* to connect to the diagonal brace member 2004 or 2012.

In the implementation shown in FIGS. 20A and 20B, the beam 2034 comprises beam sections 2034*a*, 2034*b* and 2034*c*, which are interconnected via splicing plates 2038 and 2040 so that the diagonal brace members 2004 and 2012 pass diagonally through the beam 2034. The first beam section 2034*a* may be inserted through the space 2060*b* between the inner posts 2056*a* and 2056*b* of the temporary post 2055*a* and supported on the intermediate cross member 2058 of the same temporary post 2055*a*. Similarly, the third beam section 2034*c* may be inserted through the space 2060*b* between the inner posts 2056*a* and 2056*b* of the temporary post 2055*b* and supported on the intermediate cross member 2058 of the same temporary post 2055*b*. In one implementation, to connect the second beam section 2034*b* to the first beam section 2034*a*, a splicing plate 2038 may be affixed to and between facing ends of the first beam section 2034*a* and the second beam section 2034*b* so that the brace member 2004 passes between the first and second beam sections 2034*a* and 2034*b*. Similarly, to connect the second beam section 2034*b* to the third beam section 2034*c*, a splicing plate 2040 may be affixed to and between facing ends of the second beam section 2034*b* and the third beam section 2034*c* so that the brace member 2012 passes between the second and third beam sections 2034*b* and 2034*c*. In the implementation shown in FIGS. 20A and 20B, each splicing plate 2038 and 2040 is affixed to a web portion of the ends of the beam sections 2034*a* and 2034*b* or 2034*b* and 2034*c* such that the brace member 2004 or 2012 (which is offset from the center or web axis of the beam 2034 by at least the width of the gusset plate 1704 to which the brace member 2004 or 2012 is affixed) passes along side the respective splicing plate 2038 or 2040. The splicing plates 2038 and 2040 may be affixed to respective beam sections 2034*a*, 2034*b* and 2034*c* via mild or high strength bolts and/or welds (not shown in FIG. 20A or 20B).

To support a floor slab on the cross beam 2034 and to effectively reduce the span of the cross beam 2034, the support frame 2000 may also include a column 2036 connected (e.g., via welding or bolting) between the cross beam 2034 and the lower cross beam 2032 as shown in FIG. 20A. Optional column 2036 may also be used to assist in the erection of beam section 2034*c*.

Figure 20D:
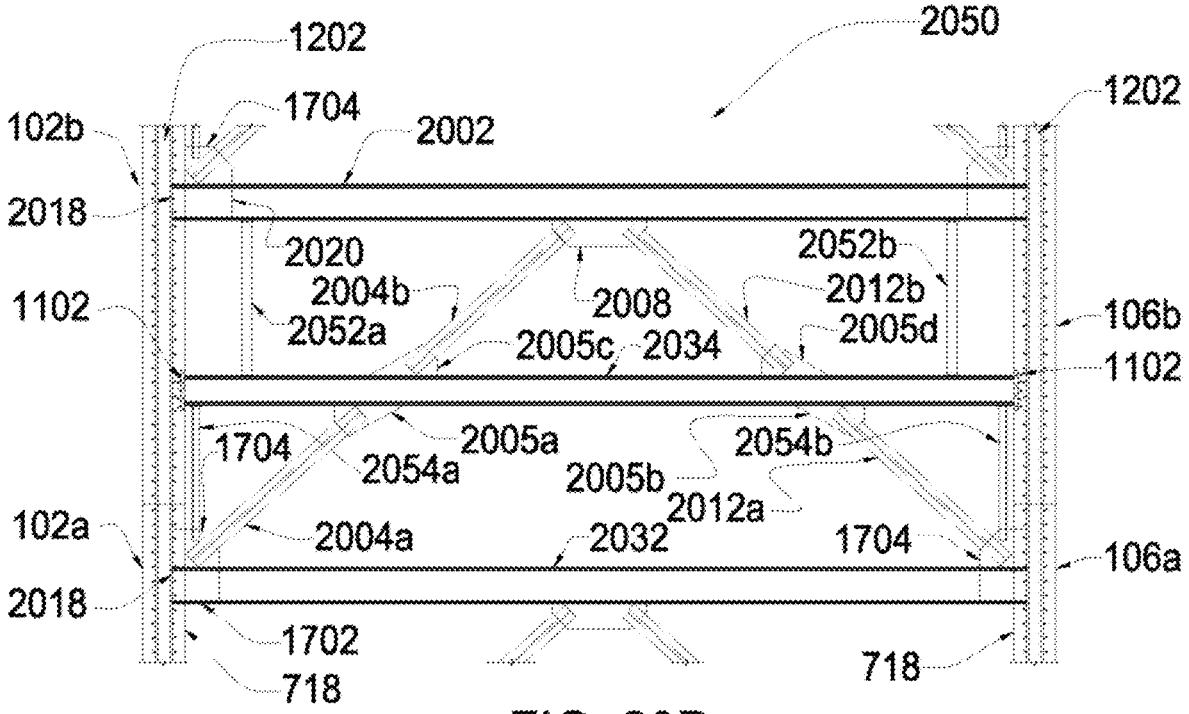
FIG. 20D depicts another exemplary support frame that may be employed between and connecting opposing precast panels in the precast wall system of FIG. 1 in accordance with the present invention, where another embodiment of temporary posts are used to support the support frame when attached to a foundation, foundation wall, or previously erected precast tier before a first or next level of the precast panels is erected to form the precast wall system.

FIG. 20D depicts another exemplary support frame 2050 that may be employed between and connecting opposing precast panels (102*a* & 102*b* and 106*a* & 106*b*) in the precast wall system 100 in accordance with the present invention. Except as described below, the support frame 2050 has components (such as cross beams 2002, 2032, and 2034 and brace members 2004 and 2012) that are erected consistent with the support frame 2000. However, in the implementation shown in FIG. 20D, instead of temporary posts 2055 extending between cross beams 2002 and 2032, the support frame 2050 includes one or more removable or temporary posts 2054*a* and 2054*b* mounted between the cross beam 2032 and the next higher cross beam 2034 to be connected between the opposing upper precast panels 102*b* and 106*b*. In this implementation, the diagonal brace members 2004 and 2012 are each comprised of brace member sections 2004*a*, 2004*b* and 2012*a*, 2012*b*. The lower end of each brace member 2004*a* and 2012*a* is connected to the gusset plate 1704 of a respective one of the lower precast panels 102*a* and 106*a* (or opposing foundation walls 60). The top end of each brace member 2004*a* and 2012*a* is connected to another respective gusset plate 2005*a* or 2005*b* that is affixed to and extending from the cross beam 2034 as shown in FIG. 20D.

After the cross beam 2034 is braced to the lower cross beam 2032 using the temporary posts 2054*a* and 2054*b* and/or brace members 2004*a* and 2012*a*, one or more temporary posts 2052*a* and 2052*b* may be mounted between the cross beam 2034 and the next higher cross beam 2002 to be connected between the opposing upper precast panels 102*b* and 106*b* to be erected as shown in FIG. 20D. To provide additional support and stiffening to the support frame 2050 (and, in particular, to the cross beam 2002 to be connected between the opposing upper precast panels 102*b* and 106*b*), the lower end of each brace member 2004*b* and 2012*b* is connected to a respective gusset plate 2005*c* or 2005*d* that is affixed to and extending from the cross beam 2034 as shown in FIG. 20D. The top end of each brace member 2004*b* and 2012*b* is connected to the cross beam 2002, via the gusset plate 2008 attached to the cross beam 2002 at a center portion thereof.

As shown in FIGS. 1 and 5, multiple support frames 120, 122 and 124 (consistent with frames 2000 or 2050) may be constructed and arranged in a parallel manner across respective pairs of opposing precast panels of the first or current tier of the precast wall system 100. The support frames 120, 122, and 124 may have interconnecting members (not numbered in FIGS. 1 and 5). Once the members of each support frame 120, 122 and 124 are erected, plumbed and bolted, opposing pairs of precast panels 102*b* and 106*b* in the next tier may be erected to connect to a respective support frame 120, 122, or 124.

In the example shown in FIGS. 20A and 20D, the cross beam 2034 of the respective support frame 2000 or 2050 is connected to a shear plate 1102 embedded in the internal or front side 718 of the higher one 102*b* of the first pair of precast panels 102*a* and 102*b* and to a shear plate 1102 embedded in the internal or front side 718 of the higher one 106*b* of the second pair of precast panels 106*a* and 106*b*. The beam-to-panel connection 608 that may be employed to connect the cross beam 2034 to the respective precast panels 102*b* and 106*b* may correspond to the beam-to-panel connection described in reference to FIG. 18A. In particular, as shown in FIG. 18A, a shear tab 1802 may be affixed (via a high-strength weld or other bond) to the embedded shear plate 1102 of the precast panel 102*b* and 106*b* so that the shear tab 1802 is orthogonal to the front side 718 of the precast panel 102*b* and 106*b*. The shear tab 1802 may be affixed or welded to the beam 2034. In another implementation, the shear tab 1802 may have one or more bolt openings 1806 for bolting (via high-strength bolts) the shear tab 1802 to the end of the cross beam 2034.

The cross beam 2002 of the respective support frame 2000 or 2050 is connected (e.g., in the same manner as described for cross beam 2032) to a beam segment 1702 embedded in the upper one 102*b* of the first pair of precast panels 102*a* and 102*b* and a beam segment 1702 embedded in the upper one 106*b* of the second pair of precast panels 106*a* and 106*b*.

Once the precast panels (e.g., panels 102*b* and 106*b* in FIG. 20B or FIG. 20D) for the current tier (e.g., group 112*b*) of the precast wall system 100 are vertically connected to respective lower tier panels (e.g., panels 102*a* and 106*a* of group 112*a*) and horizontally connected to respective adjacent panels in the same tier (e.g., group 112*b*), the temporary posts 2055*a* and 2055*b* of the support frame 2000 and the temporary 2052*a*, 2052*b*, 2054*a* and 2054*b* of the support frame 2050 may be removed as shown in FIG. 20A and used for erection of the next tier of support frames 120, 122, and 124. The column 2036 may remain as part of the support structure 2000 and 2050 and the bracing system 118 to support the span of beam 2034 for floor framing. Cross beams 2032, 2034 (including splicing plates 2038 and 2040 in support frame 2000) and 2002 also remain as permanent framing members for the bracing system 118 to support the core floor decking and concrete slab.

The support frame 2000 and 2050 as described provides bracing support for the first group 112*a* of panels horizontally interconnected to the opposing lower precast panels 102*a* and 106*a* and to the second group 112*b* of panels that are or are being set in place to be interconnected to the opposing higher precast panels 102*b* and 106*b* that are vertically interconnected to the lower precast panels 102*a* and 106*a*.

As depicted in FIG. 1, each support frame 120, 122 and 124 (constructed consistent with support frame 2000 or 2050) may be expanded or vertically interconnected to another similarly formed support frame 2000 or 2050 to continue to construct or erect the precast wall system 100 for the building. The next or other support frame 2000 or 2050 would similarly support opposing pairs of precast panels that include the opposing higher precast panels 102*b* and 106*b* and the next opposing higher precast panels (e.g., 102*c* and 106*c*) that are vertically connected to the precast panels 102 and 106*b*.

Figure 22A:
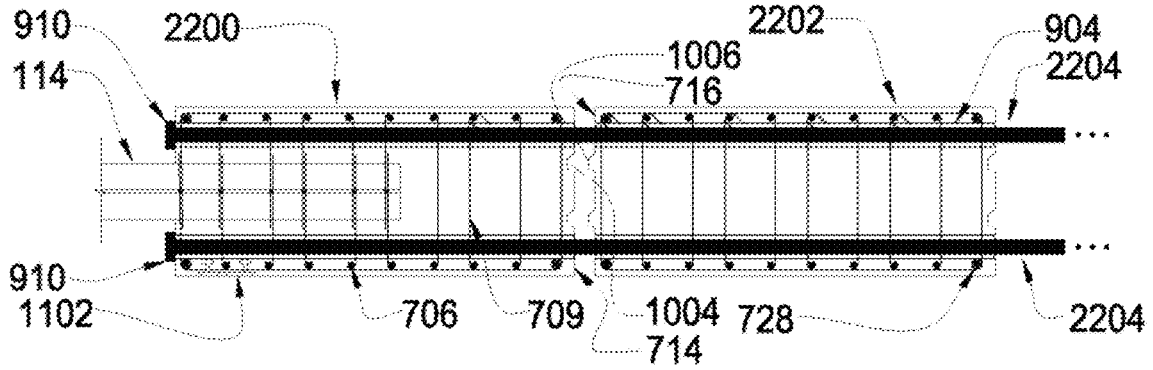
FIG. 22A is a horizontal cross-sectional view of another two exemplary precast panels that may be employed to construct the precast wall system of FIG. 1 in accordance with the present invention, where the precast panels each has a side and shear keys disposed or formed on the side of the respective panel for horizontally mating or aligning the panel to another precast panel, and in combination with a horizontal reinforcing bar resists large horizontal shear forces perpendicular to the plane of the wall defined by the two precast panels.

FIG. 22A depicts a horizontal cross-sectional view of another two exemplary precast panels 2200 and 2202 that may be employed to construct the precast wall system 100 in accordance with the present invention. Similar to precast panels 1000 and 1002 depicted in FIG. 10, the precast panels 2200 and 2202 each has a side 714 or 716 and one or more shear keys 1004 or 1006 disposed or formed on the side of the respective panel for horizontally mating or aligning the respective panel 2200 and 2202 to the other precast panel 2202 and 2200. The second shear key or key set 1006 is formed to complementary mate the first shear key or key set 1004 such that the one or more horizontal ducts 904 of the first panel 2200 are each axially aligned with the corresponding one or more horizontal ducts 904 of the second panel 2202 when the first shear key or key set 1004 is mated to the second shear key or key set 1006. In this implementation of a horizontal panel-to-panel connection 602, the precast wall system 100 includes one or more post-tensioned horizontal reinforcing bars 2204 disposed in the respective ducts 904 with a bar anchor 910 attached to each end of the respective horizontal reinforcing bar 2204. The combination of friction (due to the compressive clamping stress of the post-tensioned horizontal reinforcing bars 2204) and the shear keys 1004 and 1006 enables the transfer of horizontal shear forces between the two precast panels 2200 and 2202 such that the panels are able to resist large horizontal shear forces perpendicular to the plane of the wall defined by the precast panels 2200 and 2202, for example due to blast loading. In addition, the combination of the post-tensioned horizontal reinforcing bars 2204 and shear keys 1004 and 1006 enables the precast panels 2200 and 2202 to inhibit the passage of flame or hot gases through the shear key joint 2206 between the two panels 2200 and 2202.

Figure 22B:
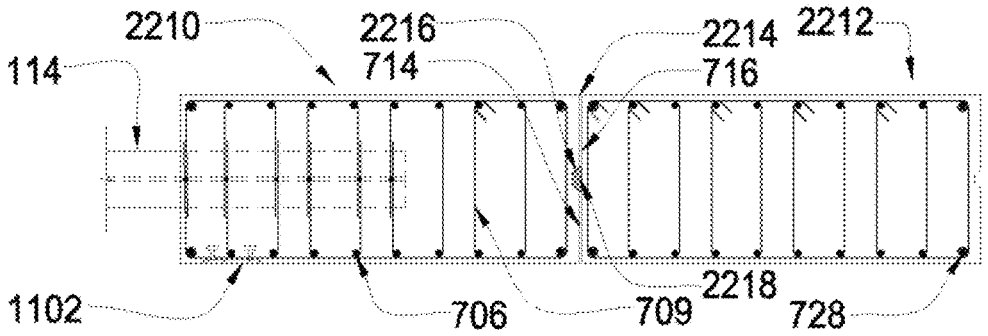
FIG. 22B is a horizontal cross-sectional view of another two exemplary precast panels that may be employed to construct the precast wall system of FIG. 1 in accordance with the present invention, where one of the panels has a vertical indentation on the side of the panel that is to be connected with the right panel to form a joint, which when filled with grout fills the indentation to effectively inhibit the passage of flame or hot gases between the joint.

FIG. 22B is a horizontal cross-sectional view of another two exemplary precast panels 2210 and 2212 that may be employed to construct the precast wall system 100 in accordance with the present invention. When the precast panels 2210 and 2212 (or walls formed from these panels) are used as a part of a fire-resistant-rated system, the joints (e.g., 2214) between the precast panels 2210 and 2212 inhibit the passage of flame or hot gases in compliance with the ASTM E 1966 standard for testing and rating fire-resistance joint systems made in or between fire-resistance-rated assemblies. As shown in FIG. 22B, one of the precast panels 2210 has a pocket or indentation 2216 on and extending the vertical height of the side 714 of the panel 2210 that is to be connected with the side 716 of the adjacent panel 2212. The side 716 of the adjacent panel 2212 may be planar or also have a vertical indentation 2216. After the two precast panels are aligned and connected side 714 by side 716 in accordance with a horizontal panel-to-panel connection 602 disclosed herein, the indentation 2216 is then filled with grout 2218 to create a seal that inhibits the passage of flame or hot gases between the joint 2214. In another implementation, the joint 2214 between the two precast panels 2210 and 2212 may be fire and smoke sealed using a flexible non-combustible material, such as a ceramic fiber blanket that is tested and fire-resistance rated in accordance with the applicable standard, for example ASTM E 1966.

Figure 23A:
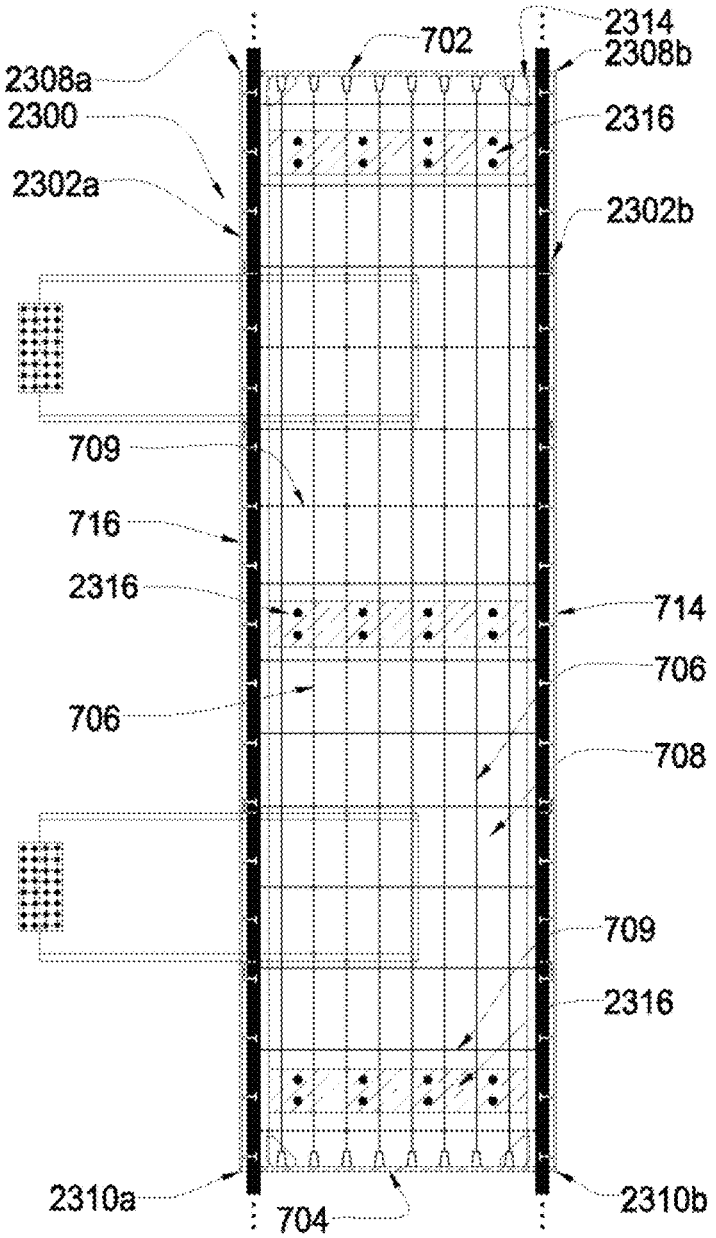
FIG. 23A depicts a vertical cross-sectional front view of another exemplary precast panel that may be employed to construct the precast wall system of FIG. 1 in accordance with the present invention, where the precast panel has a plurality of metal angles, each disposed in proximity to a respective corner of the precast panel such that each metal angle is adapted to connect the precast panel to another horizontally adjacent precast panel.
Figure 23B:
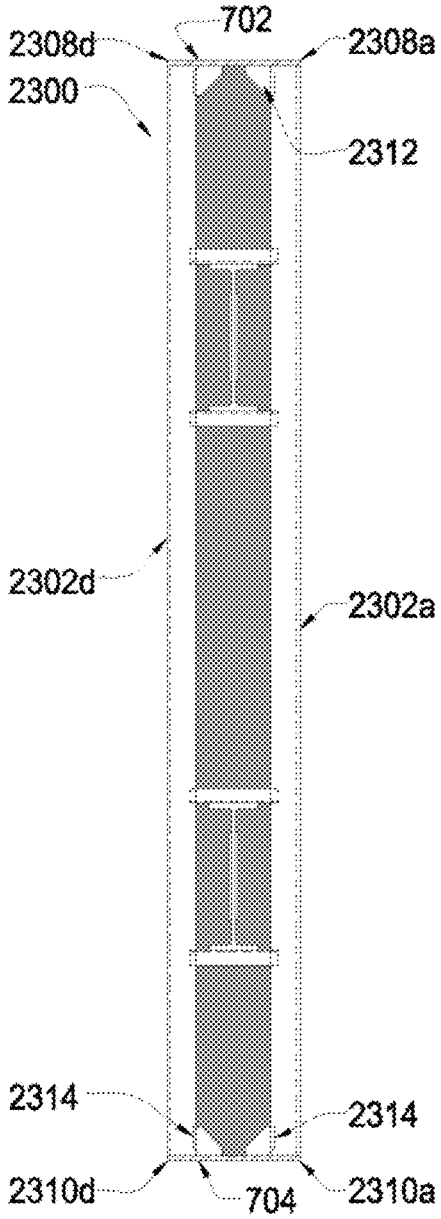
FIG. 23B depicts a left side view of the precast panel of FIG. 23A and the metal angles affixed thereto.
Figure 23C:
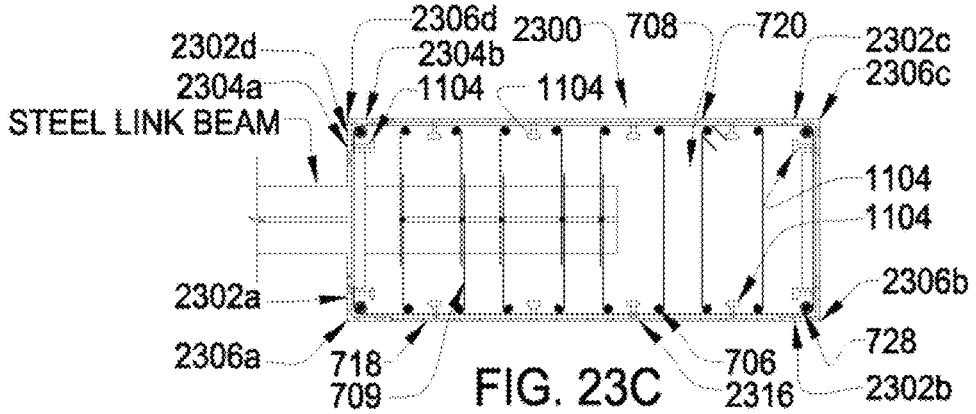
FIG. 23C depicts a horizontal cross-sectional view of the precast panel of FIG. 23A and the metal angles affixed in proximity to top end corners of the precast panel.

Turning to FIG. 23A, a vertical cross-sectional front view of another exemplary precast panel 2300 is shown, which may be employed to construct the precast wall system 100 in accordance with the present invention. FIG. 23B depicts a left side view of the precast panel 2300 and FIG. 23C depicts a horizontal cross-sectional view of the same precast panel 2300. As shown in FIGS. 23A-23C, the precast panel 2300 has a plurality of structural angles 2302*a*-2302*d* comprised or made entirely of mild or high-strength metal (for example, steel having a yield strength in a range of 36 ksi to 50 ksi). In the implementation shown in FIGS. 23A-23C, each angle 2302*a*-2302*d* is disposed along a corner edge 2306*a*, 2306*b*, 2306*c* or 2306*d* of the precast panel 2300 and may extend between a top corner 2308*a*, 2308*b*, 2308*c* or 2308*d* and a bottom corner 2310*a*, 2310*b*, 2310*c* or 2310*d* of the precast panel 2300 such that each angle 2302*a*-2302*d* is adapted to connect (for example, via a high strength weld) the precast panel 2300 to another horizontally adjacent precast panel 2300 and/or to another vertically adjacent precast panel 2300. In an alternative implementation, each angle 2302*a*-2302*d* may comprise two or more angle segments spaced apart on a respective corner edge 2306*a*-2306*d* of the panel 2300.

As best shown in FIG. 23C, each angle 2302*a*-2302*d* has a first portion or leg 2304*a* that extends along and is embedded in either the right side 714 or left side 716 of the panel 2300 and a second portion or leg 2304*b* that extends along and is embedded in either the front side 718 or the back side 720 of the panel 2300. Each angle 2302*a*-2302*d* may have one or more shear studs 1104 affixed to (e.g., welded to) and extending from each leg of the respective angle into the cementitious material 708 of the precast panel 2300 so that the respective angle is further effective to transfer forces between the precast panel 2300. In addition, to further aid in the transfer of vertical forces, the legs 2304*a* and 2304*b* at each end of each angle 2302*a*-2302*d* (or one end of an angle segment) may be affixed to (e.g., via a high strength weld) to the end plates 702 and 704 of the panel 2300. In this implementation, each leg 2304*a* and 2304*b* at each end of each angle 2302*a*-2302*d* may be connected to a respective end plate 702 or 704 via a stiffening plate 2312 or 2314 embedded in the same side 714, 716, 718 or 720 of the panel 2300 as the leg 2304*a* or 2304*b* of the respective angle 2302*a*-2302*d*.

The precast panel 2300 may also include one or more horizontal side plates 2316. Each horizontal side plate 2316 is embedded in the front side 718 or back side 720 of the precast panel 2300 and connects one leg of one angle (e.g., 2302*a* or 2302*d*) to one leg of another angle (e.g., 2302*b* or 2302*c*). Each horizontal side plate 2316 may have one or more shear studs 1104 affixed to and extending into the cementitious material 708 of the precast panel.

Although the precast panel 2300 is depicted as an opening precast panel 108 in FIG. 23, structural angles 2302*a*-2302*d* may be employed in any interior panel 102, corner panel 104, and opening panel 106, 108 or 110 embodiment disclosed herein. Furthermore, the structural angles 2302*a*-2302*d* may be employed in lieu of or in addition to side plates 720*a*-720*f* to implement a horizontal panel-to-panel connection 602 and in lieu of or in addition to end plates 702 and 704 to implement a vertical panel-to-panel connection 604 between two precast panels 2300, 102, 104, 106, 108 or 110.

For example, to implement a horizontal panel-to-panel connection 602 between a first precast panel 2300 as shown in FIG. 23 and a second precast panel formed similar to the first precast panel 2300 to employ structural angles 2302*a*-2302*d* (e.g., an interior precast panel 102 not shown in FIG. 23), each angle of the first precast panel 2300 having a leg embedded on the right side 714 of the precast panel 2300 (e.g., angles 2302*b* and 2302*c*) is horizontally aligned with and affixed to a corresponding angle (e.g., angles 2302*a* and 2302*d*) on the left side 716 of the second precast panel 102. Each pair of horizontally aligned angles of the two precast panels (e.g., angle 2302*b* of the first precast panel 2300 and angle 2302*a* on the second interior precast panel 102) define a respective joint running vertically along the front side 718 or the back side 720 of the two panels that may be welded to affix the two angles together to effectively implement the horizontal panel-to-panel connection 602.

Similarly, to implement a vertical panel-to-panel connection 604 between a first precast panel 2300 and a second precast panel formed similar to the first precast panel 2300 to employ structural angles 2302*a*-2302*d* (e.g., an interior precast panel 102 not shown in FIG. 23), each angle 2302*a*-2302*d* disposed in proximity to a respective top corner 2308*a*, 2308*b*, 2308*c* or 2308*d* of the first precast panel 2300 is vertically aligned with and affixed to a corresponding angle 2302*a*-2302*d* disposed in proximity to a respective bottom corner 2310*a*, 2310*b*, 2310*c* or 2310*d* of the second precast panel 102. In this implementation, the first and second panels may be formed without end plates 702 and 704. Instead, each pair of vertically aligned angles of the two precast panels (e.g., angle 2302*a* of the first precast panel 2300 and a corresponding angle 2302*a* on the second interior precast panel 102) define a respective corner joint running horizontally along the front side 718 or the back side 720 of the two panels, bending around a respective corner of each panel and continuing along the right side 714 or the left side 716 of the two panels. Each such corner joint may be welded to affix the respective pair of vertically aligned angles together to effectively implement the vertical panel-to-panel connection 604.

As discussed in further detail below, each structural angle 2302*a*-2302*d* of a precast panel 2300 may be used to attach temporary lifting lugs to the precast panel 2300 to enable the panel 2300 to be hoisted into position within a building via a crane or other hoisting rig.

In the implementation shown in FIGS. 23A-23C, the precast panel 2300 is depicted as an opening precast panel with link beams 114*a* and 114*b* affixed to the left side 716 of the panel 2300 to define a respective passage or opening above and/or below the respective link beam 114*a* and 114*b* relative to an adjacent precast panel to which the link beam 114*a* and 114*b* is interconnected. As shown in this implementation, the opening precast panel 2300 may include a face bearing plate 2340 disposed perpendicular between (and affixed via welds to) lower and upper plates 2342*a* and 2342*b* of the link beams 114*a* and 114*b*. The face bearing plate 2340 is disposed flush with the side 716 of the precast panel 2300 to provide further support to the link beams 114*a* and 114*b* and avoid spalling of the cured cementitious material 708 (or concrete) due to forces transferred from the link beam 114*a* or 114*b* to the cured cementitious material 708 (or concrete). The opening precast panel 2300 may also include a lower and an upper horizontal angle or plate 2344*a* and 2344*b* disposed on and affixed to a respective lower and upper plate 2342*a* or 2342*b* of the link beam 114*a* and 114*b*. When the opening precast panel 2300 is formed, the lower and upper horizontal angle or plate 2344*a* and 2344*b* are disposed relative to the link beam 114*a* or 114*b* so that the horizontal angle or plate 2344*a* and 2344*b* are embedded in the cementitious material 708 of the precast panel 2300 parallel with the side 716 so that the structural angles 2302*a* and 2302*d* that extend the length of the panel 2300 may be affixed to the horizontal angle or plate 2344*a* and 2344*b*. During fabrication of the precast panel 2300, the horizontal angle or plate 2344*a* and 2344*b* may be used to secure the respective link beam 114*a* or 114*b* in place relative to the side of the panel 2300. After fabrication of the precast panel 2300, the horizontal angle or plate 2344*a* and 2344*b* as employed in the panel 2300 aid in inhibiting the spalling of the cured cementitious material 708 (or concrete) at the top and bottom of the respective link beam 114*a* and 114*b* due to forces transferred from the link beam 114*a* or 114*b* to the cured cementitious material 708 (or concrete).

Figure 23D:
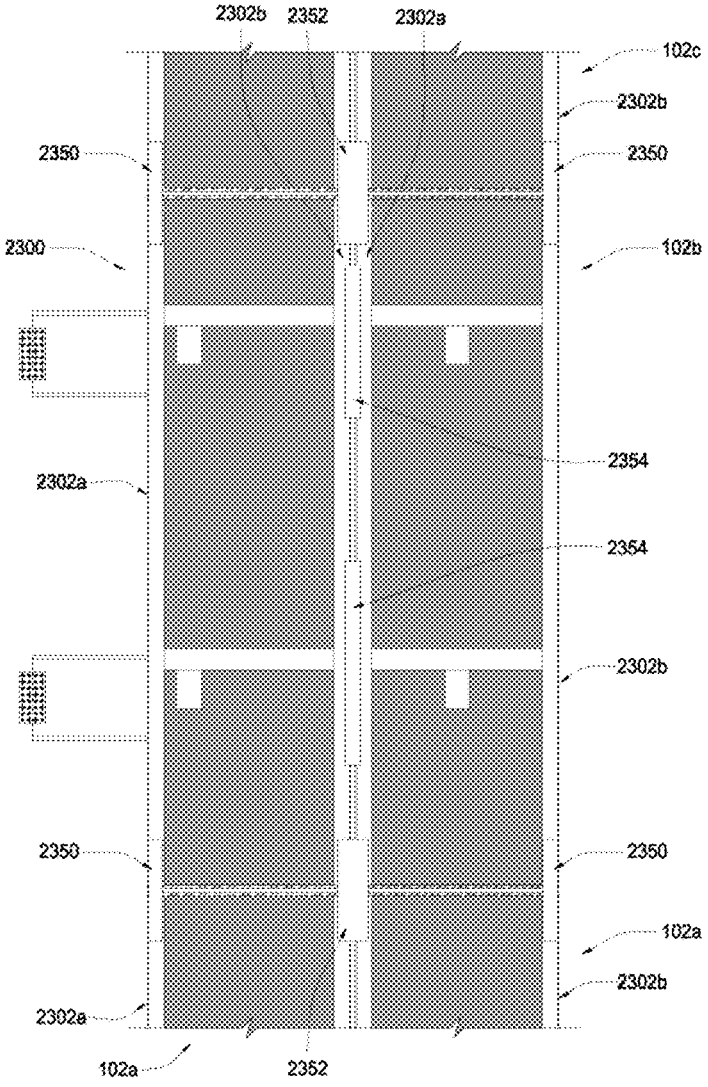
FIG. 23D depicts a front elevation view of the precast panel of FIG. 23A horizontally and vertically connected to other adjacent precast panels via horizontal and vertical panel-to-panel connections implemented using plates to connect adjacent metal angles of the respective panels.
Figure 23E:
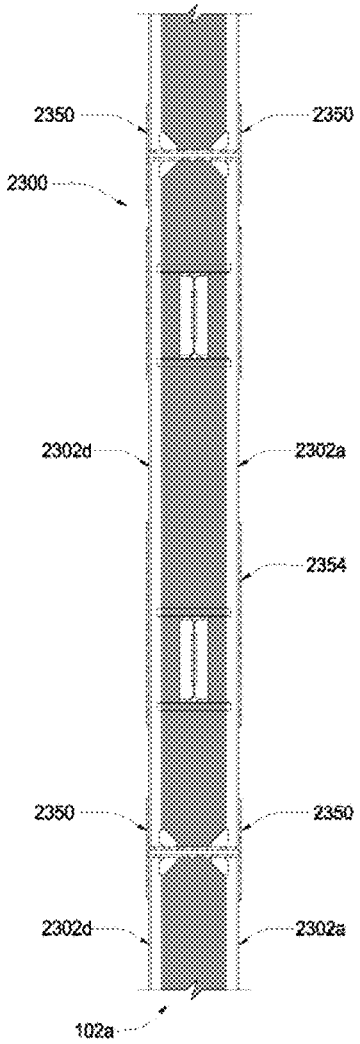
FIG. 23E depicts a left side view of the precast panel of FIG. 23D with the horizontal and vertical panel-to-panel connections to adjacent precast panels implemented using plates to connect adjacent metal angles of the respective panels.
Figure 23F:
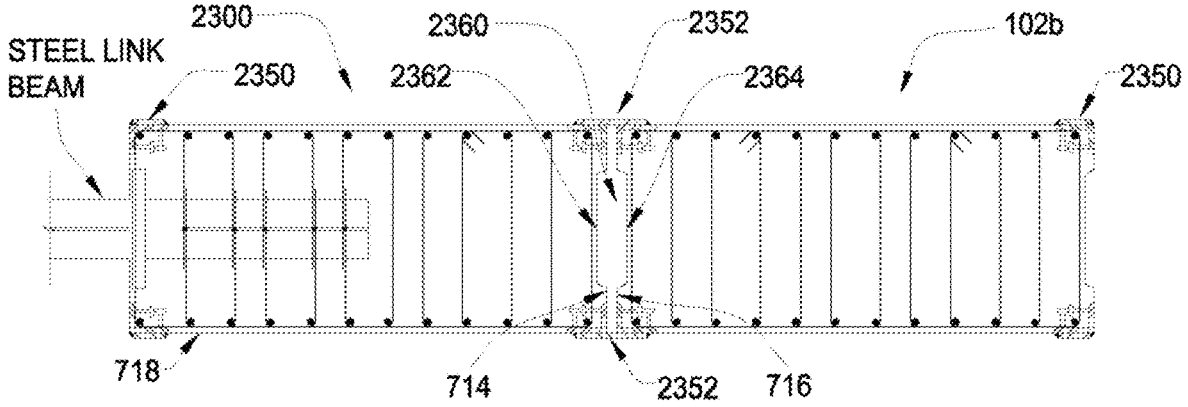
FIG. 23F depicts a horizontal cross-sectional view of the precast panel of FIG. 23D, where the horizontal panel-to-panel connection to a horizontally adjacent precast panel is augmented via a vertical grout joint defined by vertical grout indentations disposed or formed on the facing sides of the horizontally adjacent precast panels.

Turning to FIGS. 23D-23F, the precast panel 2300 is shown horizontally and vertically connected to other adjacent interior precast panels via horizontal and vertical panel-to-panel connections implemented using lap plates 2350, 2352 and 2354 to connect adjacent metal angles 2302 of the respective panels. As previously noted, each pair of horizontally aligned angles of two horizontally adjacent precast panels (e.g., angle 2302*b* of the first precast panel 2300 and angle 2302*a* on the second interior precast panel 102*b*) define a respective joint running vertically along the front side 718 or the back side 720 of the two panels that may be welded to affix the two angles together to effectively implement the horizontal panel-to-panel connection 602. To reinforce this horizontal panel-to-panel connection 602 between the two precast panels 2300 and 102*b* (or as an alternative to welding the adjacent angles 2302*a* and 2302*b* of the panels 2300 and 102*b*), one or more lap plates 2354 may be welded to the adjacent angles 2302*a* and 2302*b* to horizontally affix the panels 2300 and 102*b* to each other.

Similarly, to reinforce a vertical panel-to-panel connection 604 between the precast panels 2300 and another precast panel 102*a* vertically adjacent to the panel 2300, a lap plate 2350 may be welded to the vertically adjacent angles 2302*a* of the panels 2300 and 102*a*. Similarly, a lap plate 2350 may be welded to each of the other vertically adjacent angles 2302*b*, 2302*c* and 2302*d* of the two vertically adjacent panels 2300 and 102*b* to form or augment the vertical panel-to-panel connection 604 between the two panels. In the implementation shown in FIGS. 23D-23F, a lap plate 2352 is employed to overlap a corner formed by four adjacent precast panels (e.g., 2300, 102*a* vertically above and aligned with 2300, 102*a* vertically above and diagonally adjacent to 2300, 102*b* horizontally adjacent to 2300) and to connect (via welds) to the angles 2302 of each of the four panels that form the corner.

As shown in FIG. 23F, the horizontal panel-to-panel connection 602 between the precast panel 2300 and a horizontally adjacent precast interior panel 102*b* may be augmented via a vertical grout joint 2360 defined by vertical grout indentations 2362 and 2364 disposed or formed on the facing sides 714 and 716 of the horizontally adjacent precast panels 2300 and 102*b*. When the joint 2360 is filled with grout, the joint 2360 augments the horizontal panel-to-panel connection 602 between the panels 2300 and 102*b* and effectively inhibits the passage of flame or hot gases between the joint 2360.

Figure 23I:
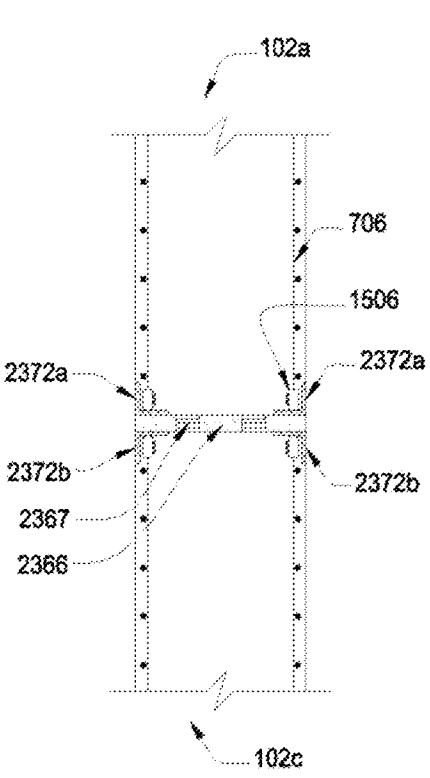
FIGS. 23G-I depict respectively a front elevation view, left side view, and vertical cross section of precast panels vertically connected via vertical grouted panel-to-panel connections with horizontal corner angles.
Figure 23H:
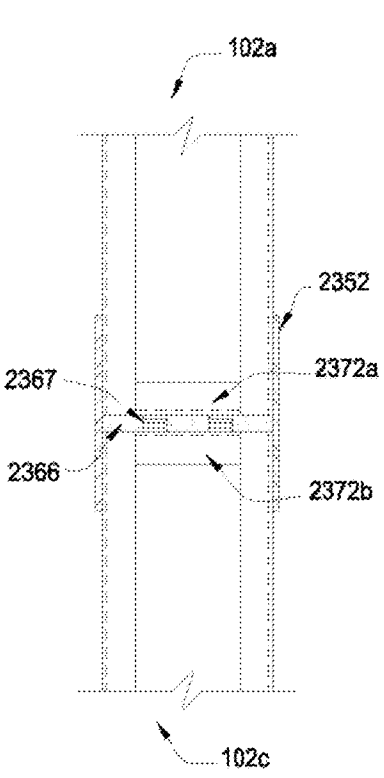
Figure 23G:
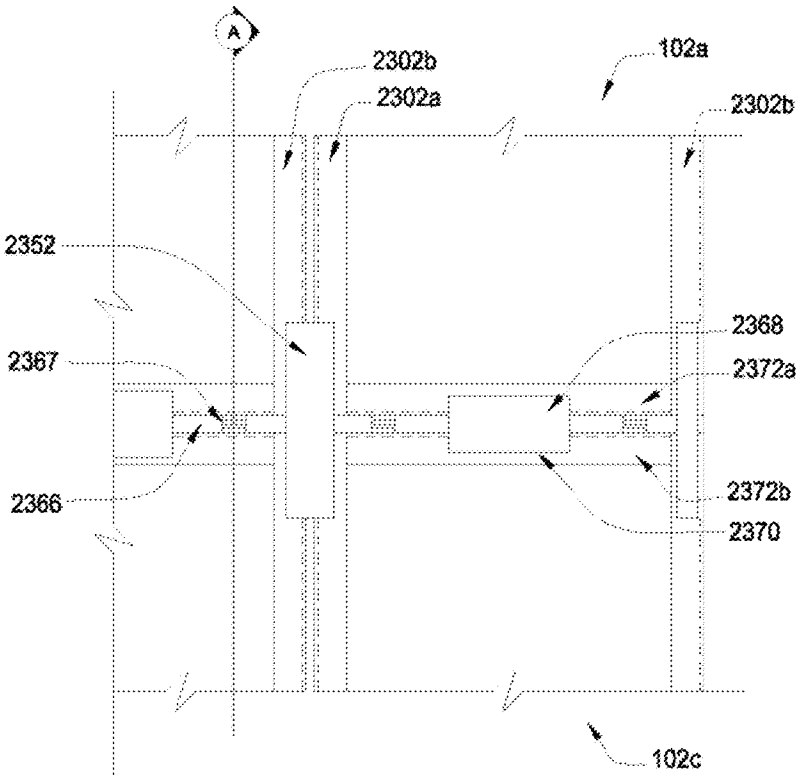

FIGS. 23G-I depict two precast interior panels 102*a* and 102*c* that are vertically connected in accordance with the present invention. This implementation is similar to the implementation of FIGS. 23D-F with the exception of the vertical connection between the two panels 102*a* and 102*b*.

As FIG. 23G depicts, the end plates 702 and 704 of the previous embodiment are replaced by a grouted horizontal joint 2366. The grout (or other high strength cementations material) in the grouted horizontal joint 2366 transfers primarily compression forces between the panels 102*a* and 102*c*. The grout strength of the grout horizontal joint 2366 (as required by analysis) is slightly higher than the concrete strength used for the panels 102*a* and 102*c*. The panels have vertical corner angles 2303*a* on panel 102*a* and 2303*b* on panel 102*c*. The angles 2303*a* and 2303*b* are used to transmit any vertical tension force and to satisfy the minimum tension capacity requirements for structural integrity. The vertical angles 2303*a* and 2303*b* are connected using a connection plate 2352 and vertical fillet welds. As depicted in FIGS. 23G-I, steel shims 2367 can be used in the grouted joint during erection for leveling and positioning of the precast panels.

In one embodiment consistent with the present invention, the panels 102*a* and 102*c* include horizontal corner angles 2372*a* and 2372*b*, as depicted in FIGS. 23G-I. The horizontal corner angles 2372*a* and 2372*b* allow for horizontal shear force transfer between the panels 102*a* and 102*c* using a connection plate 2368 welded to the horizontal corner angles 2372*a* and 2372*b* of panels 102*a* and 102*c* using horizontal fillet welds 2370.

In one embodiment consistent with the present invention, the vertical reinforcing bars 706 are attached to the horizontal corner angles 2372 via coupler 1506. The coupler 1506 may be, but is not limited to, a rebar structural steel connector or any other suitable reinforcing connector.

Figures 23J, 23K, 23L:
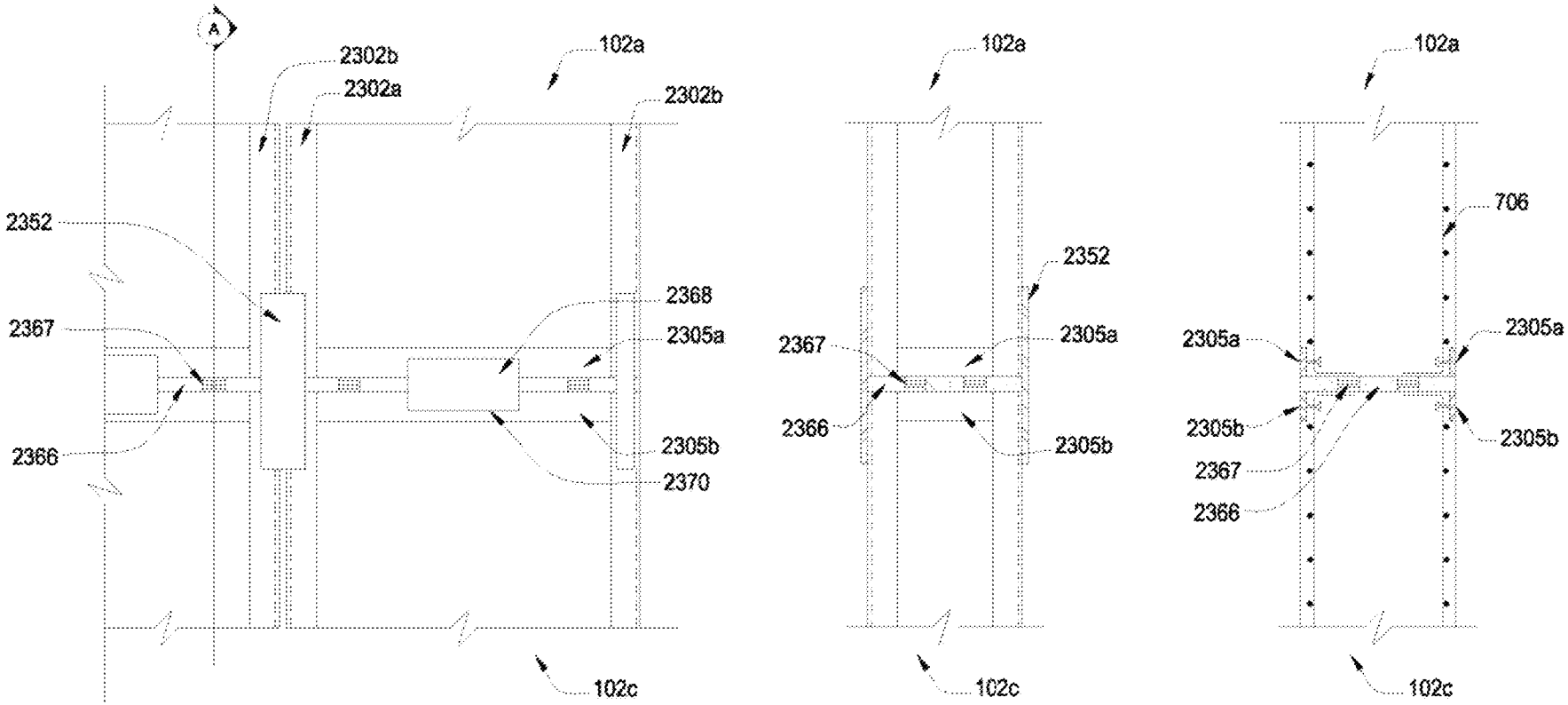
FIGS. 23J-L depict respectively a front elevation view, left side view, and vertical cross section of precast panels vertically connected via vertical grouted panel-to-panel connections with horizontal embedded plates.

In another embodiment depicted in FIGS. 23J-23L, the angles 2372*a* and 2372*b* are replaced by encased plates 2305*a* and 2305*b* with shear studs and the vertical reinforcement bars 706 are hooked at the ends without rebar continuity between panels. Consistent with this embodiment, the tension capacity of each panel is assigned to the corner angles and the tension capacity of the connection and continuity are assigned to the connection plates 2352 welded to the vertical corner angles 2302. Horizontal shear transfer between the panels 102*a* and 102*c* is achieved via a connection plate 2368 welded using horizontal fillet welds 2370 to the horizontal encased plates 2305*a* and 2305*b* of panels 102*a* and 102*c*.

Turning to FIG. 24, a precast panel erection aid platform 2400 is shown, which may be employed to construct a precast wall system 100 in accordance with the present invention. The erection aid platform 2400 comprises one or more sets 2402*a*, 2402*b* and 2402*c* of beam members 2404*a*-2404*d*. Each set 2402*a*, 2402*b* and 2402*c* of beam members 2404*a*-2404*d* is connected to four or more columns 2406*a*-2406*d* such that each set 2402*a*, 2402*b* and 2402*c* defines a respective floor of the erection aid platform 2400. The columns 2406*a*-2606*d* have a sufficient height (H) such that, when the erection aid platform 2400 is disposed relative to a top corner of a foundation 50, wall 60, or lower tier (e.g., group 112*a* in FIG. 1) of horizontally interconnected precast panels 102, 104, 106, 108 or 110, two beam members (e.g., 2404*a* & 2404*d*) of each floor or set 2402*a*, 2402*b* and 2402*c* are each positioned to temporarily brace a respective one or more precast panels 102, 106, 108, or 110 of one wall 2408*a* or 2408*b* of a next tier or group (e.g., 112*a*, 112*b* or 112*c*) erected on top of the foundation 50, the wall 60, or the lower tier (e.g., group 112*a*) of precast panels before the one wall 2408*a* or 2408*b* is horizontally connected to an adjacent wall 2408*b* or 2408*a* via a corner precast panel 106. In the example implementation shown in FIG. 24, each column 2406*a*-2406*d* is disposed in a respective corner of the erection aid platform 2400 and has a height approximately equal to the height of a precast panel 102$b_1$, 102$b_2$, 102$b_3$, 102$b_4$, or 102$b_5$ of a next tier or group 112*b* to be erected upon a lower tier or group 112*a* of precast panels employed to construct the precast wall system 100 of a building. In this implementation, two beam members 2404*a* and 2404*d* of each floor or set 2402*a*, 2402*b* and 2402*c* are each positioned to respectively brace precast panels 102$b_1$ and 102$b_2$ that define the wall 2408*a* and precast panels 102$b_3$, 102$b_4$, and 102$b_5$ that define the wall 2408*b* of the next tier or group 112*b* precast panels to be erected, enabling these precast panels 102$b_1$, 102$b_2$, 102$b_3$, 102$b_4$, and 102$b_5$ to be aligned relative to each adjacent precast panel and horizontally interconnected before the walls 2408*a* and 2408*b* are horizontally connected via a corner precast panel 106*b*. Thus, the erection aid platform 2400 enables adjacent walls 2408*a* and 2408*b* of one tier of precast panels to be erected before the adjacent walls 2408*a* and 2408*b* are interconnected so that any alignment error between the two walls 2408*a* and 2408*b* may be limited and corrected via the erection of the precast corner panel 104 used to horizontally interconnect the two walls 2408*a* and 2408*b* of precast panels.

As shown in FIG. 24, each beam member 2404*a* and 2404*d* positioned to brace one or more precast panels 102$b_1$, 102$b_2$, 102$b_3$, 102$b_4$, or 102$b_5$ may be temporarily attached to the braced precast panel via one or more right angle brackets 2410*a*-2410*e* (Note, right angle brackets attached to beam members 2404*d* are not shown in FIG. 24 for clarity and to avoid obscuring other features of the erection aid platform 2400 depicted in FIG. 24). The right angle brackets 2410*a*-2410*e* may be erection stiffened angles 2504*b* as described further described herein that have one plate 2506 affixed to the respective beam member 2404*a* or 2404*d* and another plate 2508 bolted to the respective precast panel 102$b_1$, 102$b_2$, 102$b_3$, 102$b_4$, or 102$b_5$.

An upper end 2412 of each column 2406*a*-2406*d* includes an attachment point 2414 for connecting a crane or other hoisting rig to each column 2406*a*-2406*d* to lift the erection aid platform into position relative to a top corner of a foundation 50, a cast-in-place wall 60 system, or a lower tier (e.g., group 112*a* or 112*b*) of horizontally interconnected precast panels 102, 104, 106, 108 or 110. A lower end of 2416 of each column 2406*a*-2406*d* is attached to a respective support bracket 2418*a*-2418*d*. When the erection aid platform is lifted into position, two of the support brackets 2414*c*-2414*d* are each temporarily attached (e.g., via bolts and nuts not in view in FIG. 24) to the internal face of the foundation 50, the cast-in-place wall 60, or a respective precast panel (e.g., 102$a_3$ or 102$a_5$ in FIG. 24) of a previously erected lower tier or group (e.g., 112*a*) of precast panels. In addition, when the erection aid platform is lifted into position, another two of the support brackets 2414*a*-2414*b* are temporarily attached (e.g., via bolts not in view in FIG. 24) to a cross beam 2416 connected between two opposing walls of the foundation 50, the cast-in-place walls 60, or the lower tier (e.g., 112*a* or 112*b*) of precast panels 102, 104, 106, 108 or 110. The cross beam 2416 may be a primary cross beam 2032 employed in a support frame 120, 122, 124 or 2000 of the bracing system 118 as discussed herein.

Planks or deck members 2420 may be disposed over a respective set of beam members 2404*a*-2404*d* to form a floor deck for construction workers to work inside the precast wall system 100 as it is being erected. Working on a floor deck of the erection aid platform 2400, construction workers may complete tasks, including but not limited to: (1) a vertical panel-to-panel connection 604 (e.g., by welding end plates 702 and 704 or bolting end plates 1306 and 1308 of vertically adjacent precast panels 102$a_1$ and 102$b_2$), (2) a horizontal panel-to-panel connection 602 (e.g., by welding side plates 720 or structural angles 2302 of horizontally adjacent precast panels 102$a_1$ and 102$b_2$), (3) a link beam connection 606 between two opening panels 106, 108 and 110, (4) a beam-to-panel connection 608 (e.g., for supporting an interior floor slab 1704, 1706 or 1812), (5) a slab-to-panel connection 1904, or (6) other construction activities required to erect structures internal to the precast wall system 100.

As shown in FIG. 24, the erection aid platform 2400 may also include a monorail system 2422 supported from two or more of the beam members 2404*b* and 2404*d* of the lowest set 2402*a* of beam members defining the first floor of the platform 2400. The monorail system 2422 may be used to erect elevator divider beams and floor beams that support the metal deck on a floor or floors of the foundation 50, the cast-in-place wall 60 system, or the lower tiers of precast wall system 100 below the erection aid platform 2400.

An erection aid platform 2400 may be employed in each corner of the precast wall system 100 to be erected. Once each of the precast panels for the current or upper most tier of the precast wall system 100 are erected and secured (e.g., via a vertical panel-to-panel connection 604 and a horizontal panel-to-panel connection 602 or link beam connection 606 as described herein), each erection aid platform 2400 may be lifted via a hoisting rig to the top of the panels 102$b_1$, 102$b_2$, 102$b_3$, 102$b_4$, or 102$b_5$ that the respective platform 2400 braced during the erection sequence for those panels 102$b_1$, 102$b_2$, 102$b_3$, 102$b_4$, or 102$b_5$. As discussed in further detail herein, the process of lifting each platform 2400 in position to brace precast panels to be erected, erecting the precast panels, completing panel-to-panel connections for the braced precast panels, and forming floor beam and floor slab structures relative to the braced precast panels is repeated over and over again until each planned tier or group 112*a*, 112*b*, and 112*c* of the precast wall system 100 is erected to construct the building as designed. Once the precast wall system 100 is fully erected, the erection aid platforms 2400 may be removed and lowered to the street for dismantling and shipping off-site.

Figure 25:
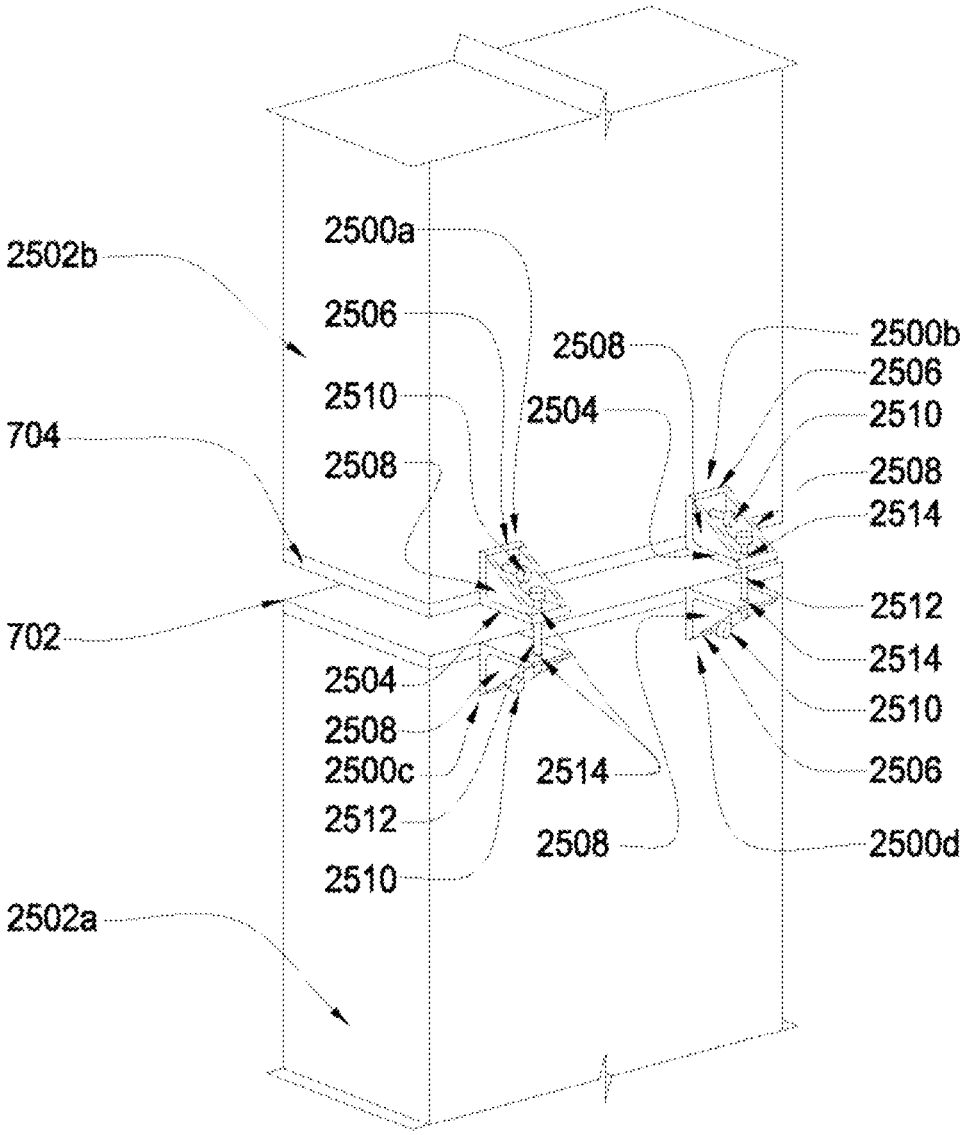
FIG. 25 depicts angle brackets that may be temporarily attached to ends of precast panels to vertically align the precast panels during the construction process of the precast wall system.

FIG. 25 depicts angle brackets 2500*a*-2500*d* that may be temporarily attached to ends of precast panels 2502*a* and 2502*b* (which each represent any embodiment of a precast panel 102, 104, 106, 108, or 110 disclosed herein) to aid in vertically aligning the precast panels 2502*a* and 2502*b* as the upper panel 2502*b* (e.g., included in an upper tier or group 112*b* or 112*c* of precast panels) is lifted into position atop the lower panel 2502*a* (e.g., included in a lower tier or group 112*a* or 112*b* of precast panels) during the construction process of the precast wall system 100. Each angle bracket 2500*a*-2500*d* includes a first plate 2504 and a second plate 2506 that is affixed (or integral) to and extends at a right angle from the first plate 2504. Each angle bracket 2500*a*-2500*d* may include one or more stiffening side plates 2508 affixed to both the first plate 2504 and second plate 2506 of the respective bracket 2500*a*-2500*d* to further strengthen the bracket. The second plate 2506 of each angle bracket 2500*a*-2500*d* is affixed (e.g., via a bolt 2510) to the end of the respective precast panel 2502*a* or 2502*b* so that the first plate 2504 is aligned with and in the same plane as the end plate 702 or 704 of the respective precast panel 2502*a* or 2502*b* to which the second plate 2506 of the angle bracket 2500*a*, 2500*b*, 2500*c* or 2500*d* is attached. The first plate 2504 of each angle bracket 2500*a*-2500*b* of the upper precast panel 2502*b* may be temporarily aligned with and affixed to the first plate 2504 of a corresponding angle bracket 2500*c*-2500*d* of the lower precast panel 2502*a* via a respective bolt 2512 inserted through a bore 2514 in each of the first plates and threaded in a respective nut (not shown in FIG. 25). The bore 2514 of each angle bracket 2500*c* and 2500*d* attached to and aligned with the top end plate 702 of a precast panel may be used as an attachment point for a hoisting rig to lift the precast panel into position within the precast wall system 100 being erected.

Figure 26A:
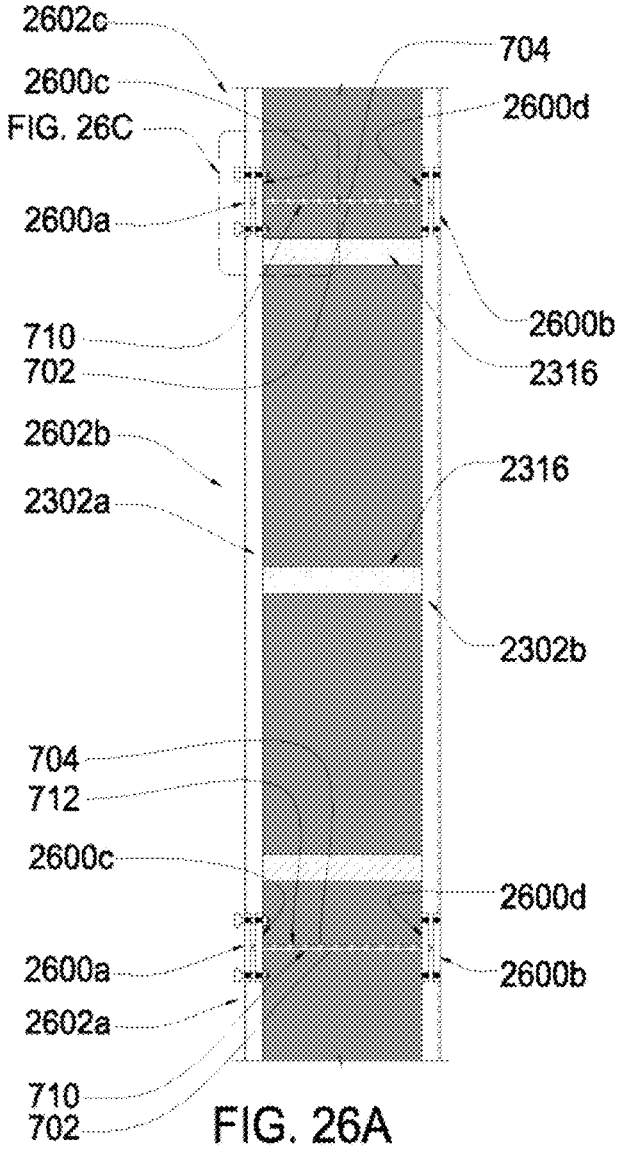
FIG. 26A depicts a front view a precast panel and a plurality of lifting lugs temporarily attached to ends of the precast panel to aid in lifting the precast panel and for guiding the precast panel into alignment with another vertically adjacent precast panel that was previously erected during the construction process of the precast wall system.
Figure 26B:
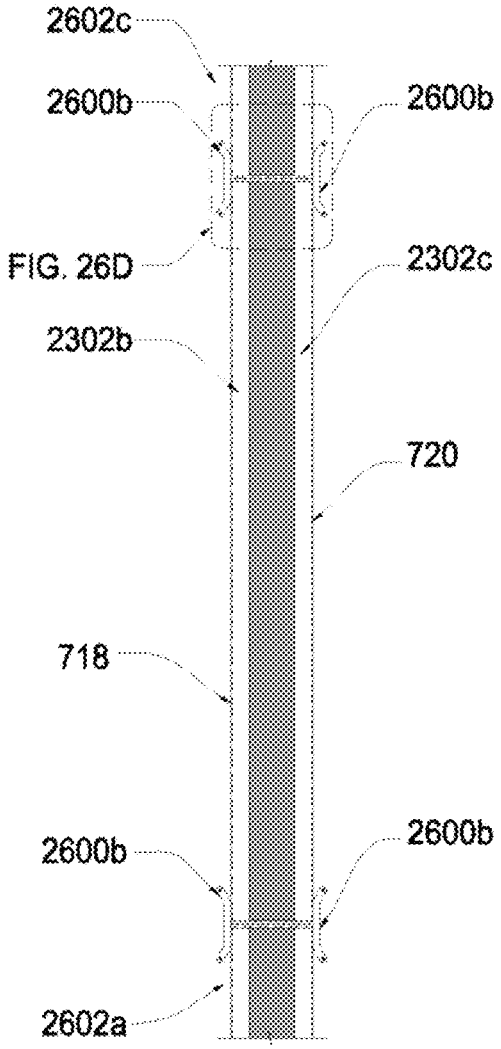
FIG. 26B depicts a side view of the precast panel and the lifting lugs shown in FIG. 26A.
Figure 26C:
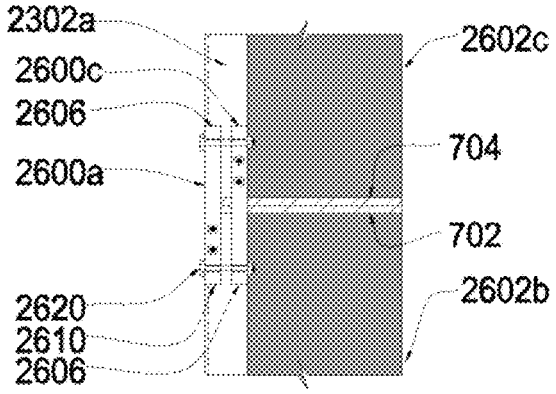
FIG. 26C depicts a magnified front view of one lifting lug shown in FIG. 26A as temporarily attached to the precast panel and another lifting lug temporarily attached to another vertically adjacent precast panel, where the two lifting lugs are functioning as guides to aid in the alignment of the two precast panels.
Figure 26D:
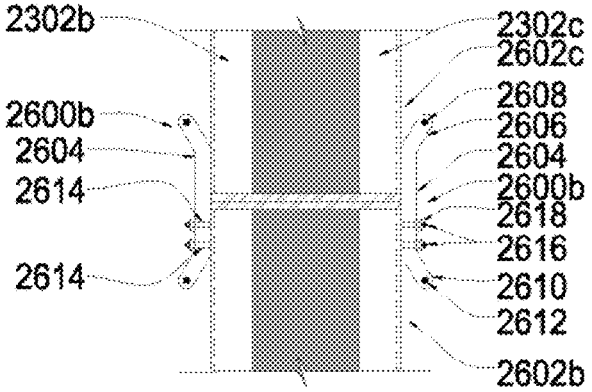
FIG. 26D depicts a magnified side view of two lifting lugs temporarily attached to a front side and a back side of the precast panel shown in FIG. 26A, where the two lifting lugs are functioning as guides to aid in the alignment of the precast panel with another vertically adjacent precast panel.

As an alternative to using angle brackets 2500*a*-2500*d*, FIGS. 26A through 26D depict one embodiment of lifting lugs 2600*a*-2600*d* that may be affixed to a precast panel 2602*a*, 2602*b* or 2602*c* (each of which are representative of any embodiment of a precast panel 102, 104, 106, 108 or 110 described herein) to aid in lifting the precast panel (e.g., 2602*b*) and for guiding the precast panel (e.g., 2602*b*) into alignment with another vertically adjacent precast panel (e.g., 2602*a*) that was previously erected during the construction process of the precast wall system 100. As best shown in FIG. 26D, each lifting lug 2600*a*-2600*d* includes a body 2604 that is configured to be removably attached to one end of a respective precast panel 2602*a*-2602*d* and a first end 2606 extending from (and integral to) the body 2604 and having an attachment point 2608 for a hoisting rig (e.g., a crane) to lift the respective precast panel. Each lifting lug 2600*a*-2600*d* may also have a second end 2610 that extends from (and is integral to) the body 2604 opposite from the first end 2606, where the second end 2610 has another attachment point 2612 for the hoisting rig to lift the respective precast panel. In the implementation shown in FIG. 26, the attachment point 2608 or 2612 is an orifice through the respective end 2606 or 2610 of the lifting lug 2600*a*-2600*d* that is sized to enable a bolt or cable to pass for connecting to a hoisting rig. However, other attachment points 2608 or 2612 may be employed such as a ring or clip that a hoisting rig may connect to in order to lift the precast panel 2602*a*, 2602*b* or 2602*c* via the lifting lug 2600*a*-2600*d*.

The first end 2606 of each lifting lug 2600*a*-2600*d* may be bent or curved relative to the body 2604 of the lifting lug 2600*a*-2600*d* so that, when the body 2604 of the lifting lug 2600*a*-2600*d* is attached to the precast panel (e.g., 2602*b*), the first end 2606 of the lifting lug 2600*a*-2600*d* is effective to capture and guide another vertically adjacent precast panel (e.g., 2602*a* or 2602*c*) towards the panel 2602*b* that the lifting lug 2600*a*-2600*d* is attached.

In one implementation, to removably attach the lifting lug 2600*a*-2600*d* to a respective precast panel 2602*a*, 2602*b* or 2602*c*, each lifting lug 2600*a*-2600*d* has one or more bore holes 2614 for receiving a respective stud 2616 mounted on or embedded in the front side 718 or back side 720 of the precast panel in proximity to one end 710 or 712 of the panel 2602*a*, 2602*b* or 2602*c*. Each stud 2616 may be secured to the respective lifting lug 2600*a*-2600*d* via a nut or other type of anchor threaded on or affixed to the end of the stud 2616 extending out of the bore hole 2614 in the body 2604 of the respective lifting lug 2600*a*-2600*d*.

Each precast panel 2602*b* may have a first plurality of lifting lugs 2600*a* and 2600*b* ("top lugs 2600*a* and 2600*b*") attached in proximity to and spaced about the top end 710 or top end plate 704 so that the first end 2606 of each lifting lug 2600*a* and 2600*b* extends beyond and curves away the top end 710 or top end plate 702. As shown in the example depicted in FIGS. 26A-26D, two top lugs 2600*a* and 2600*b* are each attached to a respective structural angle 2302*a* and 2302*b* on the front side 718 of the precast panel 2602*b* and two additional top lugs 2600*a* (not in view in FIGS. 26A-26D) and 2600*b* are each attached to a respective structural angle 2302*c* and 2302*d* (not in view in FIGS. 26A-26D) on the back side 720 of the precast panel 2602*b*. The four lifting lugs 2600*a* and 2600*b* spaced about the top end 710 or top end plate 702 of the precast panel 2602*b* enable the precast panel 2602*b* to be lifted without being substantially tilted by a hoisting rig connected to the attachment points 2608 of the first end 2606 of each of four lifting lugs 2600*a* and 2600*b* so that the precast panel 2602*b* may be positioned atop and vertically aligned with a lower precast panel 2602*a* that was previously erected as one of a lower tier (e.g., group 112*a*) of precast panels in the precast wall system 100 being constructed.

Each precast panel 2602*b* may also have a second plurality of lifting lugs 2600*c* and 2600*d* ("bottom lugs 2600*c* and 2600*d*") attached in proximity to and spaced about the bottom end 712 or bottom end plate 704 so that the first end 2606 of each lifting lug 2600*c* and 2600*d* extends beyond and curves away the bottom end 712 or bottom end plate 704. As shown in the example depicted in FIGS. 26A-26D, two bottom lugs 2600*c* and 2600*d* are each attached to a respective structural angle 2302*a* and 2302*b* on the front side 718 of the precast panel 2602*b* and two additional bottom lugs 2600*c* and 2600*d* (not in view in FIGS. 26A-26D) are each attached to a respective structural angle 2302*c* and 2302*d* (not in view in FIGS. 26A-26D) on the back side 720 of the precast panel 2602*b*. As the upper precast panel 2602*b* is lifted and lowered towards the lower precast panel 2602*a*, the first end 2608 of the four bottom lifting lugs 2600*c* and 2600*d* spaced about the bottom end 712 or bottom end plate 704 of the upper precast panel 2602*b* effectively capture the top end 710 of the lower precast panel 2602*a* and guide the upper precast panel 2602*b* towards the top end 710 of the lower precast panel 2602*a* such that the bottom end 712 (or bottom end plate 704) of the upper precast panel 2602*b* is substantially aligned with the top end 710 (or top end plate 702) of the lower precast panel 2602*a*.

As previously noted, the lower precast panel 2602*a* may also have a first plurality of lifting lugs 2600*a* and 2600*b* attached in proximity to and spaced about the top end 710 or top end plate 704 of the lower precast panel 2602 so that the first end 2606 of each lifting lug 2600*a* and 2600*b* extends beyond and curves away the top end 710 or top end plate 702 of the lower precast panel 2602*a*. In this implementation, as the upper precast panel 2602*b* is lifted and lowered towards the lower precast panel 2602*a*, the first end 2608 of the four top lifting lugs 2600*a* and 2600*b* spaced about the top end 710 or top end plate 702 of the lower precast panel 2602*a* effectively capture the bottom end 714 of the upper precast panel 2602*b* and guide the upper precast panel 2602*b* towards the top end 710 of the lower precast panel 2602*a* such that the bottom end 712 (or bottom end plate 704) of the upper precast panel 2602*b* is substantially aligned with the top end 710 (or top end plate 702) of the lower precast panel 2602*a*.

As best shown in FIGS. 26A and 26C, when the bottom end 712 of the upper precast panel 2602*b* is positioned atop and substantially aligned with the top end 710 of the lower precast panel 2602*a*, each top lug 2600*a* and 2600*b* attached in proximity to the top end 710 or the top end plate 702 of the lower precast panel 2602*a* is disposed relative to and horizontally aligned with a corresponding one of the bottom lugs 2600*c* and 2600*d* attached in proximity to the bottom end 712 or the bottom end plate 704 of the upper precast panel 2602*b*. When a top lug 2600*a* or 2600*b* is horizontally aligned with a corresponding bottom lug 2600*c* or 2600*d*, the orifice 2614 in the first end 2606 of the top lug 2600*a* attached to the lower precast panel 2602*a* is aligned with the orifice 2614 in the second end 2610 of the bottom lug 2600*c* attached to the upper precast panel 2602*b* and a bolt 2620 or other removable fastener may be inserted through the aligned orifices 2614 of the two horizontally aligned lugs 2606 and 2610 of the vertically adjacent panels 2602*a* and 2602*b* to maintain the alignment between the two panels. Similarly, when a top lug 2600*a* or 2600*b* is horizontally aligned with a corresponding bottom lug 2600*c* or 2600*d*, the orifice 2614 in the first end 2606 of the bottom lug 2600*b* attached to the upper precast panel 2602*b* is also aligned with the orifice 2614 in the second end 2610 of the top lug 2600*c* attached to the bottom precast panel 2602*a* and another bolt 2620 or other removable fastener may be inserted through these aligned orifices 2614 of the two horizontally aligned lugs 2606 and 2610 of the vertically adjacent panels 2602*a* and 2602*b* to further maintain the alignment between the two panels 2602*a* and 2602*b*.

Once the upper precast panel 2602*b* is positioned and interconnected to the lower precast panel 2602*a*, the hoist rig may be disconnected from the attachment point 2608 of each of the top lugs 2600*a* and 2600*b* of the upper precast panel 2602*b* and connected to the attachment point 2608 of each of the top lugs 2600*a* and 2600*b* of the next precast panel 2602*c* to be positioned in the precast wall system 100.

Figure 27A:
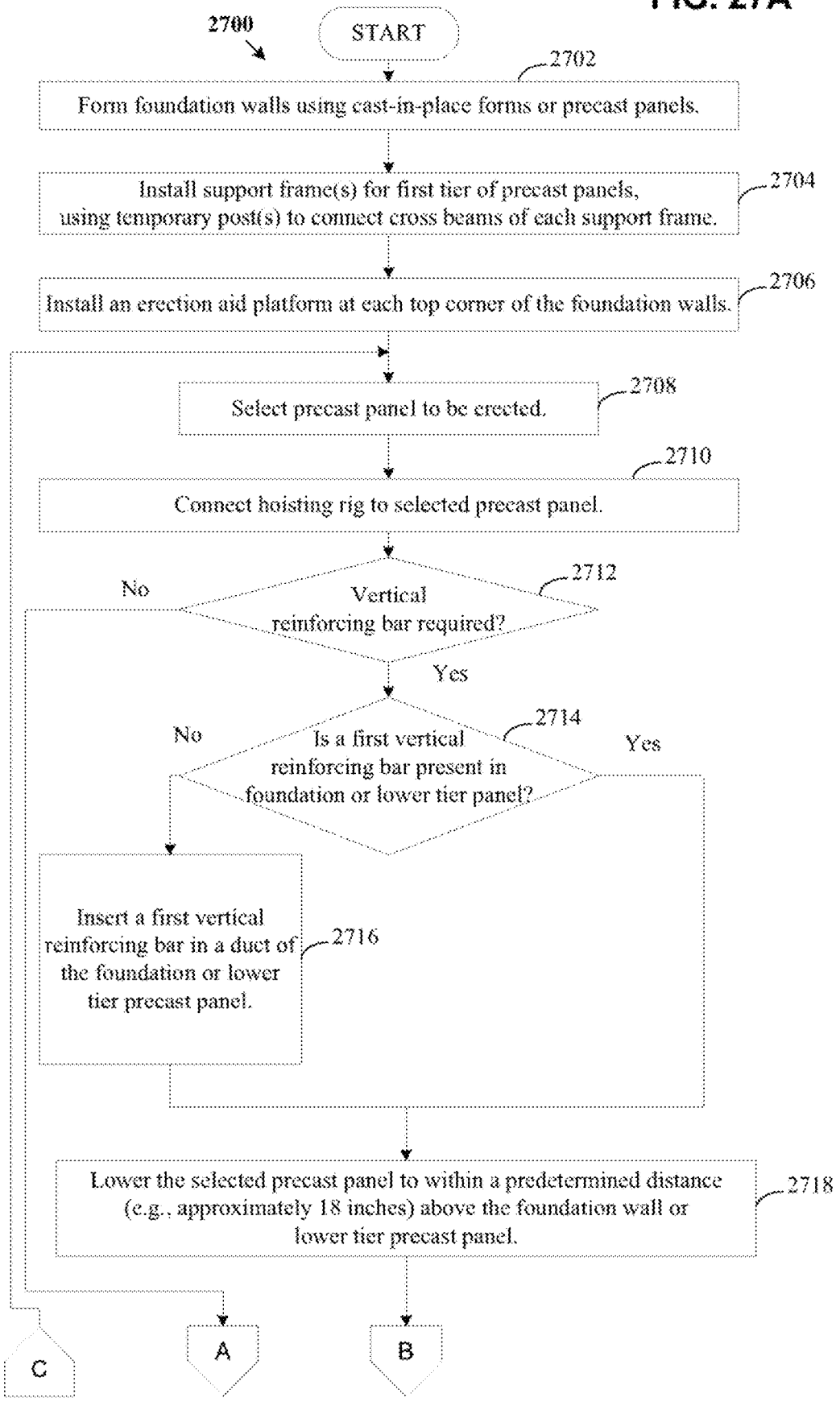
Figure 28:
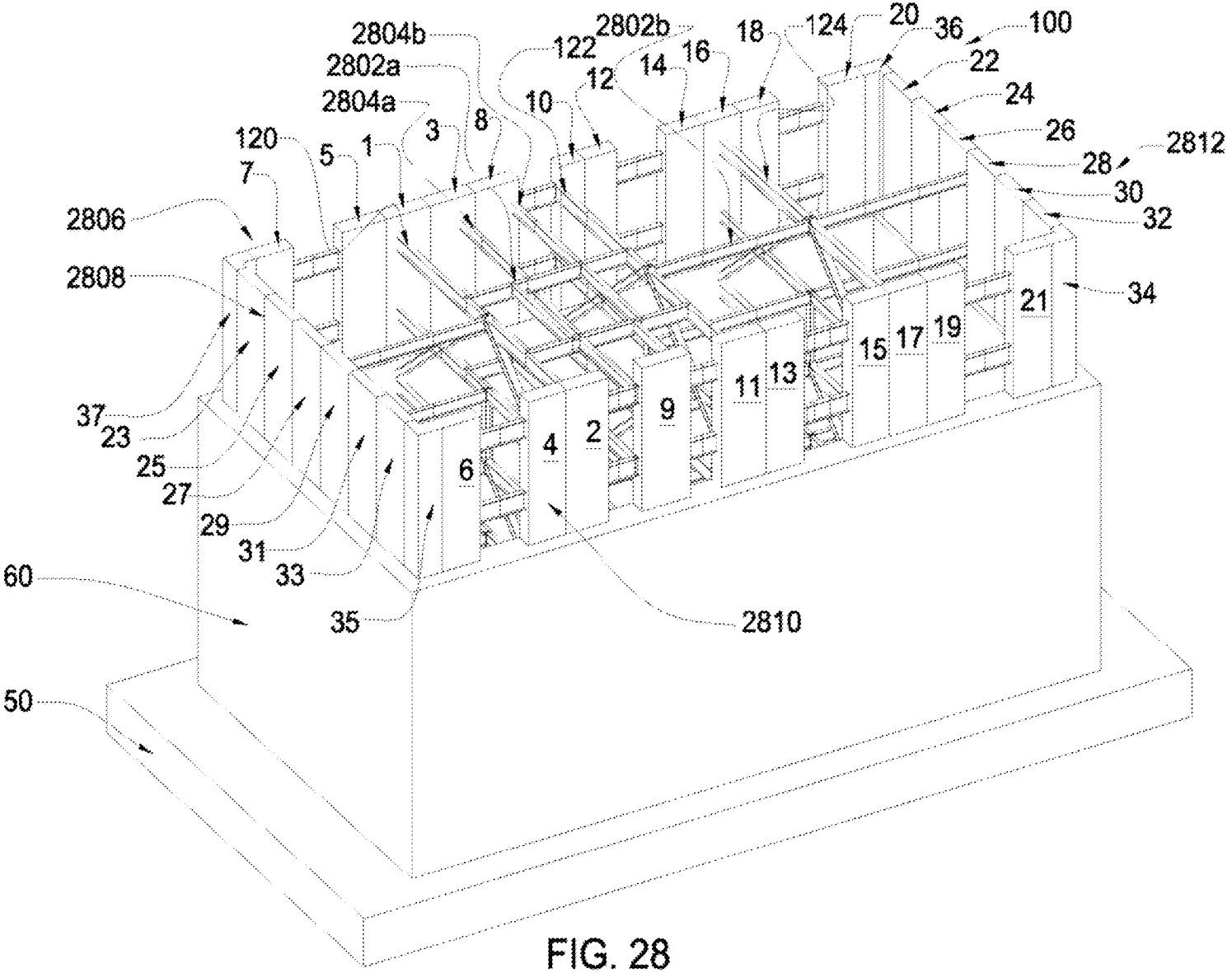
FIG. 28 depicts a sequence of erecting precast panels in a first tier of the precast wall system constructed in accordance with the process illustrated in FIGS. 27A-27C.

FIGS. 27A-27C depict a flow chart illustrating an exemplary process 2700 for constructing a precast wall system 100 in accordance with the present invention. For brevity and clarity in the discussion of the process 2700 to follow, an exemplary sequence is shown in FIG. 28 of erecting precast panels 102, 104, 106, 108 and 110 in a first tier 112*a* of the precast wall system 100 in accordance with the process 2700. Unless otherwise specified herein, the precast wall system construction or erection process 2700 may be performed by construction workers utilizing one or more hoisting rigs (such as cranes suitable for high-rise building construction) and standard construction tools (such as a welder, manual or power socket wrenches, or other standard tools). The precast panels 102, 104, 106, 108 and/or 110 employed in the precast wall system 100 to be erected may vary depending on the design of the building without deviating from the scope of the disclosed process 2700. In addition, the precast panels 102, 104, 106, 108 and/or 110 employed in the precast wall system 100 are preferably casted or formed off site in accordance with the embodiments described in detail herein.

Initially, construction workers may form a footing or foundation 50 and foundation walls 60 upon the footing or foundation 50 using standard cast-in-place techniques (step 2702 in FIG. 27A). In an alternative implementation, the foundation walls 60 may be omitted and the initial tier 112*a* of precast panels 102, 104, 106, 108 and 110 may be erected directly on the footing or foundation 50 as described herein. If any of the first tier 112*a* of precast panels are to be vertically connected to the foundation 50 or the foundation walls 60 using a vertical reinforcing bar 728, a top portion (e.g., 312 in FIG. 3B) of the foundation 50 or wall 60 (which is the last portion to be formed from concrete poured to from the cast-in-place foundation 50 or wall 60) is formed to include a cap plate 314 that serves as a base for vertically connecting precast panels 102, 104, 106, 108 or 110 (precasted consistent with the panel 310 in FIG. 3B) and to include vertical ducts 724 for inserting and retaining a continuous reinforcing bar 728 or coupled reinforcing bar segments 728*a* and 728*b*. The last or top portion 312 of the cast-in-place foundation 50 or wall 60 may be formed to include one or more support posts 316 upon which the cap plate 314 may be disposed before pouring concrete to encase the support posts 316 and forming the top portion 312. Plates 318 having jacking bolts 320 may be disposed on the top of the support posts 316. Prior to pouring the concrete for the top portion 312 of the foundation 50 or wall 60, shims or the jacking bolts 320 may be used (by individually threading each bolt 320 through the respective support plate 318) to adjust the level of the cap plate 314 of the foundation 50 or wall 60. Shims (e.g., 308 in FIG. 3A) may also be employed to level the bottom end plate 704 of the precast panel 310 relative to the cap plate 314.

Next, using a hoisting rig, construction workers may install one or more support frames 120, 122, 124 (consistent with the support frame 2050) for a first tier 112*a* of precast panels (step 2704). Each support frame 120, 122, 124 may be previously constructed (consistent with the support frame 2050) to include removable or temporary posts 2052*a* and 2052*b* and 2054*a* and 2054*b* to connect cross beams of the precast panels as shown and described, for example, in reference to FIGS. 20A and 20B. In this implementation, the temporary posts 2052*a* and 2052*b* and 2054*a* and 2054*b* are used to support the respective support frame 120, 122, 124 when the primary cross beam (i.e., the lowest cross beam of the support frame 2050) is attached to a foundation 50 or wall 60 before a first tier 112*a* precast panel is erected to form the precast wall system 100. At this stage in the process 2700, additional beams 2802*a* and 2802*b* as shown in FIG. 28 may be installed and connected between the support frames 120, 122, and 124 to complete the structural framing for the first tier 112*a* of the precast wall system 100.

Using a hoisting rig, an erection aid platform 2400 may next be installed at each top corner of the foundation walls 60 (step 2706) as described in reference to FIG. 24. Although not shown in FIG. 28 to avoid obscuring other aspects of the first tier 112*a* of the precast wall system 100 to be constructed, each erection aid platform 2400 functions to brace precast panels on two respective walls (2806 & 2808, 2808 & 2810, 2810 & 2812 and 2812 & 2806 in FIG. 28) before installation of a corner precast panel 104 that horizontally connects the two respective walls as previously described and shown in reference to FIG. 24. Thus, the erection aid platforms 2400 enable each wall 2806, 2808, 2810 and 2812 of the current tier 112*a*, 112*b* or 112*c* of precast panels 102, 104, 106, 108 or 110 to be erected and aligned and plumbed relative to the foundation 50 or wall 60 or lower tier (e.g., 112*a* or 112*b*) of precast panels before the precast panel walls 2806, 2808, 2810 and 2812 of the current tier 112*a*, 112*b* or 112*c* are interconnected via precast corner panels 106. Accordingly, alignment errors between adjacent precast panel walls 2806, 2808, 2810 and 2812 is limited or avoided.

Returning to FIG. 27A, a precast panel is selected to be erected (step 2708). In a preferred selection sequence, the first precast panel selected to be erected requires a connection to a previously erected support frame 120, 122 or 124 and the next precast panel to be erected is the precast panel designed to be disposed opposite to the first precast panel and connected to the other end of the respective support frame 120, 122, or 124. In the example erection sequence depicted in FIG. 28, the interior precast panel referenced as "1" is selected as the first precast panel to be erected since the precast panel 1 requires a connection to the support frame 120. The next precast panel that will be selected to be erected is the opening precast panel referenced as "2" in FIG. 28, which is disposed opposite to the interior precast panel 1 and is to be connected to the same support frame 120.

Next, a hoisting rig is connected to the selected precast panel (step 2710). In one implementation, each precast panel 102, 104, 106, 108 and 110 to be erected in each tier 112*a*, 112*b* and 112*c* of the precast wall system 100 has angle brackets 2500*c* and 2500*d* (as shown in FIG. 25) attached to and aligned with the top end plate 702 of the precast panel. The bore 2514 of each bracket 2500*c* and 2500*d* may then used as attachment points for the hoisting rig to lift the selected precast panel into position within the precast wall system 100. Alternatively, each precast panel may be formed consistent with the precast panels 2602*a* and 2602*b* depicted in FIGS. 26A-26D to have a first plurality of lifting lugs 2600*a* and 2600*b* ("top lugs 2600*a* and 2600*b*") attached in proximity to and spaced about the top end 710 or top end plate 704 so that the first end 2606 of each lifting lug 2600*a* and 2600*b* extends beyond and curves away from the top end 710 or top end plate 702. The hoisting rig may connect to the attachment points 2608 of the top lugs 2600*a* and 2600*b* to lift the selected panel into position within the precast wall system 100. A second plurality of lifting lugs 2600*c* and 2600*d* ("bottom lugs 2600*c* and 2600*d*") may be attached in proximity to and spaced about the bottom end 712 or bottom end plate 704 of the selected precast panel (consistent with the precast panel 2602*b* in FIG. 26A) so that the first end 2606 of each of the bottom lifting lugs 2600*c* and 2600*d* is able to effectively capture the outside edges of the foundation walls 60 (or the top end 710 of a lower tier precast panel such as 2600*a* in FIG. 26A) and guide the selected (or upper) precast panel towards the foundation wall 60 (or the top end 710 of the lower tier precast panel 2602*a*) such that the bottom end 712 (or bottom end plate 704) of the selected or upper precast panel (2600*b* in FIG. 26A) is substantially aligned with the top end 710 (or top end plate 702) of the lower precast panel (2600*a* in FIG. 26A).

If in step 2712 it is determined that the design of the precast system 100 specifies that a vertical reinforcing bar is not required to complete the vertical connection of the selected precast panel to the foundation 50, wall 60, or a lower tier precast panel, then the erection process continues at step 2726. If a vertical reinforcing bar is required and it is determined in step 2714 that a first vertical reinforcing bar or segment 728*a* is not present in the foundation 50 or foundation wall 60 or lower tier precast panel, then a first vertical reinforcing bar segment 728*a* is inserted in a duct of the foundation 50, foundation wall 60, or lower tier panel (2716). The selected precast panel is then lowered via the hoisting rig to within a predetermined distance (e.g., approximately 18 inches) above the foundation 50 or foundation wall 60 (or to a lower tier precast panel once the first tier 112*a* is erected) (step 2718).

If vertical bar-to-bar couplers 326 are to be used to connect vertical reinforcing bar segments 728*a* and 728*b* to form a continuous vertical reinforcing bar 728 and a first vertical reinforcing bar segment 728*a* is present in the foundation or lower tier panel, then a vertical bar-to-bar coupler 326 is attached to the first vertical reinforcing bar segment 728*a* (step 2720). A second vertical reinforcing bar segment 728*b* is then inserted in a duct 724 of the selected precast panel that is aligned with the first vertical reinforcing bar segment 728*a* (step 2722). Step 2722 may be omitted if the second vertical reinforcing bar segment 728*b* was previously installed in the duct 724 of the selected precast panel before the panel was connected to the hoist rig and lowered into place in step 2714. The second vertical reinforcing bar segment 728*b* is attached to the vertical bar-to-bar coupler 326 (step 2724) to incrementally form a continuous vertical reinforcing bar 728 through each vertically adjacent precast panels in a plurality or all tiers 112*a*, 112*b* or 112*c* of the precast wall system 100 to be erected. If the selected precast panel has more than one duct 724 and corresponding vertical reinforcing bar segment 728*b*, steps 2720, 2722 and 2724 may be repeated to align and couple each vertical bar segment 728*b* in the selected precast panel to a corresponding vertical bar segment 728*a* present in the foundation or lower tier panel.

Next, the selected precast panel is lowered to its final position atop the foundation 50, wall 60 or lower tier precast panel (step 2726). In the implementation in which bottom lugs 2600*c* and 2600*d* are attached in proximity to and spaced about the bottom end 712 or bottom end plate 704 of the selected precast panel, the first end 2606 of each of the bottom lifting lugs 2600*c* and 2600*d* is able to effectively capture the outside edges of the foundation walls 60 (or the top end 710 of a lower tier precast panel such as 2600*a* in FIG. 26A) and guide the selected (or upper) precast panel towards the foundation wall 60 (or the top end 710 of the lower tier precast panel 2602*a*) such that the bottom end 712 (or bottom end plate 704) of the selected or upper precast panel (2600*b* in FIG. 26A) is substantially aligned with the top end 710 (or top end plate 702) of the lower precast panel (2600*a* in FIG. 26A). However, the selected precast panel may be further aligned, plumbed and shimmed (as necessary) relative to the foundation wall 60 or lower tier precast panel (step 2728) using standard bore sighting equipment or alignment tools.

Next, it is determined whether the selected precast panel requires a connection to one of the erection aid platforms (step 2728). If selected precast panel does not require connection to an erection aid platform, then processing continues at step 2732. Otherwise, the selected precast panel is temporarily attached to one of the erection aid platforms (step 2730). As previously noted, each erection aid platform 2400 functions to brace precast panels on two respective walls (2806 & 2808, 2808 & 2810, 2810 & 2812 and 2812 & 2806 in FIG. 28) before installation of a corner precast panel 104 that horizontally connects the two respective walls. For example, precast panels 4 and 6 of wall 2810 and precast panels 31 and 33 of wall 2808 may be braced by one erection aid platform 2400 before the corner precast panel 35 is installed and horizontally interconnected to adjacent panels 6 and 33 using one of the disclosed horizontal panel-to-panel connections 602. As previously described in reference to FIG. 24, the selected precast panel may be temporarily attached, via one or more right angle brackets 2410*a*-2410*e*, to one of the beam members 2404*a* or 2404*d* of the erection aid platform 2400 that is bracing the selected precast panel. The right angle brackets 2410*a*-2410*e* are not over tightened to enable the selected precast panel to be aligned, plumbed, and shimmed (as necessary) relative to the foundation 50, wall 60 or lower tier precast panel in step 2732.

Once the selected precast panel is lowered to its final position, aligned, plumbed, and shimmed as necessary, the vertical panel-to-panel connection 604 between the selected panel and foundation wall 60 or lower tier precast panel is completed (step 2734). For example, if the selected precast panel is formed with end plates consistent with the precast panels disclosed herein, the bottom end plate 302, 704, 1308, or 1408 of the selected precast panel is connected (for example, via welding, bolting or clamping) to the cap plate 314 embedded in the foundation wall 60 or to the top end plate 702, 1306 or 1406 of a previously erected lower tier precast panel.

Alternatively or in addition to connecting end plates between vertically adjacent precast panels, if the precast panels are formed to include structural angles 2302*a*-2302*d*, the structural angles 2302*a*-2302*d* of the selected precast panel may be welded or affixed to the cap plate 314 of the foundation 50 or wall 60 or to corresponding structural angles 2302*a*-2302*d* of a lower tier precast panel as previously described herein.

In addition, once the erection, pluming and alignment of the selected panel is completed, the ducts 724 of the selected panel are filled with grout to lock the vertical reinforcing bar segment 728*b* in place. Alternatively, the grouting of the ducts 724 of each precast panel in the current tier may be performed after step 2748 after the erection, pluming and alignment of all the precast panels in the current tier is completed. The grouting may be performed on the first two tiers of precast panels after the two tiers of panels have been erected to facilitate bar 728*a* to bar 728*b* alignment.

Next, it is determined whether the selected precast panel requires a connection to the support frame (step 2736). For example, in the exemplary erection sequence depicted in FIG. 28, the precast panels 1 and 2 require a connection to the support frame 120, the precast panels 10 and 11 require a connection to the support frame 122, and the precast panels 16 and 17 require a connection to the support frame 124. Other precast panels 3, 8, 9, 26 and 27 require an indirect method (e.g., a beam-to-panel connection) to connect a structural beam (e.g., a floor beam) to one of the support frames 120, 122, or 128 as part of the bracing system 118 of the precast wall system 100. Such connections to precast panels 3, 8, 9, 26 and 27 may be performed in step 2738.

If the selected precast panel does not require a connection to a support frame 120, 122 or 124, then processing continues at step 2740. Otherwise, the selected precast panel is connected to the respective support frame 120, 122 or 122 as required (step 2738). For example, each of the precast panels 1, 10, and 16 may be connected to cross beams 2002 and 2034 and brace member 2004 of the respective support frame 120, 122 or 124 consistent with the manner in which the precast panel 102*b* is connected to the support frame 2000 or 2050 as previously described in reference to FIGS. 20A-20D. Similarly, each of the precast panels 2, 11, and 17 may also be connected to cross beams 2002 and 2034 and a brace member 2004 or 2012 of the respective support frame 120, 122 or 124 consistent with the manner in which the precast panel 106*b* is connected to the support frame 2000 or 2050 as previously described herein. Precast panels 3, 8, 9, 26 and 27 may be formed to implement any one of the beam-to-panel connections 608 in described herein, such as depicted and described in reference to FIG. 18A.

It is then determined whether the selected precast panel requires a horizontal panel-to-panel connection that can be completed with a previously precast panel horizontally adjacent to the selected precast panel (step 2740). If no such horizontal connections are required, then processing continues at step 2744. Otherwise, the horizontal panel-to-panel connection or connections 602 between the selected panel and each horizontally adjacent precast panel is completed (step 2742). For example, if the selected precast panel and adjacent precast panels are formed to include embedded side plates 720 consistent with the panels 700 or 702, the horizontal panel-to-panel connection 608 may be implemented by welding or bolting the corresponding aligned side plates of the two precast panels. Alternatively or in addition, if the selected precast panel and adjacent precast panels are each formed to include embedded structural angles 2302*a*-2302*d* on the edges 2306*a*-2306*d* of the panels consistent with the panel 2300 or 2602*a* depicted in FIGS. 23 and 26, the horizontal panel-to-panel connection 608 may be implemented by welding the corresponding aligned structural angles of the selected precast panel and each adjacent precast panel. In addition or alternatively, the selected precast panel and adjacent precast panels may be formed with horizontal ducts 904 to accommodate a horizontal reinforcing bar 906 inserted in the axially aligned ducts 904 of the selected precast panel and the adjacent precast panel as described, for example, in reference to FIG. 9.

Once the selected precast panel is horizontally interconnected to previously erected adjacent precast panels, in step 2750 it is determined whether there are more precast panels are required to complete current tier 112*a*, 112*b* or 112*c* of the precast wall system 100 (step 2744). If there are more precast panels required to complete the current tier (e.g., tier 112*a* in FIG. 18), the processing continues at step 2708 until each panel, including corner precast panels 104 (e.g., panels 34, 35, 36 and 37 in FIG. 28) are horizontally interconnected to complete the erection of the current tier (e.g., 112*a*).

If all the precast panels in the current tier have been erected and horizontally connected, then each of the temporary posts 2052*a* and 2052*b* and 2054*a* and 2054*b* employed in the support frames may be removed (step 2746). Once the precast panels requiring a connection to a respective support frame 120, 122, or 124 are actually connected to the respective support frame 120, 122, or 124 in accordance with the present invention, the temporary posts 2052*a* and 2052*b* and 2054*a* and 2054*b* are no longer needed to stabilize the secondary cross beam 2034 to one of the primary cross beams 2002 or 2032 of support frame 120, 122, or 124.

Similarly, once all the precast panels in the current tier have been erected and horizontally connected, then the connections between panels and erection aid platforms via the right angle brackets 2410 may be removed (step 2748).

If it is determined in step 2750 that more tiers (e.g., 112*b* and 112*c*) of precast panels need to be erected to complete the construction of the precast wall system 100, then each support frame 120, 122, and/or 124 for the next tier of precast panels (e.g., 112*b* or 112*c*) is installed relative to the last tier of precast panels (step 2752). For example, as shown in FIG. 20A, the brace members 2004 and 2012 of the support member 2000 (or the brace members 2004*a* and 2012*a* of the support member 2050) for a next tier 112*b* are connected to the gusset plate 1704 of a lower precast panel (e.g., the gusset plates of panels 102*b* and 106*b* that are disposed above the cross beam 2002 of the lower tier support frame 2000 depicted in FIG. 20A or the lower tier support frame 2050 in FIG. 20D) before the next tier precast panel (e.g., erected atop panels 102*b* and 106*b*) is lifted into position and connected to this next tier support member 2000 or 2050.

In addition, each erection aid platform 2400 is lifted to respective top corner of the previously erected tier of precast panel walls (step 2754) and processing is then continued at step 2708. In the example shown in FIG. 28, each erection aid platform 2400 is lifted to a respective top corner of the tier 112*a* of precast walls, where each top corner is defined by the corner precast panels 34, 35, 36, and 37 in FIG. 28. The erection aid platforms 2400 may each be lifted and supported relative to the top corner of the previously erected tier 112*a* as described in reference to FIG. 24.

If no more tiers (e.g., 112*b* and 112*c*) of precast panels need to be erected to complete the construction of the precast wall system 100, then each erection aid platform 2400 may be disconnected from the precast wall system and removed (step 2756). The erection aid platforms 2400 may be disassembled and stored or shipped to another site for use in erecting another precast wall system for another high-rise building.

Figure 29A:
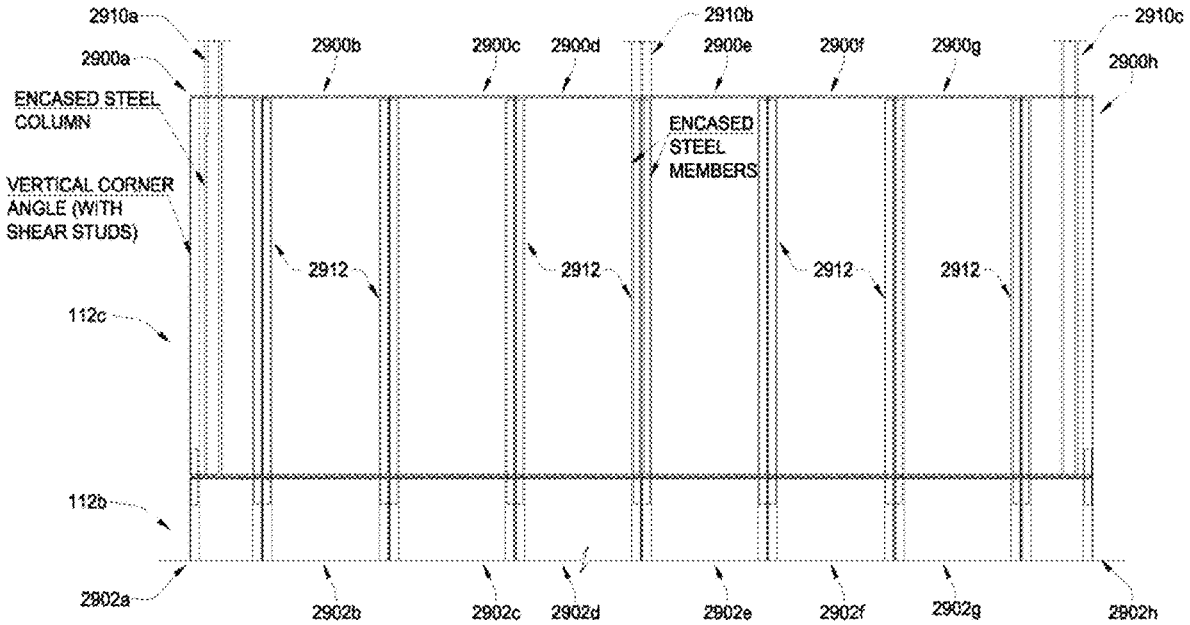
FIG. 29A is a front elevation view of two tiers of precast panels horizontally and vertically connected in accordance with the present invention, where the precast panels comprising the top tier are formed to support gravity columns for carrying a floor above the top tier of precast panels.

Turning to FIG. 29A, two tiers 112*b* and 112*c* of precast panels 2900*a*-*h* and 2902*a*-*h* horizontally and vertically connected in accordance with the present invention are shown to form a core wall system 100 for a high rise building. In the implementation shown in FIG. 29A, precast panels 2900*a*-*h* from the top tier 112*c* are formed to support gravity columns 2910*a*, 2910*b* and 2910*c* for carrying a floor above the top tier 112*c* of precast panels. Because large forces from the gravity columns 2910*a*-2910*c* are transferred directly to individual precast panels 2900*a*, 2900*d*, 2900*e* and 2900*h* that support these columns 2910*a*-2910*c*, large and stiffer panel-to-panel connections are employed between each of the panels in the top tier 112*c* and between the top tier 112*c* panels and the lower tier 112*b* panels. In the implementation shown in FIG. 29A, a respective continuous vertical lap plate 2912 is employed to connect (via respective welds) the corner edge angles (e.g., angles 2302*a* and 2302*b*) that are exposed on the front side 718 of adjacent panels 2900*d* and 2900*e* supporting a gravity column 2910*b* as well as between other adjacent panels in the same tier 112*c* (i.e., adjacent panels 2900*a* and 2900*b*, 2900*b* and 2900*c*, 2900*c* and 2900*d*, 2900*e* and 2900*f*, 2900*f* and 2900*g*, and 2900*g* and 2900*h*). Each of the continuous vertical lap plates 2912 preferably extend the length of the joint formed between the corner edge angles (e.g., angles 2302*a* and 2302*b*) of the adjacent panels in the top tier 112*c* of panels supporting the gravity columns 2910*a*-2910*c*. In one implementation, a lower end of each of the continuous vertical lap plates 2912 extends beyond the length of the joint between two respective adjacent panels (e.g., 2900*d* and 2900*e*) in the top tier 112*c* to also partially cover and connect (via a weld) to the corner edge angles (e.g., angles 2302*a* and 2302*b*) of two respective adjacent panels (e.g., 2902*d* and 2902*e*) in the lower tier 112*b*. In this implementation, the continuous vertical lap plates 2912 further reinforce the horizontal panel-to-panel connection 602 between horizontally adjacent panels in the top tier 112*c* of panels configured to support gravity columns 2910*a*-2910*c* as well as the vertical panel-to-panel connection 604 between panels in the top tier 112*c* and panels in the lower tier 112*b*.

Figure 29B:
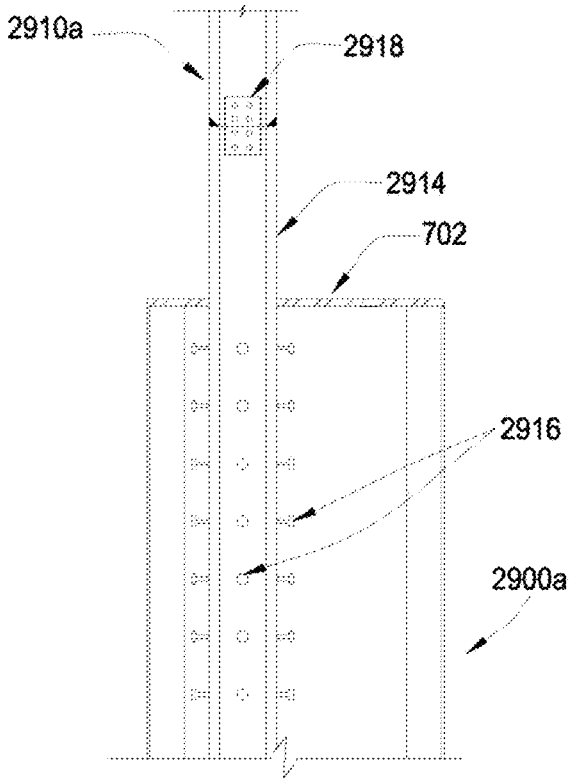
FIG. 29B is a vertical cross-sectional view of a corner precast panel in the top tier shown in FIG. 29A, where the corner precast panel includes a column member having an end partially encased in the panel and another end extending above the top of the panel to support a gravity column.
Figure 29C:
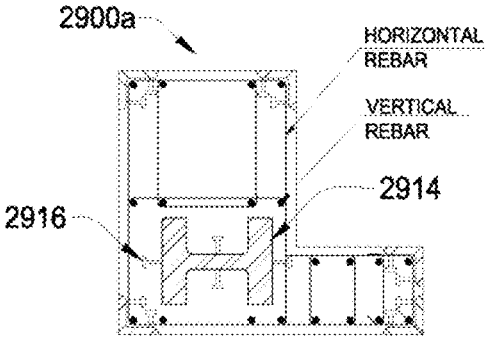
FIG. 29C is a horizontal cross-sectional view of the corner precast panel in FIG. 29B.

FIGS. 29B-29C, depict an exemplary corner precast panel 2900*a* in the top tier 112*c* in which the corner precast panel 2900*a* includes a column member 2914 having an end partially encased in the panel 2900*a* and another end extending above the top of the panel to support another gravity column 2910*a*. In the implementation shown in FIG. 29B, the panel 2900*a* is precast to have a top end plate 702 through which the column member 2914 extends and to which the column member may be affixed via a weld. The portion of the column member 2914 encased in the precast panel 2900*a* may have shear studs 2916 affixed about the column member 2914. The gravity column 2910*a* may be affixed (via a weld) to the one end of the column member 2914 extending above the top of the panel 2900*a*. In one implementation, one or more erection channels or plates 2918 (comprised of steel or other high strength material) may be used to connect or reinforce the connection between the gravity column 2910*a* and the column member 2914 to enable transfer of forces. As shown in FIG. 29B, each erection channel or plate 2918 is disposed to overlap the joint formed between the gravity column 2910*a* and the column member 2914 and then welded or otherwise affixed to the respective columns 2910*a* and 2914. As shown in FIG. 29C, the column member 2914 may be an I-beam. However, the column member 2914 may have another shape such as a square or rectangular post (nevertheless, the gravity column 2910*a* and the column member 2914 should preferably have similar shapes).

Figure 29D:
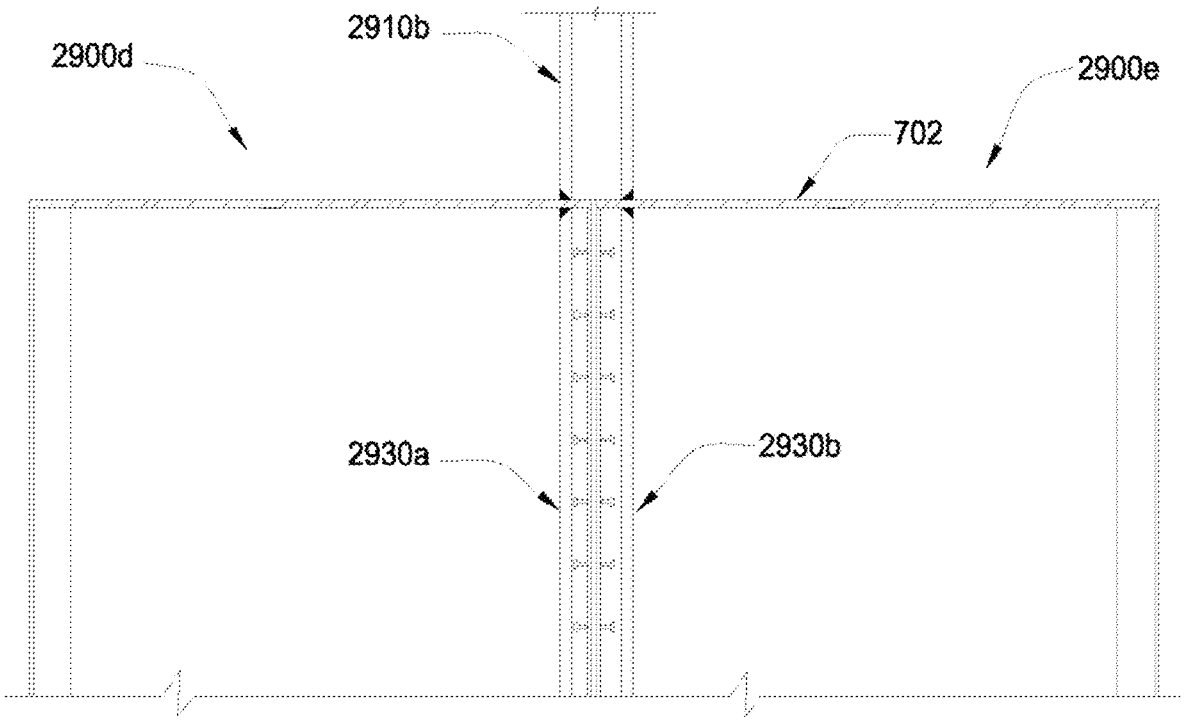
FIG. 29D is an enlarged front elevation view of two precast interior panels in the top tier shown in FIG. 29A with a cut-away view of the adjacent sides of the two interior panels, where each panel has a corresponding half of a column member embedded in the panel's side for collectively supporting a gravity column above and between the two panels.
Figure 29E:
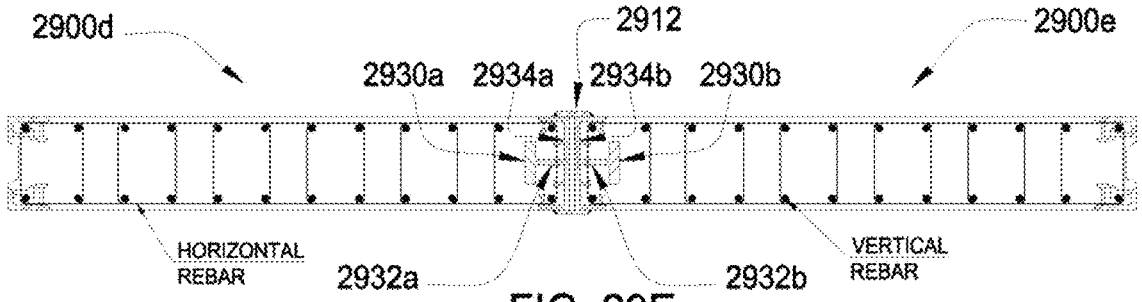
FIG. 29E is a horizontal cross-sectional view of the two precast interior panels as shown in FIG. 29D, where the column member is oriented so that the web of the column member is parallel to the front side of the panels.

FIG. 29D depicts an enlarged front elevation view of one implementation of the two precast interior panels 2900*d* and 2900*e* in the top tier 112*c* with a cut-away view of the adjacent sides of the two interior panels 2900*d* and 2900*e*. FIG. 29E is a horizontal cross-sectional view of the two precast interior panels 2900*d* and 2900*e*. Each panel 2900*d* and 2900*e* has a corresponding half 2930*a* or 2930*b* of a column member embedded in the respective panel's side for collectively supporting a gravity column 2910*b* above and between the two panels 2900*d* and 2900*e*. As shown in FIG. 29E, each column member half 2930*a* or 2930*b* is oriented so that the web (i.e., 2932*a* or 2932*b*) of each column member half is parallel to the front side of the panels 2900*d* and 2900*e*. In this implementation, each column member half 2930*a* and 2930*b* corresponds to half of an I-beam with a plate 2934*a* or 2934*b* that is affixed to the web 2932*a* or 2932 of the column member half 2930*a* or 2930*b* and that defines the one side of the panel 2900*d* or 2900*e* facing the adjacent panel 2900*e* or 2900*d* having the corresponding column member half 2930*b* or 2930*a*. Each column member half 2930*a* and 2930*b* may be encased in the respective panel 2900*d* or 2900*e* so that a top end of the column member half 2930*a* and 2930*b* abuts the top end plate 702 of the panel 2900*d* or 2900*e* (as shown in FIG. 29D) or extends above the top of the panel. The top end of each column member half 2930*a* and 2930*b* may then be affixed or welded to the top end plate 702 of the respective panel 2900*d* or 2900*e*. The gravity column 2910*b* may then be supported on and affixed to (via welds) the end plates 702 of the two panels 2900*d* or 2900*e* directly over the column member 2930 defined by the two column member halves 2930*a* and 2930*b* when the two panels 2900*d* or 2900*e* are positioned horizontally, side-by-side, adjacent to each other. Alternatively, if the each column member half 2930*a* and 2930*b* is encased in the respective panel 2900*d* or 2900*e* so that a top end of the column member half 2930*a* and 2930*b* extends above the top of the panel, the gravity column 2910*b* may then be supported on and affixed to (via welds) directly to the top end of the column member halves 2930*a* and 2930*b* when the two panels 2900*d* or 2900*e* are positioned horizontally, side-by-side, adjacent to each other. As previously noted, to reinforce the horizontal connection between the two precast panels 2900*d* and 2900*e*, a vertical lap plate 2912 may be employed to connect (via respective welds) the corner edge angles (e.g., angles 2302*a* and 2302*b*) that are exposed on the front side 718 of adjacent panels 2900*d* and 2900*e* so that the lap plate 2912 substantially covers the joint formed between the adjacent sides of the panels 2900*d* and 2900*e* that are defined by the facing plates 2934*a* and 2934*b* of the column member halves 2930*a* and 2930*b*.

Figure 29F:
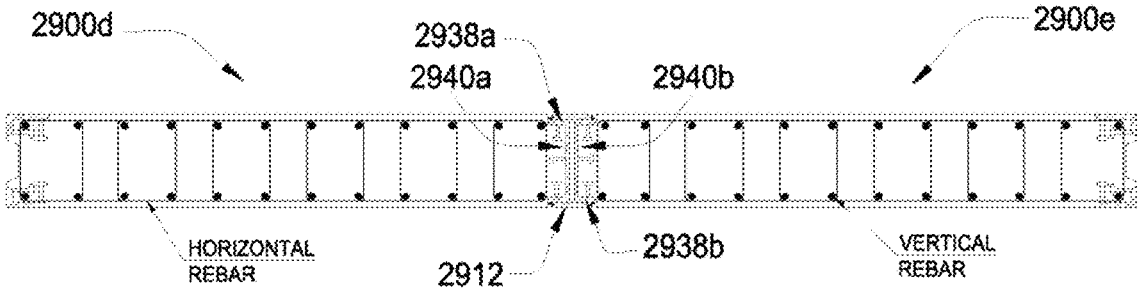
FIG. 29F is a horizontal cross-sectional view of the two precast interior panels as shown in FIG. 29D, where the column member is oriented so that the web of the column member is perpendicular to the front side of the panels.

In an alternative implementation as shown in FIG. 29F, when the gravity column 2910*b* is to be oriented so that the web of the gravity column 2910*b* is perpendicular to the front side of the panels 2900*d* and 2900*e*, each panel 2900*d* and 2900*e* may have a column member half 2938*a* or 2938*b* is similarly oriented to collectively support the gravity column 2910*b*. In this implementation, each column member half 2938*a* and 2938*b* has a substantially "C" shape corresponding to half of an I-beam split along the axis of the web 2940 (i.e., defined by webs 2940*a* and 2940*b* in FIG. 29F) of the I-beam (i.e., collectively defined by the column member halves 2938*a* and 2938*b* in FIG. 29F) perpendicular to the horizontal parallel plates of the I-beam web. In one embodiment consistent with the present invention, the column members 2938*a* and 2938*b* are channel sections. In another embodiment consistent with the present invention, the column members 2938*a* and 2938*b* are formed by welding three plates together. As shown in FIG. 29F, each column member half 2938*a* and 2938*b* is oriented so that the web 2940*a* and 2940*b* of each column member half is perpendicular to the front side of the panels 2900*d* and 2900*e* and defines the one side of the panel 2900*d* or 2900*e* facing the adjacent panel 2900*e* or 2900*d* having the corresponding column member half 2938*b* or 2938*a*. Like the previous implementation, each column member half 2940*a* and 2940*b* is encased in the respective panel 2900*d* or 2900*e* so that a top end of the column member half 2938*a* and 2938*b* abuts the top end plate 702 of the panel 2900*d* or 2900*e* or extends above the top of the panel. The top end of each column member half 2938*a* and 2938*b* may then be affixed or welded to the top end plate 702 of the respective panel 2900*d* or 2900*e*. The gravity column 2910*b* may then be supported on and affixed to (via welds) the end plates 702 of the two panels 2900*d* or 2900*e* directly over the column member 2938 defined by the two column member halves 2938*a* and 2938*b* when the two panels 2900*d* or 2900*e* are positioned horizontally, side-by-side, adjacent to each other. Alternatively, if the each column member half 2938*a* and 2938*b* is encased in the respective panel 2900*d* or 2900*e* so that a top end of the column member half 2938*a* and 2938*b* extends above the top of the panel, the gravity column 2910*b* may then be supported on and affixed to (via welds) directly to the top end of the column member halves 2938*a* and 2938*b* when the two panels 2900*d* or 2900*e* are positioned horizontally, side-by-side, adjacent to each other. A vertical lap plate 2912 may then be employed to connect (via respective welds) the column member halves 2938*a* and 2938*b* that are exposed on the front side 718 of adjacent panels 2900*d* and 2900*e* so that the lap plate 2912 substantially covers the joint formed between the adjacent sides of the panels 2900*d* and 2900*e* that are defined by the column member halves 2938*a* and 2938*b*.

The precast wall system 100 and precast panels 102, 104, 106, 108 and 110 as described herein retain the advantages of a cast-in-place concrete core wall while eliminating the field labor intensity associated with layout, formworks, field installed rebar, field locating and placement of embedded plates, concrete pouring, curing, forms stripping or jacking in the case of a mechanized forming system. A precast wall system consistent with the present invention is also able to serve as the main lateral bracing system of the building as well as the support for the gravity loads or function in combination with typical systems used for high-rise buildings (e.g., perimeter frame with outriggers). Thus, a precast core or perimeter wall system consistent with the present invention is a more efficient, cost effective and viable alternate to cast-in-place construction.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. Accordingly, while various embodiments of the present invention have been described, it will be apparent to those of skill in the art that many more embodiments and implementations are possible that are within the scope of this invention. Accordingly, the present invention is not to be restricted except in light of the attached claims and their equivalents.

What is claimed:

1. A precast structural wall panel comprising:

a panel portion which is a set or cured pour of cementitious material and having a top end, a bottom end, a front side extending between the top end and the bottom end, a back side extending between the top end and the bottom end;

a connection side extending between a first edge of the front side and a first edge of the back side, the connection side forming respective vertically extending vertical corner edges with the front side and the back side;

a top end plate on the top end of the panel portion and a bottom end plate on the bottom end of the panel portion, each of which end plates being made of a metallic material;

vertical bars and (a) horizontal bars or (b) horizontal ties embedded in the set or cured cementitious material and arrayed to reinforce the precast structural wall panel, the vertical bars being connected to the top plate and the bottom plate and being effective to transfer high-rise building vertical loads from the top plate to the bottom plate, the vertical bars arranged in at least a first row along the front side and a second row along the back side;

structural angles extending vertically along outer sides of the vertical corner edges of the connection side and at least partially embedded in the panel portion cementitious material so as to have exposed outer surfaces, one leg of each structural angle extending along the connection side while another leg of the structural angle extends along the front side or the back side, the structural angles being made of a metallic material, the structural angles enabling welding to the exposed outer surfaces; and shear transfer structures embedded in the panel portion and securing the structural angles to the panel portion.

2. The precast structural wall panel of claim 1, wherein the structural angles are embedded in the connection side of the panel portion, the front side, and the back side with cementitious material of the connection side in a region separating the structural angles being exposed.

3. The precast wall structural panel of claim 2, wherein the shear transfer structures comprise shear studs embedded in the panel portion and securing the structural angles to the panel portion.

4. The precast wall structural panel of claim 1, wherein the shear transfer structures comprise shear studs embedded in the panel portion and securing the structural angles to the panel portion.

5. The precast structural wall panel of claim 1, further comprising vertical ducts extending vertically within the panel portion, each of the top end plate and the bottom end plate having openings aligned with ends of each vertical duct reaching the top end or bottom end, respectively.

6. The precast structural wall panel of claim 5, further comprising vertical tensioning reinforcing bars or tensioning cables within the vertical ducts.

7. The precast structural wall panel of claim 6, wherein, in horizontal cross section, the vertical bars and vertical tensioning reinforcing bars occupy 0.12 percent to 8 percent of the panel portion.

8. The precast structural wall panel of claim 5, further comprising horizontal ducts extending horizontally within the panel portion and having openings at the connection side.

9. The precast structural wall panel of claim 8, further comprising horizontal tensioning reinforcing bars or tensioning cables in the horizontal ducts.

10. The precast structural wall panel of claim 1, wherein the cementitious material is any standard construction cement, epoxy-resins without course aggregate, concrete, or any combination thereof.

11. The precast structural wall panel of claim 1, wherein the cementitious material has a compressive strength in a range of 5,000 psi and 20,000 psi.

12. The precast structural wall panel of claim 1, wherein the cementitious material includes pozzolan, aggregate, or fibers.

13. The precast structural wall panel of claim 1, wherein at least one of the vertical bars is secured to the top end plate or the bottom end plate by means of a coupler secured to an internal surface of the bottom end plate, the coupler receiving an end of the one vertical bar within a cavity thereof, the end of the one vertical bar secured to the coupler.

14. The precast structural wall panel of claim 13, wherein at least one of the couplers is a rebar coupler.

15. The precast structural wall panel of claim 13, wherein the cavity of at least one of the couplers is threaded.

16. The precast structural wall panel of claim 13, wherein the end of the at least one of the vertical bars is secured to the coupler by means of a plurality of vertically aligned threaded fasteners.

17. The precast structural wall panel of claim 1, further comprising a horizontal plate extending between and secured to two of the vertical corner angles.

18. The precast structural wall panel of claim 17, wherein the horizontal plate is partially embedded in the connection side and secured to the panel portion by means of other shear transfer structures embedded in the panel portion.

19. The precast structural wall panel of claim 18, wherein the other shear transfer structures embedded in the panel comprise other shear studs.

20. The precast structural wall panel of claim 1, wherein the top end plate or the bottom end plate extends beyond the top end or the bottom end, respectively to define a perimeter that is greater than a perimeter of a horizontal cross section of the panel portion.

21. The precast structural wall panel of claim 1, wherein each of the top end plate and the bottom end plate extends beyond the top end and bottom end, respectively, to define perimeters that are each greater than a perimeter of a horizontal cross section of the panel portion.

22. The precast structural wall panel of claim 1, further comprising a horizontal link beam with a first end extending from the connection side of the precast structural wall panel and a second end embedded in the panel portion.

23. The precast structural wall panel of claim 1, wherein the connection side has shear keys formed or disposed on the connection side.

24. The precast structural wall panel of claim 23, wherein the shear keys are formed of the cementitious material.

25. The precast structural wall panel of claim 23, wherein the shear keys mate with shear keys of another precast structural wall panel.

26. The precast structural wall panel of claim 1, wherein, in horizontal cross section, the vertical bars occupy 0.12 percent to 8 percent of the panel portion.

27. The precast structural wall panel of claim 1 comprising a support column with an end disposed in the panel portion between the rows of vertical bars and encased by the cementitious material.

28. The precast structural wall panel of claim 1, wherein the precast structural wall panel is an L-shaped corner panel and the panel portion is one leg of the L-shape of the precast structural wall panel.

29. The precast structural wall panel of claim 1, wherein the precast structural wall panel is rectangular-shaped with a left vertical side and a right vertical side, and the connection side is the left vertical side or the right vertical side.

30. The precast structural wall panel of claim 1, further comprising horizontal ducts extending horizontally within the panel portion and having respective openings at the connection side.

31. The precast structural wall panel of claim 30, further comprising horizontal tensioning reinforcing bars or tensioning cables in the horizontal ducts.

32. The precast structural wall panel of claim 1, wherein the cementitious material has a compressive strength of at least 5,000 psi.

* * * * *